US009147518B1

(12) United States Patent
Nakamura et al.

(10) Patent No.: US 9,147,518 B1
(45) Date of Patent: Sep. 29, 2015

(54) INDUCTOR AND COIL SUBSTRATE

(71) Applicant: Shinko Electric Industries Co., Ltd., Nagano-ken (JP)

(72) Inventors: Atsushi Nakamura, Nagano (JP); Tsukasa Nakanishi, Nagano (JP); Takayuki Matsumoto, Nagano (JP)

(73) Assignee: Shinko Electric Industries Co., Ltd., Nagano-ken (JP)

( * ) Notice: Subject to any disclaimer, the term of this patent is extended or adjusted under 35 U.S.C. 154(b) by 0 days.

(21) Appl. No.: 14/661,535

(22) Filed: Mar. 18, 2015

(30) Foreign Application Priority Data

Mar. 20, 2014 (JP) ..... 2014-058650

(51) Int. Cl.
*H01F 5/00* (2006.01)
*H01F 27/28* (2006.01)

(52) U.S. Cl.
CPC ..... *H01F 27/2804* (2013.01); *H01F 5/00* (2013.01); *H01F 2027/2809* (2013.01)

(58) Field of Classification Search
CPC ..... H01F 5/00; H01F 27/00–27/30
USPC ..... 336/65, 83, 200, 232; 257/531
See application file for complete search history.

(56) References Cited

U.S. PATENT DOCUMENTS

| | | | | | |
|---|---|---|---|---|---|
| 4,959,631 | A * | 9/1990 | Hasegawa et al. | ..... | 336/83 |
| 5,359,315 | A * | 10/1994 | Inoue et al. | ..... | 336/200 |
| 5,363,080 | A * | 11/1994 | Breen | ..... | 336/192 |
| 2014/0167897 | A1 * | 6/2014 | Choi et al. | ..... | 336/83 |

FOREIGN PATENT DOCUMENTS

JP 2003-168610 6/2003

* cited by examiner

*Primary Examiner* — Tuyen Nguyen
(74) *Attorney, Agent, or Firm* — Fish & Richardson P.C.

(57) ABSTRACT

An inductor includes a stacked structure. The stacked structure includes a substrate, a first structural body stacked on a lower surface of the substrate, and second structural bodies sequentially stacked on an upper surface of the substrate. A through hole extends through the stacked structure in a thickness direction. An insulation film covers the stacked structure. The first structural body includes a first insulating layer stacked on the lower surface of the substrate, and a first wiring stacked on a lower surface of the first insulating layer. The second structural bodies include second insulating layers and second wirings. The first wiring and the second wirings are connected in series to one another to form a helical coil. The substrate has a thickness greater than that of the first insulating layer and the second insulating layers.

11 Claims, 33 Drawing Sheets

INDUCTOR AND COIL SUBSTRATE

CROSS-REFERENCE TO RELATED APPLICATIONS

This application is based upon and claims the benefit of priority from prior Japanese Patent Application No. 2014-058650, filed on Mar. 20, 2014, the entire contents of which are incorporated herein by reference.

FIELD

This disclosure relates to an inductor, a coil substrate, and a method for manufacturing a coil substrate.

BACKGROUND

In recent years, miniaturization in electronic devices, such as a game machine or a mobile phone, has been accelerated. Accordingly, the demand has been increased for miniaturization of various types of elements such as an inductor to be incorporated in such electronic devices. For example, an inductor using a winding coil is incorporated in such electronic devices. The inductor using the winding coil is employed in, for example, a power supply circuit or the like of the electronic device (see Japanese Laid-Open Patent Publication No. 2003-168610).

The limitation in downsizing of the inductor using the winding coil is considered to be about 1.6 mm×1.6 mm in its planner shape. This is because the thickness of the winding is limited. If the inductor is downsized such that the size thereof exceeds the limitation, the ratio of the volume of the winding to the whole area of the inductor decreases. This hinders the increase of the inductance. An inductor capable of easily realizing miniaturization is desired.

SUMMARY

One aspect of this disclosure is an inductor. The inductor includes a stacked structure. The stacked structure includes a substrate, a first structural body stacked on a lower surface of the substrate, and a plurality of second structural bodies sequentially stacked on an upper surface of the substrate. A through hole extends through the stacked structure in a thickness direction. An insulation film covers the stacked structure. The first structural body includes a first insulating layer, which is stacked on the lower surface of the substrate, and a first wiring, which is stacked on a lower surface of the first insulating layer. The first wiring is positioned at a lowermost layer of the stacked structure. The second structural bodies include a plurality of second insulating layers and a plurality of second wirings, respectively. One of the second insulating layers is positioned at an uppermost layer of the stacked structure. Each of the second insulating layers is stacked on an upper surface of a corresponding one of the second wirings. An inner surface of the substrate, an inner surface of the first structural body, and inner surfaces of the second structural bodies define an inner wall surface of the through hole. The first wiring includes a first connection portion. The second wiring of the uppermost one of the second structural bodies includes a second connection portion. The insulation film covers the stacked structure except for a surface of the stacked structure on which the first connection portion and the second connection portion are exposed. The first wiring and the second wirings are connected in series to one another to form a helical coil. The substrate has a thickness greater than that of the first insulating layer and greater than that of each of the second insulating layers.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

Figure 1:
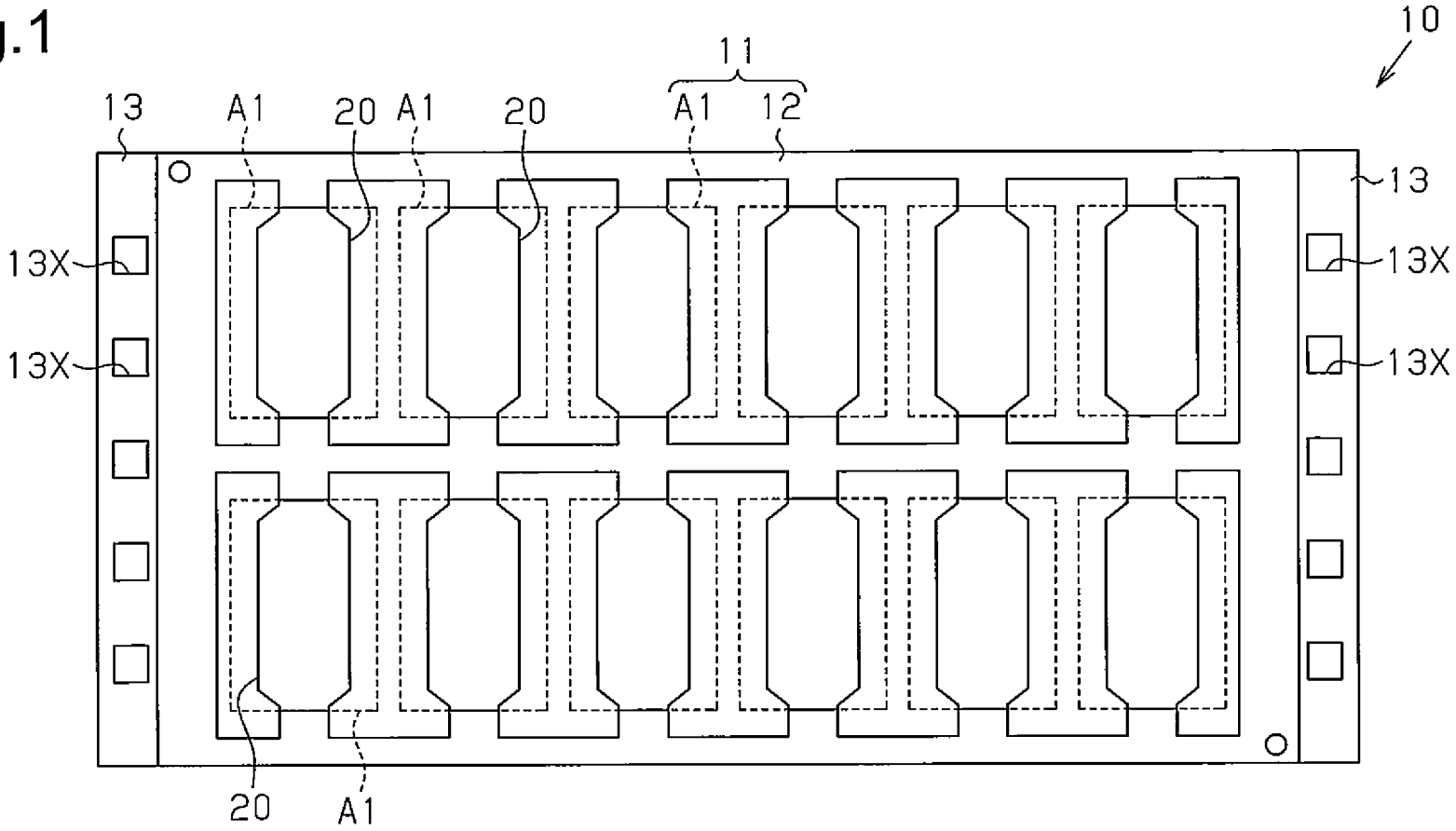
FIG. 1 is a schematic plan view illustrating a coil substrate according to one embodiment.

One embodiment will now be described with reference to the accompanying drawings. Elements in the drawings are illustrated for simplicity and clarity and have not necessarily been drawn to scale. In the cross-sectional views, hatching of some elements is omitted and the hatching of some elements is changed to be shaded for clarity.

First, the structure of a coil substrate 10 will now be described.

As illustrated in FIG. 1, the coil substrate 10 is formed, for example, in a substantially rectangular shape in the planar view. The coil substrate 10 includes a block 11 and two outer frames 13 projecting outward from the block 11. The block 11 is formed, for example, in a substantially rectangular shape in the planar view. Individual areas A1 are arranged in a matrix manner (in this example, 2×6) in the block 11. The block 11 is eventually cut along a broken line (each individual area A1) and fragmentized into individual unit coil substrates 20 (hereinafter, simply referred to also as "coil substrates 20"). In other words, the block 11 includes individual areas A1 each of which is used as the coil substrate 20.

The individual areas A1 may be arranged at a predetermined interval as illustrated in FIG. 1, or may be arranged such that they are in contact with one another. In the example illustrated in FIG. 1, the block 11 has twelve individual areas A1, but there is no particular limit to the number of the individual areas A1.

The block 11 includes a connection 12 that connect the coil substrates 20 to each other. The connection 12 supports and surrounds the coil substrates 20.

The outer frame 13 is formed at, for example, both end areas of the coil substrate 10. The outer frame 13 projects outward from, for example, a short side of the block 11. Sprocket holes 13X are formed in the outer frame 13. The sprocket holes 13X are continuously arranged at a substantially constant interval along, for example, a short side of the coil substrate 10 (in a vertical direction in FIG. 1). Each of the sprocket holes 13X has, for example, a substantially rectangular shape in the planar view. The sprocket hole 13X is a through hole used for transferring the coil substrate 10 and is engaged with a pin of a sprocket driven by a motor or the like so as to transfer the coil substrate 10 by a pitch between the sprocket holes 13X when the coil substrate 10 is mounted to a manufacturing apparatus. Thus, the interval between the adjacent sprocket holes 13X is set in correspondence to the manufacturing apparatus to which the coil substrate 10 is mounted. A portion of the coil substrate 10 except for the individual areas A1 (that is, the connection 12 and the outer frame 13) is discarded after being fragmentized into the individual coil substrates 20.

Next, the structure of the individual coil substrate 20 will now be described with reference to FIGS. 2 to 7.

Figure 2:
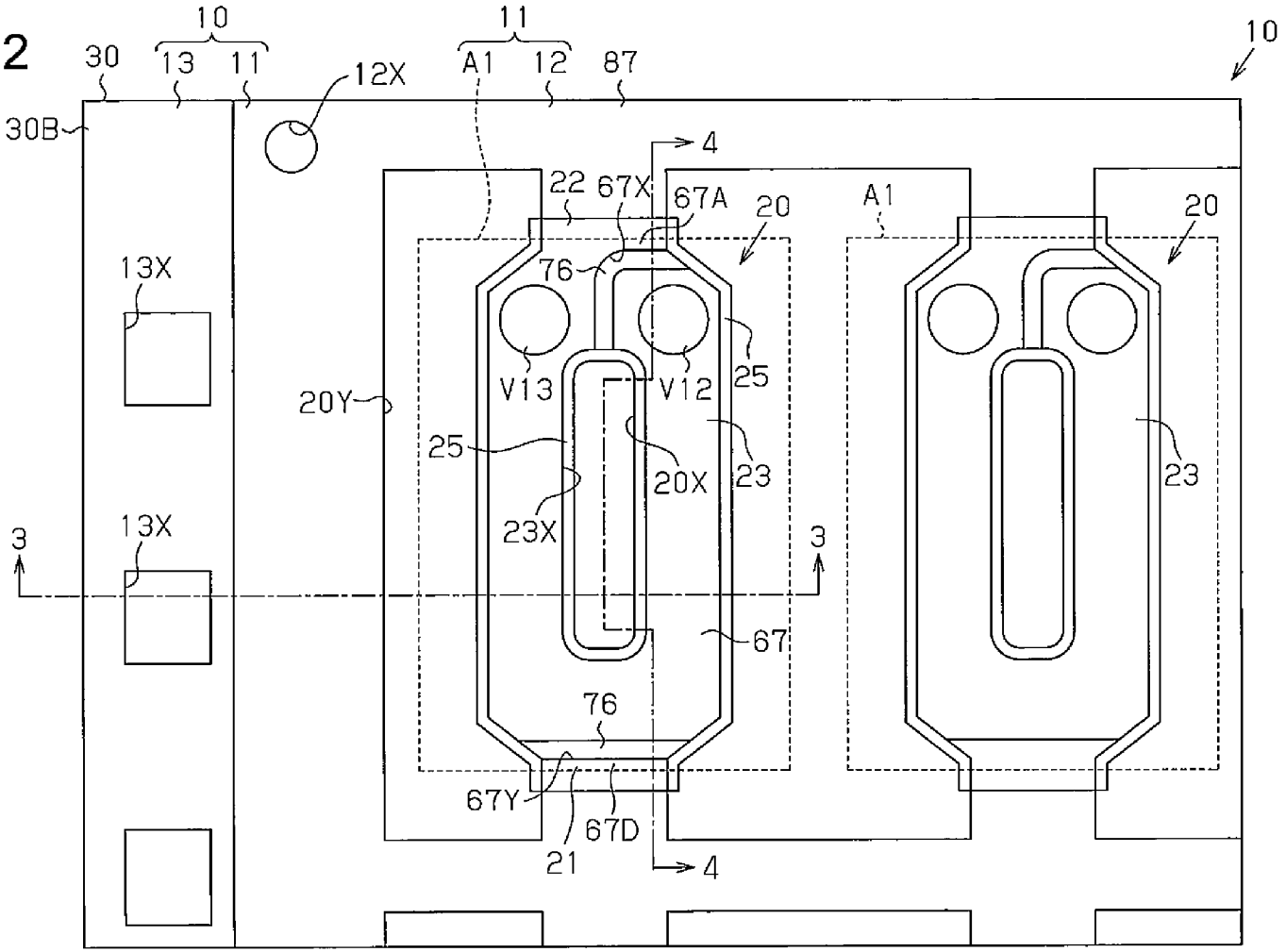
FIG. 2 is an enlarged plan view illustrating a part of the coil substrate of FIG. 1.

As illustrated in FIG. 2, the coil substrate 20 of each individual area A1 is formed in, for example, a substantially rectangular shape in the planar view. For example, the planar shape of the coil substrate 20 is a rectangular of which corners are chamfered. The coil substrate 20 includes projecting portions 21 and 22 projecting outward (upward and downward in FIG. 2) from short sides of the rectangular. However, the planar shape of the coil substrate 20 is not limited to the shape illustrated in FIG. 2, but may have any shape. In addition, the planar shape of the coil substrate 20 may have any size. For example, the coil substrate 20 may have a size such that when an inductor 90 illustrated in FIG. 8B is manufactured from the coil substrate 20, the planar shape of the inductor 90 may be substantially rectangular of about 1.6 mm×0.8 mm. The thickness of the coil substrate 20 may be, for example, about 0.5 mm.

A through hole 20X is formed at a substantially center portion of the coil substrate 20 in the planar view. The through hole 20X extends through the coil substrate 20 in the thickness direction. The planar shape of the through hole 20X may have any shape and any size. For example, the planar shape of the through hole 20X may be a substantially oval shape or elliptical shape.

An opening 20Y is formed between the coil substrate 20 and the connection 12 to define the coil substrate 20. The opening 20Y extends through the coil substrate 10 in the thickness direction.

Figure 3:
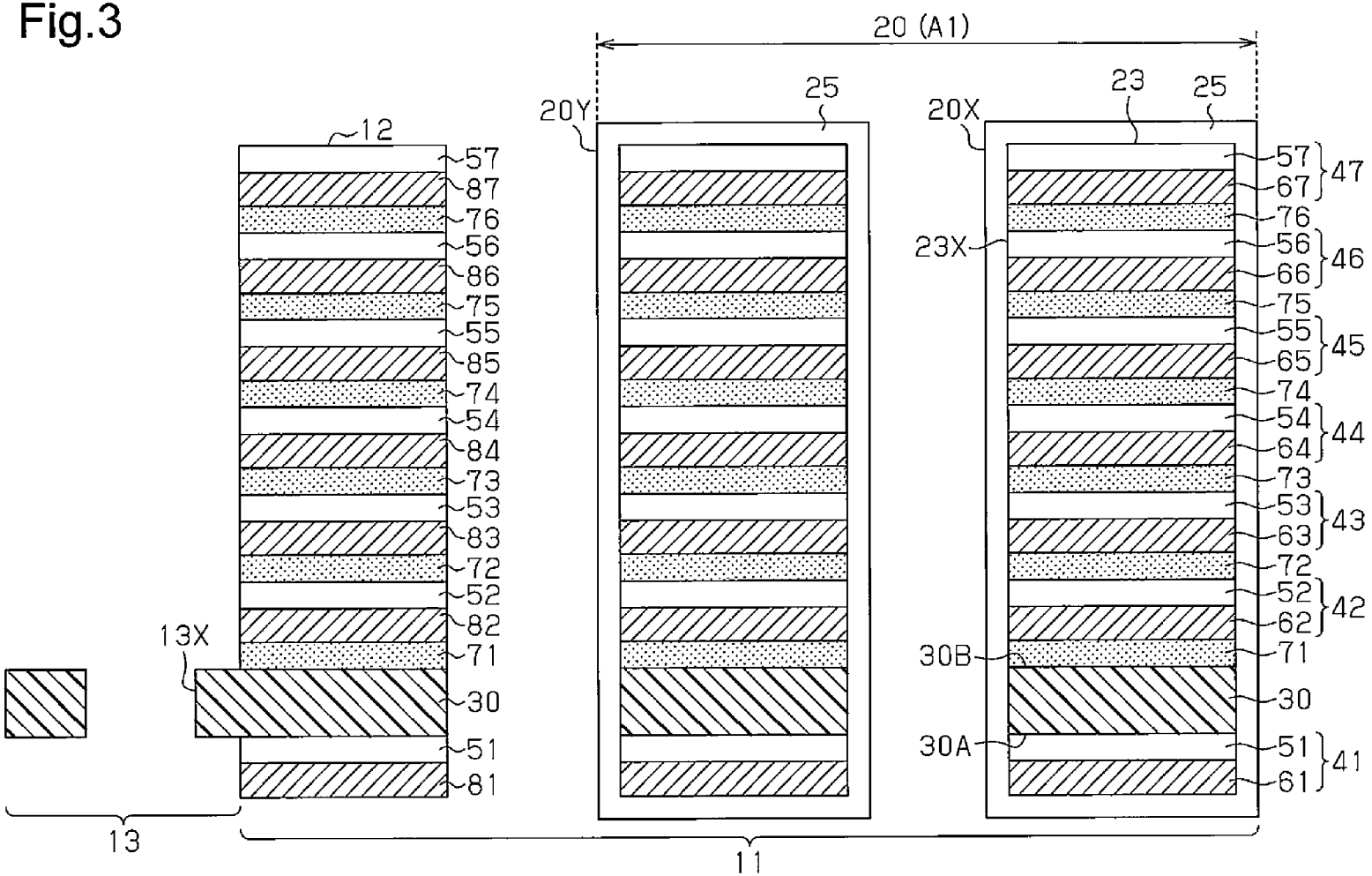
FIG. 3 is a schematic cross-sectional view of the coil substrate taken along line 3-3 in FIG. 2.
Figure 4:
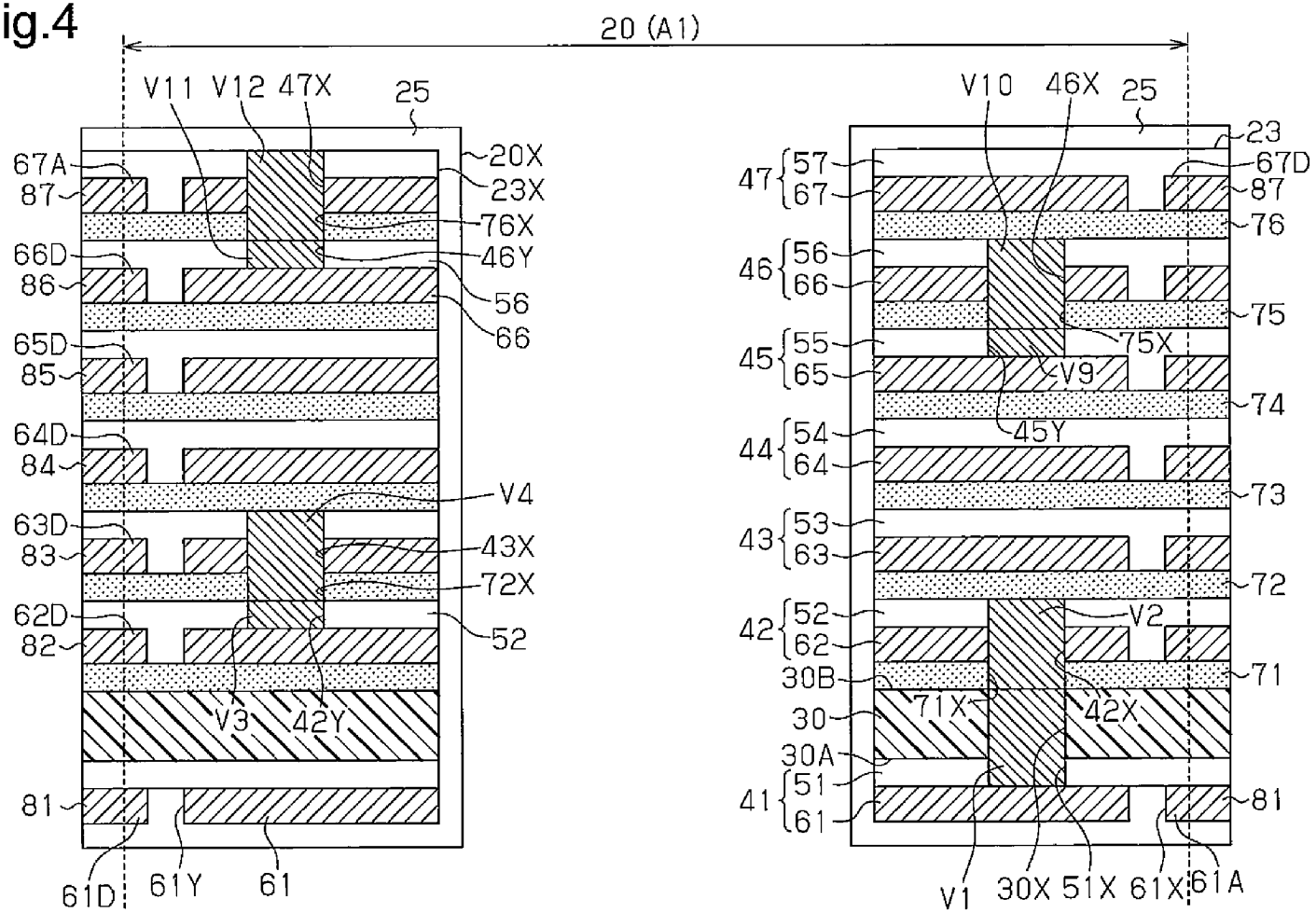
FIG. 4 is a schematic cross-sectional view of a unit coil substrate taken along line 4-4 in FIG. 2.

As illustrated in FIGS. 3 and 4, the coil substrate 20 includes a stacked structure 23 and an insulation film 25 that covers the surface of the stacked structure 23. The stacked structure 23 includes a substrate 30, a structural body 41 stacked on a lower surface 30A of the substrate 30, and structural bodies 42 to 47 sequentially stacked on an upper surface 30B of the substrate 30.

The planar shape of the stacked structure 23 is substantially the same as the planar shape of the coil substrate 20. For example, the planar shape of the stacked structure 23 is slightly smaller than that of the coil substrate 20 by a portion corresponding to the insulation film 25. In addition, a through hole 23X extends through the stacked structure 23 in the thickness direction at a substantially center portion of the stacked structure 23 in the planar view. In the same manner as the planar shape of the through hole 20X, the planar shape of the through hole 23X may be, for example, a substantially oval shape or elliptical shape.

In the stacked structure 23, the structural body 42 is stacked on the upper surface 30B of the substrate 30 via an adhesive layer 71. The structural body 43 is stacked on the structural body 42 via an adhesive layer 72. The structural body 44 is stacked on the structural body 43 via an adhesive layer 73. The structural body 45 is stacked on the structural body 44 via an adhesive layer 74. The structural body 46 is stacked on the structural body 45 via an adhesive layer 75. The structural body 47 is stacked on the structural body 46 via an adhesive layer 76.

A heat resistant adhesive made of an insulating resin may be used, for example, as the adhesive layers 71 to 76. For example, an epoxy adhesive may be used for the adhesive layers 71 to 76. Each thickness of the adhesive layers 71 to 76 may be, for example, about 12 to 35 μm.

As illustrated in FIG. 4, the structural body 41 includes an insulating layer 51, a wiring 61, a connection portion 61A, and a metal layer 61D. The structural body 42 includes an insulating layer 52, a wiring 62, and a metal layer 62D. The structural body 43 includes an insulating layer 53, a wiring 63, and a metal layer 63D. The structural body 44 includes an insulating layer 54, a wiring 64, and a metal layer 64D. The structural body 45 includes an insulating layer 55, a wiring 65, and a metal layer 65D. The structural body 46 includes an insulating layer 56, a wiring 66, and a metal layer 66D. The structural body 47 includes an insulating layer 57, a wiring 67, a connection portion 67A, and a metal layer 67D.

For example, an insulating resin containing an epoxy resin as a main component may be used as the material of the insulating layers 51 to 57. Alternatively, an insulating resin containing a thermosetting resin as a main component may be used as the material of the insulating layers 51 to 57. Further, the insulating layers 51 to 57 may include, for example, a filler such as silica and alumina. The coefficient of thermal expansion of the insulating layers 51 to 57 may be, for example, about 50 to 120 ppm/° C. Each thickness of the insulating layers 51 to 57 may be, for example, about 12 μm to 20 μm.

The wiring 61 is located in the lowermost wiring layer. Preferably, for example, a metal material having a greater adhesion with the insulation film 25 than the substrate 30 is used as the material of the wiring 61, the connection portion 61A, and the metal layer 61D. For example, copper (Cu) or a copper alloy may be used as the material of the wiring 61, the connection portion 61A, and the metal layer 61D. Similarly, copper or a copper alloy may be used, for example, as the material of the wirings 62 to 67, the connection portion 67A, and the metal layers 62D to 67D. Each thickness of the wirings 61 to 67, the connection portions 61A and 67A, and the metal layers 61D to 67D may be, for example, about 12 to 35 μm.

For example, a sheet-like insulating substrate may be used as the substrate 30. For example, an insulating resin may be used as the material of the substrate 30. The insulating resin is preferably adjusted such that the thermal expansion coefficient of the substrate 30 is smaller than the thermal expansion coefficient of each of the insulating layers 51 to 57. For example, the thermal expansion coefficient of the substrate 30 is set to about 10 to 25 ppm/° C. In addition, for example, the material having an excellent heat resistance is preferable as the material of the substrate 30. Further, the material having a higher elastic modulus than the insulating layers 51 to 57 is preferable as the material of the substrate 30. A resin film, such as a polyimide (PI) film or a polyethylene naphthalate (PEN) film, may be used for the substrate 30. For example, the polyimide film having a small thermal expansion coefficient may be preferably used for the substrate 30. For example, the thickness of the substrate 30 is set to be larger than the thickness of each of the insulating layers 51 to 57. The thickness of the substrate 30 may be set to, for example, about 12 μm to 50 μm. The substrate 30 having such a thickness has a greater rigidity than each of the insulating layers 51 to 57.

Figure 5:
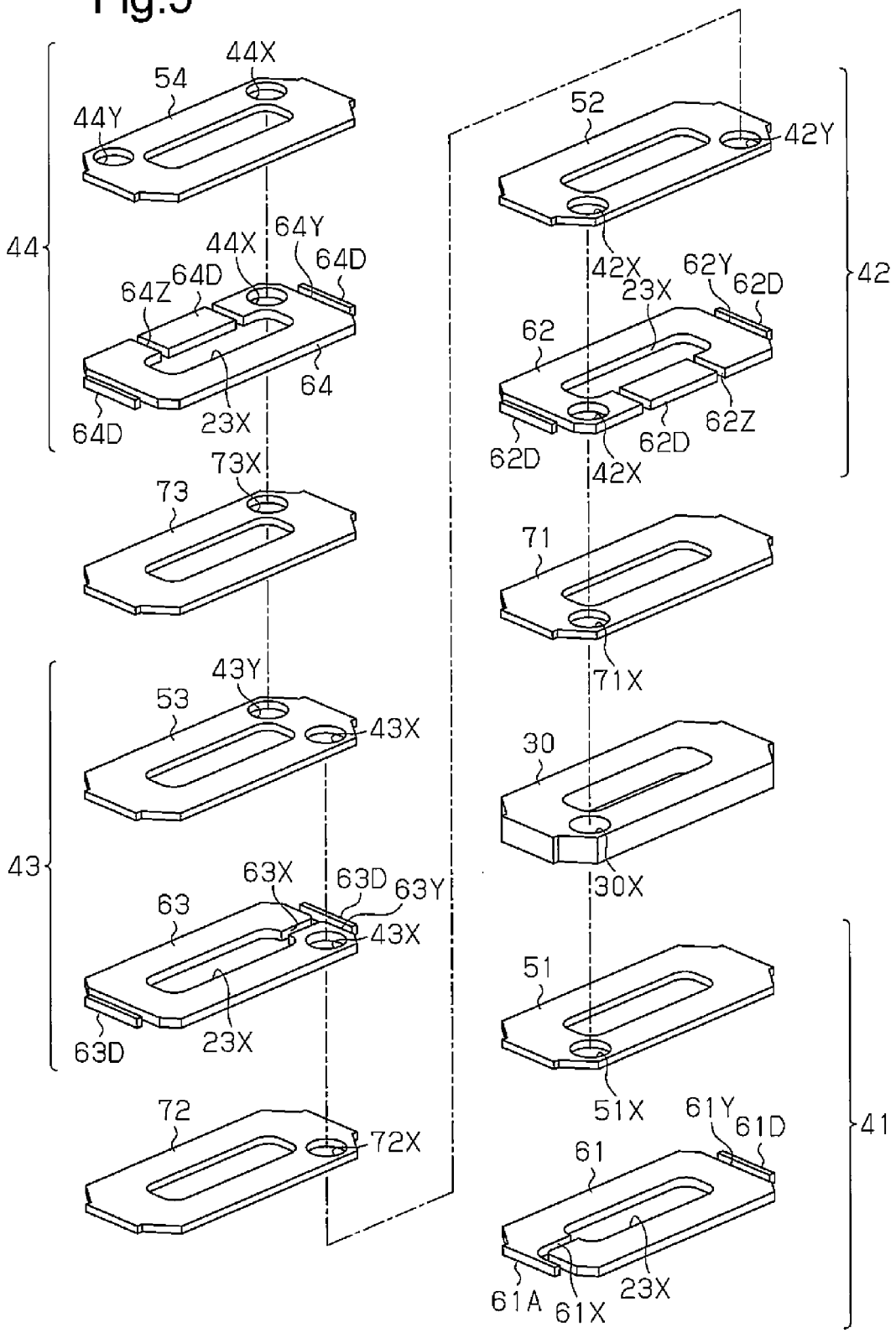
FIGS. 5 and 6 are exploded perspective views of a stacked structure of the unit coil substrate.

As illustrated in FIGS. 4 and 5, a through hole 30X extends through the substrate 30 in the thickness direction. The through hole 30X may have any planar shape and size. For example, the through hole 30X may be a circular shape having the diameter of about 150 μm.

Next, the structure of the structural body 41 will now be described.

The insulating layer 51 is stacked on the lower surface 30A of the substrate 30. A through hole 51X extends through the insulating layer 51 in the thickness direction. The through hole 51X communicates with the through hole 30X of the substrate 30. In other words, the through hole 51X is formed at a position overlapping the through hole 30X in the planar view. A via wiring V1 is formed in the through holes 30X and 51X. In other words, the through holes 30X and 51X are filled with the via wiring V1. The via wiring V1 is electrically connected to the wiring 61. For example, copper or a copper alloy may be used as the material of the via wiring V1.

The wiring 61, the connection portion 61A, and the metal layer 61D are stacked on a lower surface of the insulating layer 51. The wiring 61, the connection portion 61A, and the metal layer 61D are positioned in the lowermost layer of the stacked structure 23. The width of the wiring 61 may be, for example, about 50 μm to 130 μm. The wiring 61 is a part of a helical coil that is formed in the coil substrate 20. The wiring 61 serves as a first-layer wiring of the coil (about one turn). In the following description, a direction along a spiral of the coil will be referred to as a longitudinal direction of each wiring, and a direction perpendicular to the longitudinal direction in the planar view will be referred to as a width direction of each wiring.

As illustrated in FIG. 5, the planar shape of the wiring 61 is a substantially oval shape. A groove 61X extends through the wiring 61 in the thickness direction at a given position of the wiring 61. In other words, the groove 61X cuts the wiring 61 in the width direction so that the wiring 61 has a non-annular shape. A cross-sectional shape of the wiring 61 in the width direction may be, for example, a substantially rectangular shape.

The connection portion 61A is formed at one end portion of the wiring 61. The connection portion 61A is formed at a position corresponding to the projecting portion 21 (see FIG. 2) of the coil substrate 20. The connection portion 61A is formed integrally with the wiring 61. In other words, the connection portion 61A is a part of the wiring 61. The connection portion 61A is electrically connected to a metal layer 81 formed in the connection 12. The metal layer 81 is used as, for example, a power supply line for plating. The connection portion 61A is exposed from the insulation film 25 in a side surface 20A (see FIG. 8A) of the coil substrate 20 after fragmentized into individual pieces. The connection portion 61A is connected to an electrode 92 of the inductor 90 (see FIG. 8B).

The metal layer 61D is separated from the wiring 61. In other words, a groove 61Y is formed between the metal layer 61D and the wiring 61. Thus, the metal layer 61D is electrically insulated from the wiring 61 by the groove 61Y. The metal layer 61D is, for example, a dummy pattern that is arranged to minimize the difference between the shape of a conductive layer (wiring 61, the connection portion 61A, and the metal layer 61D) in the structural body 41 and the shape of a conductive layer (the wiring 67, the connection portion 67A, and the metal layer 67D) in another structural body. The metal layer 61D is formed at a position corresponding to the projecting portion 22 (see FIG. 2) of the coil substrate 20. In this example, the metal layer 61D is arranged at a position overlapping the connection portion 67A formed in the structural body 47 at the uppermost layer of the coil substrate 20 in the planar view. The metal layer 61D is an electrically isolated (floating) part that is not electrically connected to the other wiring or metal layer in the coil substrate 20 after fragmentized into individual pieces.

Next, the structure stacked on the upper surface 30B of the substrate 30 will now be described.

As illustrated in FIG. 4, the adhesive layer 71 is stacked on the upper surface 30B of the substrate 30. A through hole 71X extends through the adhesive layer 71 in the thickness direction and communicates with the through hole 30X of the substrate 30.

The structural body 42 is stacked on the upper surface 30B of the substrate 30 via the adhesive layer 71. The wiring 62 and the metal layer 62D are stacked on the adhesive layer 71. As illustrated in FIG. 5, the wiring 62 is formed in a substantially C-shape in the planar view. The wiring 62 is a part of the helical coil and serves as a second-layer wiring of the coil (about a ¾ turn).

The metal layer 62D is a dummy pattern similarly to the metal layer 61D. For example, the metal layer 62D includes three metal layer parts. Two of the three metal layer parts are separated from the wiring 62 by grooves 62Y and formed at positions overlapping the connection portions 61A and 67A in the planar view. The other metal layer part of the metal layer 62D is separated from the wiring 62 by a groove 62Z and formed at a position overlapping a part of the wiring 61 in the planar view.

As illustrated in FIG. 4, the insulating layer 52 is stacked on the adhesive layer 71 to cover side surfaces and upper surfaces of the wiring 62 and the metal layer 62D.

A through hole 42X is formed in the structural body 42. The through hole 42X extends through the insulating layer 52 and the wiring 62 in the thickness direction and communicates with the through hole 71X of the adhesive layer 71. The through holes 42X and 71X are filled with a via wiring V2. The via wiring V2 is electrically connected to the via wiring V1 filled in the through hole 30X of the substrate 30 and the through hole 51X of the insulating layer 51. Further, the second-layer wiring 62 is connected in series to the first-layer wiring 61 through the via wirings V1 and V2. In other words, the wirings 61 and 62 of the two structural bodies 41 and 42 neighboring in the thickness direction are connected in series to each other. The via wirings V1 and V2 serve as a through electrode that extends through the insulating layer 51, the substrate 30, the adhesive layer 71, the wiring 62, and the insulating layer 52. In addition, a through hole 42Y is formed in the structural body 42. The through hole 42Y extends through the insulating layer 52 in the thickness direction and exposes a part of the upper surface of the wiring 62. The through hole 42Y is filled with a via wiring V3 that is electrically connected to the wiring 62. For example, copper or a copper alloy may be used as the material of the via wirings V2 and V3.

The adhesive layer 72 is stacked on the insulating layer 52. A through hole 72X extends through the adhesive layer 72 in the thickness direction and communicates with the through hole 42Y of the structural body 42.

The structural body 43 is stacked on the structural body 42 via the adhesive layer 72. Thus, the wiring 63 and the metal layer 63D are stacked on the adhesive layer 72. The insulating layer 53 is stacked on the adhesive layer 72 to cover side surfaces and upper surfaces of the wiring 63 and the metal layer 63D.

As illustrated in FIG. 5, the wiring 63 is formed in a substantially oval shape in the planar view. A groove 63X extends through the wiring 63 in the thickness direction at a given position of the wiring 63. In other words, the groove 63X cuts the wiring 63 in the width direction so that the wiring 63 has a non-annular shape. The wiring 63 is a part of the helical coil and serves as a third-layer wiring of the coil (about one turn).

The metal layer 63D is a dummy pattern similarly to the metal layer 61D. For example, the metal layer 63D includes two metal layer parts. The two metal layer parts are separated from the wiring 63 by grooves 63Y and are formed at positions overlapping the connection portions 61A and 67A in the planar view.

As illustrated in FIG. 4, a through hole 43X is formed in the structural body 43. The through hole 43X extends through the insulating layer 53 and the wiring 63 in the thickness direction and communicates with the through hole 72X of the adhesive layer 72. The through holes 43X and 72X are filled with a via wiring V4. The via wiring V4 is electrically connected to the via wiring V3 filled in the through hole 42Y of the structural body 43. Further, the third-layer wiring 63 is connected in series to the second-layer wiring 62 though the via wirings V3 and V4. In other words, the wirings 62 and 63 of the two structural bodies 42 and 43 neighboring in the thickness direction are connected in series to each other. The via wirings V3 and V4 serve as a through electrode that extends through the insulating layer 52 of the structural body 42, the adhesive layer 72, and the wiring 63 and the insulating layer 53 of the structural body 43. In addition, a through hole 43Y is formed in the structural body 43. The through hole 43Y extends through the insulating layer 53 in the thickness direction and exposes a part of the upper surface of the wiring 63. The through hole 43Y is filled with a via wiring V5 (see FIG. 7) that is electrically connected to the wiring 63. For example, copper or a copper alloy may be used as the material of the via wirings V4 and V5.

The adhesive layer 73 is stacked on the insulating layer 53. A through hole 73X extends through the adhesive layer 73 in the thickness direction and communicates with the through hole 43Y of the structural body 43.

As illustrated in FIG. 4, the structural body 44 is stacked on the structural body 43 via the adhesive layer 73. Thus, the wiring 64 and the metal layer 64D are stacked on the adhesive layer 73. The insulating layer 54 is stacked on the adhesive layer 73 to cover side surfaces and upper surfaces of the wiring 64 and the metal layer 64D. The structural body 44 has the same structure as the structural body 42. For example, as illustrated in FIG. 5, the structural body 44 corresponds to the structure obtained by rotating the structural body 42 by 180 degrees about a normal line of an upper surface of the insulating layer 52.

The wiring 64 is formed in a substantially C-shape in the planar view. The wiring 64 is a part of the helical coil and serves as a fourth-layer wiring of the coil (about ¾ turn). The metal layer 64D is a dummy pattern similarly to the metal layer 61D. For example, the metal layer 64D includes three metal layer parts. Two of the three metal layer parts are separated from the wiring 64 by grooves 64Y and formed at positions overlapping the connection portions 61A and 67A in the planar view. The other metal layer part of the metal layer 64D is separated from the wiring 64 by a groove 64Z and formed at a position overlapping a part of the wiring 63 in the planar view.

A through hole 44X is formed in the structural body 44. The through hole 44X extends through the insulating layer 54 and the wiring 64 in the thickness direction and communicates with the through hole 73X of the adhesive layer 73. The through holes 44X and 73X are filled with a via wiring V6 (see FIG. 7). The via wiring V6 is electrically connected to the via wiring V5 (see FIG. 7) filled in the through hole 43Y of the structural body 43. Further, the fourth-layer wiring 64 is connected in series to the third-layer wiring 63 through the via wirings V5 and V6. In other words, the wirings 63 and 64 of the two structural bodies 43 and 44 neighboring in the thickness direction are connected in series to each other. The via wirings V5 and V6 serve as a through electrode that extends through the insulating layer 53 of the structural body 43, the adhesive layer 73, and the wiring 64 and the insulating layer 54 of the structural body 44. In addition, a through hole 44Y is formed in the structural body 44. The through hole 44Y extends through the insulating layer 54 in the thickness direction and exposes a part of the upper surface of the wiring 64. The through hole 44Y is filled with a via wiring V7 (see FIG. 7) that is electrically connected to the wiring 64. For example, copper or a copper alloy may be used as the material of the via wirings V6 and V7.

Figure 6:
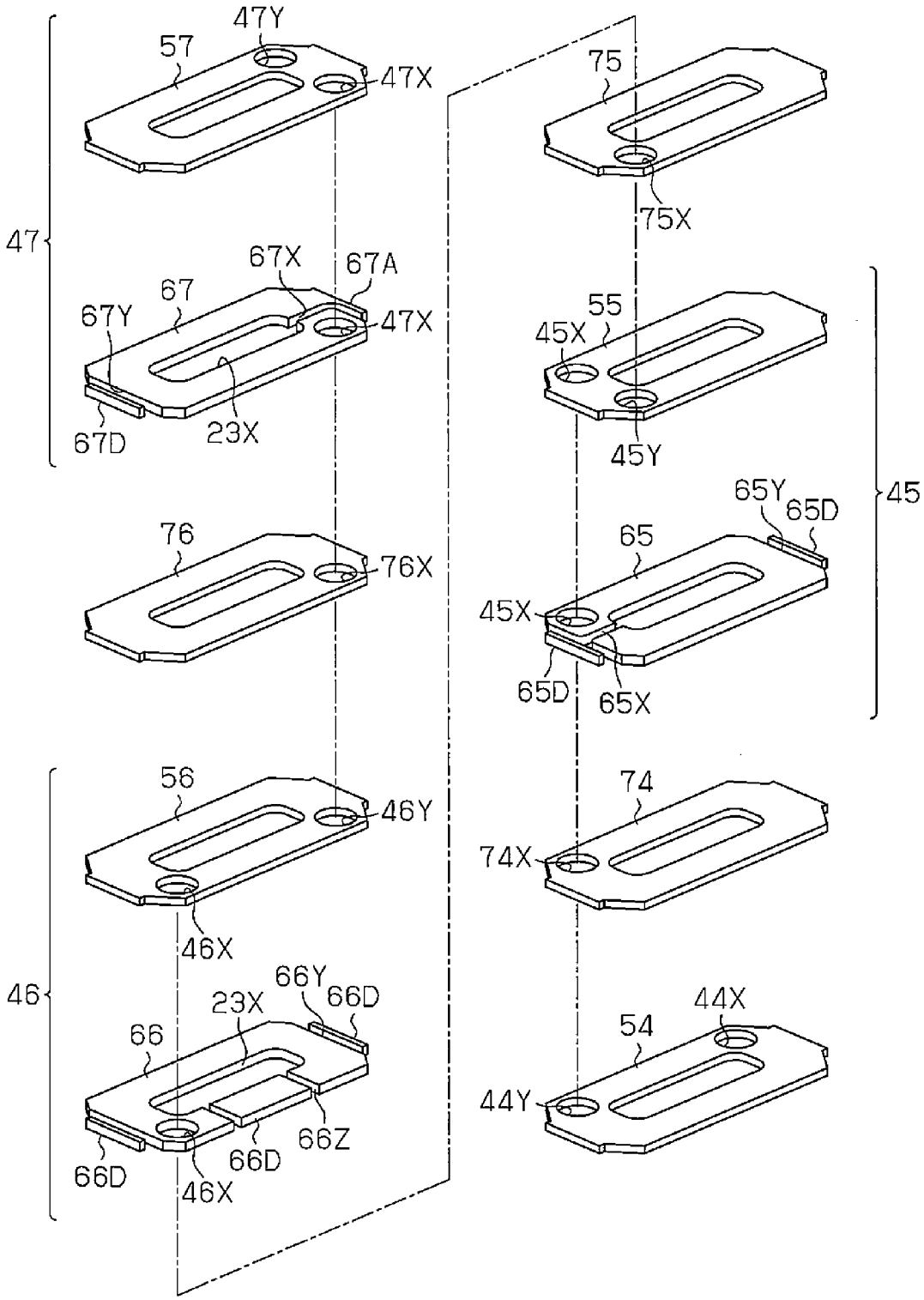

As illustrated in FIG. 6, the adhesive layer 74 is stacked on the insulating layer 54. A through hole 74X extends through the adhesive layer 74 in the thickness direction and communicates with the through hole 44Y of the structural body 44.

As illustrated in FIG. 4, the structural body 45 is stacked on the structural body 44 via the adhesive layer 74. Thus, the wiring 65 and the metal layer 65D are stacked on the adhesive layer 74. The insulating layer 55 is stacked on the adhesive layer 74 to cover side surfaces and upper surfaces of the wiring 65 and the metal layer 65D. As illustrated in FIGS. 5 and 6, the structural body 45 has the same structure as the structural body 43 and corresponds to the structure obtained by rotating the structural body 43 by 180 degrees about a normal line of an upper surface of the insulating layer 53.

As illustrated in FIG. 6, the wiring 65 is formed in a substantially oval shape in the planar view. A groove 65X extends through the wiring 65 in the thickness direction at a given position of the wiring 65. In other words, the groove 65X cuts the wiring 65 in the width direction so that the wiring 65 has a non-annular shape. The wiring 65 is a part of the helical coil and serves as a fifth-layer wiring of the coil (about one turn). The metal layer 65D is a dummy pattern similarly to the metal layer 61D. For example, the metal layer 65D includes two metal layer parts. The two metal layer parts are separated from the wiring 65 by grooves 65Y and formed at positions overlapping the connection portions 61A and 67A in the planar view.

A through hole 45X is formed in the structural body 45. The through hole 45X extends through the insulating layer 55 and the wiring 65 in the thickness direction and communicates with the through hole 74X of the adhesive layer 74. The through holes 45X and 74X are filled with a via wiring V8 (see FIG. 7). The via wiring V8 is electrically connected to the via wiring V7 (see FIG. 7) filled in the through hole 44Y of the structural body 44. Further, the fifth-layer wiring 65 is connected in series to the fourth-layer wiring 64 through the via wirings V7 and V8. In other words, the wirings 64 and 65 of the two structural bodies 44 and 45 neighboring in the thickness direction are connected in series to each other. The via wirings V7 and V8 serve as a through electrode that extends through the insulating layer 54 of the structural body 44, the adhesive layer 74, and the wiring 65 and the insulating layer 55 of the structural body 45. In addition, as illustrated in FIG. 4, a through hole 45Y is formed in the structural body 45. The through hole 45Y extends through the insulating layer 55 in the thickness direction and exposes a part of the upper surface of the wiring 65. The through hole 45Y is filled with a via wiring V9 that is electrically connected to the wiring 65. For example, copper or a copper alloy may be used as the material of the via wirings V8 and V9.

The adhesive layer 75 is stacked on the insulating layer 55. A through hole 75X extends through the adhesive layer 75 in the thickness direction and communicates with the through hole 45Y of the structural body 45.

The structural body 46 is stacked on the structural body 45 via the adhesive layer 75. Thus, the wiring 66 and the metal layer 66D are stacked on the adhesive layer 75. The insulating layer 56 is stacked on the adhesive layer 75 to cover side surfaces and upper surfaces of the wiring 66 and the metal layer 66D. The structural body 46 has the same structure as that of the structural body 42.

As illustrated in FIG. 6, the wiring 66 is formed in a substantially C-shape in the planar view. The wiring 66 is a part of the helical coil and serves as a sixth-layer wiring of the coil (about ¾ turn). The metal layer 66D is a dummy pattern similarly to the metal layer 61D. For example, the metal layer 66D includes three metal layer parts. Two of the three metal layer parts are separated from the wiring 66 by a groove 66Y and formed at positions overlapping the connection portions 61A and 67A in the planar view. The other metal layer part of the metal layer 66D is separated from the wiring 66 by a groove 66Z and formed at a position overlapping a part of the wiring 65 in the planar view.

A through hole 46X is formed in the structural body 46. The through hole 46X extends through the insulating layer 56 and the wiring 66 in the thickness direction and communicates with the through hole 75X of the adhesive layer 75. The through holes 46X and 75X are filled with a via wiring V10. The via wiring V10 is electrically connected to the via wiring V9 filled in the through hole 45Y of the structural body 45. Further, the sixth-layer wiring 66 is connected in series to the fifth-layer wiring 65 through the via wirings V9 and V10. In other words, the wirings 65 and 66 of the two structural bodies 45 and 46 neighboring in the thickness direction are connected in series to each other. The via wirings V9 and V10 serve as a through electrode that extends through the insulating layer 55 of the structural body 45, the adhesive layer 75, and the wiring 66 and the insulating layer 56 of the structural body 46. In addition, a through hole 46Y is formed in the structural body 46. The through hole 46Y extends through the insulating layer 56 in the thickness direction and exposes a part of the upper surface of the wiring 66. A via wiring V11 that is electrically connected to the wiring 66 is filled in the through hole 46Y. For example, copper or a copper alloy may be used as the material of the via wirings V10 and V11.

The adhesive layer 76 is stacked on the insulating layer 56. A through hole 76X extends through the adhesive layer 76 in the thickness direction and communicates with the through hole 46Y of the structural body 46.

The structural body 47 is stacked on the structural body 46 via the adhesive layer 76. Thus, the wiring 67, the connection portion 67A, and the metal layer 67D are stacked on the adhesive layer 76. The insulating layer 57 is stacked on the adhesive layer 76 to cover side surfaces and upper surfaces of the wiring 67, the connection portion 67A, and the metal layer 67D.

As illustrated in FIG. 6, the planar shape of the wiring 67 is a substantially oval shape. A groove 67X extends through the wiring 67 in the thickness direction at a given position of the wiring 67. In other words, the groove 67X cuts the wiring 67 in the width direction so that the wiring 67 has a non-annular shape. The wiring 67 is a part of the helical coil and serves as a seventh-layer wiring of the coil (about one turn).

The connection portion 67A is formed at one end portion of the wiring 67. The connection portion 67A is formed at a position corresponding to the projecting portion 22 (see FIG. 2) of the coil substrate 20. The connection portion 67A is formed integrally with the wiring 67. In other words, the connection portion 67A is a part of the wiring 67. The connection portion 67A is exposed from the insulation film 25 in a side surface 20B (see FIG. 8A) of the coil substrate 20 after fragmentized into individual pieces. The connection portion 67A is connected to an electrode 93 of the inductor 90 (see FIG. 8B).

The metal layer 67D is a dummy pattern similarly to the metal layer 61D. For example, the metal layer 67D is separated from the wiring 67 by a groove 67Y and formed at a position overlapping the connection portion 61A in the planar view.

As illustrated in FIG. 4, a through hole 47X is formed in the structural body 47. The through hole 47X extends through the insulating layer 57 and the wiring 67 in the thickness direction and communicates with the through hole 76X of the adhesive layer 76. The through holes 47X and 76X are filled with a via wiring V12. The via wiring V12 is electrically connected to the via wiring V11 filled in the through hole 46Y of the structural body 46. Further, the seventh-layer wiring 67 is connected in series to the sixth-layer wiring 66 through the via wirings V11 and V12. In other words, the wirings 66 and 67 of the two structural bodies 46 and 47 neighboring in the thickness direction are connected in series to each other. The via wirings V11 and V12 serve as a through electrode that extends through the insulating layer 56 of the structural body 46, the adhesive layer 76, and the wiring 67 and the insulating layer 57 of the structural body 47. In addition, as illustrated in FIG. 6, a through hole 47Y is formed in the structural body 47. The through hole 47Y extends through the insulating layer 57 in the thickness direction and exposes a part of the upper surface of the wiring 67. A via wiring V13 (see FIG. 7) that is electrically connected to the wiring 67 is filled in the through hole 47Y. For example, copper or a copper alloy may be used as the material of the via wirings V12 and V13.

The through holes 42X to 47X, the through holes 42Y to 47Y, and the through holes 71X to 76X may have any planar shape and size. For example, the planar shape of each of the through holes 42X to 47X, 42Y to 47Y, and 71X to 76X may be a circular shape having the diameter of about 150 μm.

Figure 7:
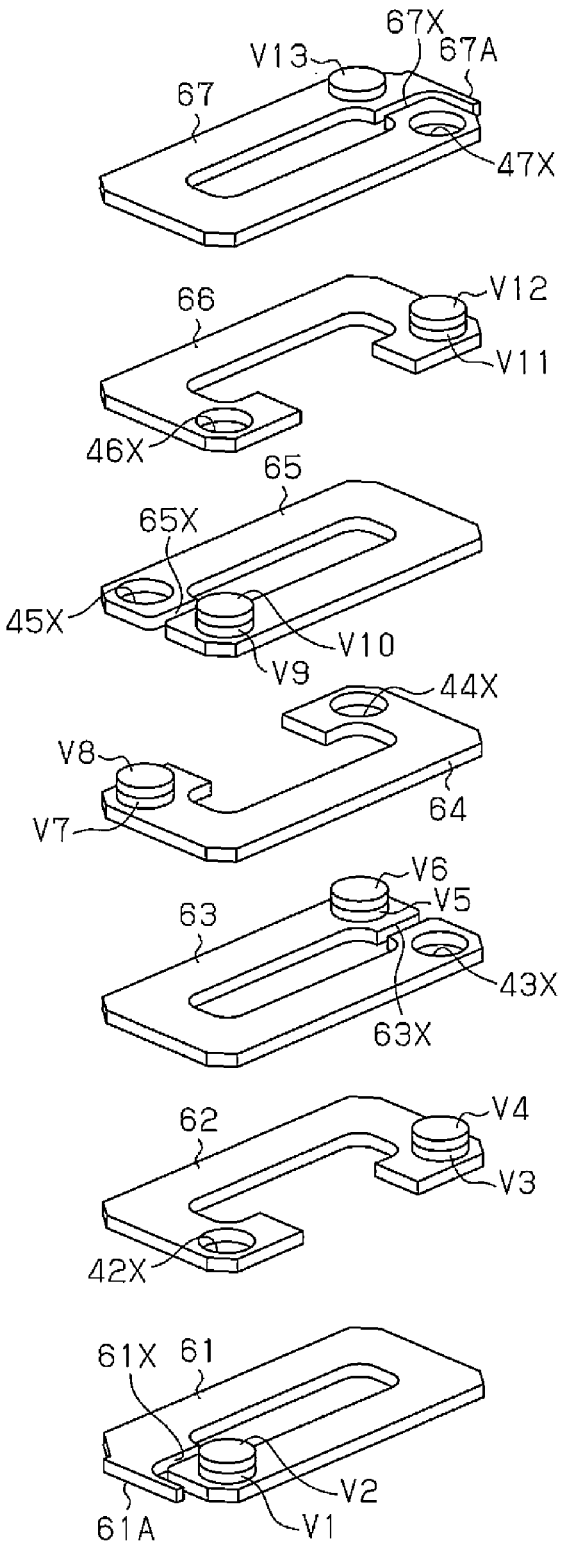
FIG. 7 is a schematic perspective view illustrating a wiring structure of the unit coil substrate.

In this manner, the wirings 61 to 67 of the structural bodies 41 to 47 neighboring in the thickness direction of the stacked structure 23 are connected in series to each other through the via wirings V1 to V12 as illustrated in FIG. 7. Accordingly, the helical coil that extends from the connection portion 61A to the connection portion 67A is formed in the coil substrate 20.

As illustrated in FIG. 2, the through hole 23X extending through the stacked structure 23 in the thickness direction is formed at the substantially center portion of the stacked structure 23 in the planar view. As illustrated in FIGS. 3 and 4, an inner wall surface of the through hole 23X is defined by inner surfaces of the wirings 61 to 67.

As illustrated in FIGS. 2 to 4, the insulation film 25 covers the entire surface of the stacked structure 23. In this example, the insulation film 25 continuously covers an outer wall surface (side wall) of the stacked structure 23, a lower surface and a side surface of the wiring 61 positioned at the lowermost layer, an upper surface of the insulating layer 57 positioned at the uppermost layer, upper surfaces of the via wirings V12 and V13, and the inner wall surface of the through hole 23X. Thus, the insulation film 25 covers the inner surfaces of the wirings 61 to 67 that define the inner wall surface of the through hole 23X. In addition, the insulation film 25 covers the side surfaces of the wiring 61 that define the grooves 61X and 61Y. Further, as illustrated in FIG. 2, for example, the insulation film 25 covers upper and lower surfaces of the stacked structure 23 from a position overlapping the connection portion 67A to a position overlapping the metal layer 67D in the planar view. Further, the insulation film 25 also covers a part of the connection 12. However, most parts of the connection 12 and the entire surface of the outer frame 13 are exposed from the insulation film 25. In FIG. 2, the insulation film 25 at the upper surface of the stacked structure 23 and the insulating layer 57 are not illustrated.

For example, an insulating resin such as an epoxy resin or an acrylic resin may be used as the material of the insulation film 25. The insulation film 25 may include, for example, a filler such as silica and alumina. The thickness of the insulation film 25 may be, for example, about 10 μm to 50 μm.

The coil substrate 20 is connected to the neighboring coil substrate 20 by the connection 12. The structure of the connection 12 will now be briefly described.

As illustrated in FIG. 3, the insulating layer 51 and the metal layer 81 are sequentially stacked on the lower surface 30A of the substrate 30. The adhesive layer 71, the metal layer 82, the insulating layer 52, the adhesive layer 72, the metal layer 83, the insulating layer 53, the adhesive layer 73, the metal layer 84, the insulating layer 54, the adhesive layer 74, the metal layer 85, the insulating layer 55, the adhesive layer 75, the metal layer 86, the insulating layer 56, the adhesive layer 76, the metal layer 87, and the insulating layer 57 are stacked in order on the upper surface 30B of the substrate 30. As illustrated in FIG. 4, the metal layer 81 is electrically connected to the metal layer 61D and the connection portion 61A. The metal layer 82 is electrically connected to the metal layer 62D. The metal layer 83 is electrically connected to the metal layer 63D. The metal layer 84 is electrically connected to the metal layer 64D. The metal layer 85 is electrically connected to the metal layer 65D. The metal layer 86 is electrically connected to the metal layer 66D. The metal layer 87 is electrically connected to the metal layer 67D and the connection portion 67A. For example, copper or a copper alloy may be used as the material of the metal layers 81 to 87.

As illustrated in FIG. 2, a recognition mark 12X is formed at a given position of the connection 12. The recognition mark 12X extends through the connection 12 in the thickness direction. The recognition mark 12X is used as, for example, an alignment mark. The recognition mark 12X may have any planar shape and size. For example, the planar shape of the recognition mark 12X may be a substantially circular shape.

Next, the structure of the outer frame 13 will now be briefly described.

As illustrated in FIG. 3, the outer frame 13 is formed by the substrate 30 only. The outer frame 13 is formed at, for example, the both end areas of the substrate 30. For example, the outer frame 13 is formed by extending the substrate 30 to the outside of the connection 12. Further, the sprocket hole 13X described above is formed in the outer frame 13 (substrate 30). The sprocket holes 13X extends through the substrate 30 in the thickness direction.

Figure 8A:
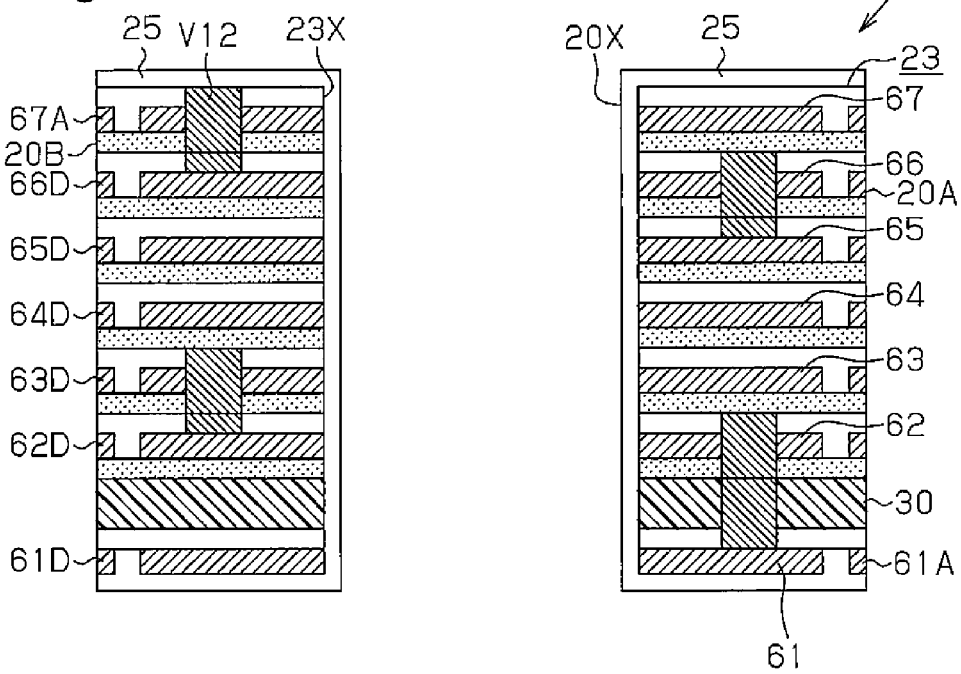
FIG. 8A is a schematic cross-sectional view illustrating the unit coil substrate after being fragmentized.
Figure 8B:
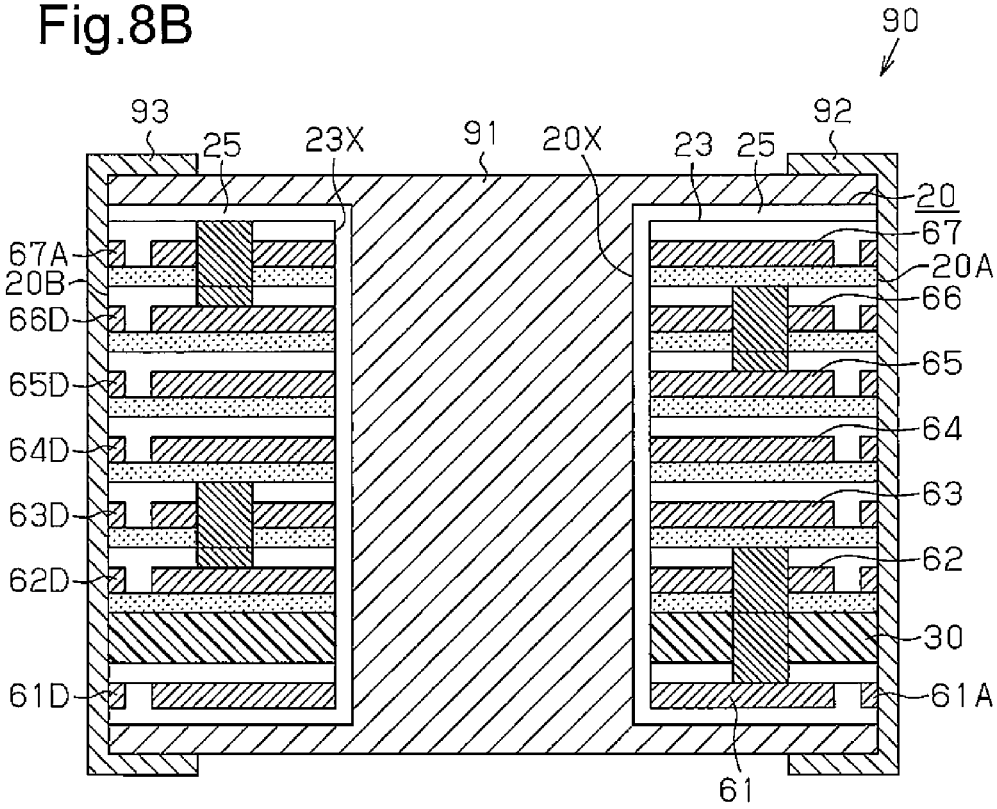
FIG. 8B is a schematic cross-sectional view illustrating an inductor using the unit coil substrate.

FIG. 8A illustrates one of the coil substrates 20 that are fragmentized by cutting the insulation film 25, the substrate 30, the insulating layers 51 to 57, the metal layers 61D to 67D, and the like at a cutting position indicated by the broken line in FIG. 4. The connection portion 61A is exposed at one side surface 20A of the coil substrate 20. The connection portion 67A is exposed at the other side surface 20B of the coil substrate 20. The coil substrate 20 after fragmentized into individual pieces may be used even in a vertically inverted state. In addition, the coil substrate 20 after fragmentized into individual pieces may be arranged at any angle.

Next, the structure of the inductor 90 having the coil substrate 20 will now be described.

As illustrated in FIG. 8B, the inductor 90 is a chip inductor that includes the coil substrate 20, an encapsulating resin 91, and the electrodes 92 and 93. The encapsulating resin 91 encapsulates the coil substrate 20. The planar shape of the inductor 90 may be substantially rectangular of, for example, about 1.6 mm×0.8 mm. The thickness of the inductor 90 may be, for example, about 1.0 mm. The inductor 90 may be used in, for example, a voltage conversion circuit of a small electronic device.

The encapsulating resin 91 encapsulates the coil substrate 20 except for its side surfaces 20A and 20B. That is, the encapsulating resin 91 entirely covers the coil substrate 20 (i.e., the stacked structure 23 and the insulation film 25) except for the side surfaces 20A and 20B at which the connection portions 61A and 67A are exposed. For example, the encapsulating resin 91 covers an upper surface, a lower surface, and an inner side surface of the insulation film 25. Thus, the through hole 20X is filled with the encapsulating resin 91. In this example, the encapsulating resin 91 covers the entire inner wall surface of the through hole 20X. An insulating resin (for example, an epoxy resin) including a filler of a magnetic material such as ferrite may be used as the material of the encapsulating resin 91. The magnetic material increases the inductance of the inductor 90.

In this manner, in the inductor 90, the through hole 20X formed at the substantially center portion of the coil substrate 20 is also filled with the insulating resin including the magnetic material. Thus, as compared to when the through hole 20X is not formed, more surrounding parts of the coil substrate 20 are encapsulated by the encapsulating resin 91 including the magnetic material. This increases the inductance of the inductor 90.

A core of the magnetic material such as ferrite may be arranged in the through hole 20X. In this case, the encapsulating resin 91 may be formed so as to encapsulate the coil substrate 20 along with the core. The core may have a cylindrical shape or a rectangular parallelepiped shape.

The electrode 92 is arranged outside the encapsulating resin 91 and is connected to a part of the connection portion 61A. The electrode 92 continuously covers the side surface 20A of the coil substrate 20, a side surface of the encapsulating resin 91 formed to be flush with the side surface 20A, and a part of each of upper and lower surfaces of the encapsulating resin 91. An inner wall surface of the electrode 92 is in contact with a side surface of the connection portion 61A exposed at the side surface 20A of the coil substrate 20. Thus, the electrode 92 is electrically connected to the connection portion 61A.

The electrode 93 is arranged outside the encapsulating resin 91 and is connected to a part of the connection portion 67A. The electrode 93 continuously covers the side surface 20B of the coil substrate 20, a side surface of the encapsulating resin 91 formed to be flush with the side surface 20B, and a part of each of the upper and lower surfaces of the encapsulating resin 91. An inner wall surface of the electrode 93 is in contact with a side surface of the connection portion 67A exposed at the side surface 20B of the coil substrate 20. Thus, the electrode 93 is electrically connected to the connection portion 67A.

For example, copper or a copper alloy may be used as the material of the electrodes 92 and 93. Each of the electrodes 92 and 93 may have the structure in which metal layers are stacked.

The electrodes 92 and 93 are also connected to the metal layers 61D to 67D each formed as the dummy pattern. However, the metal layers 61D to 67D are not electrically connected to the wirings 61 to 67 and the other metal layers. Thus, the wirings 61 to 67 are hardly short-circuited due to the metal layers 61D to 67D and the electrodes 92 and 93.

Next, the method for manufacturing the coil substrate 10 will now be described. The manufacturing method will be described by using reference numerals of elements of the coil substrate 10 in order to facilitate the understanding.

Figure 9:
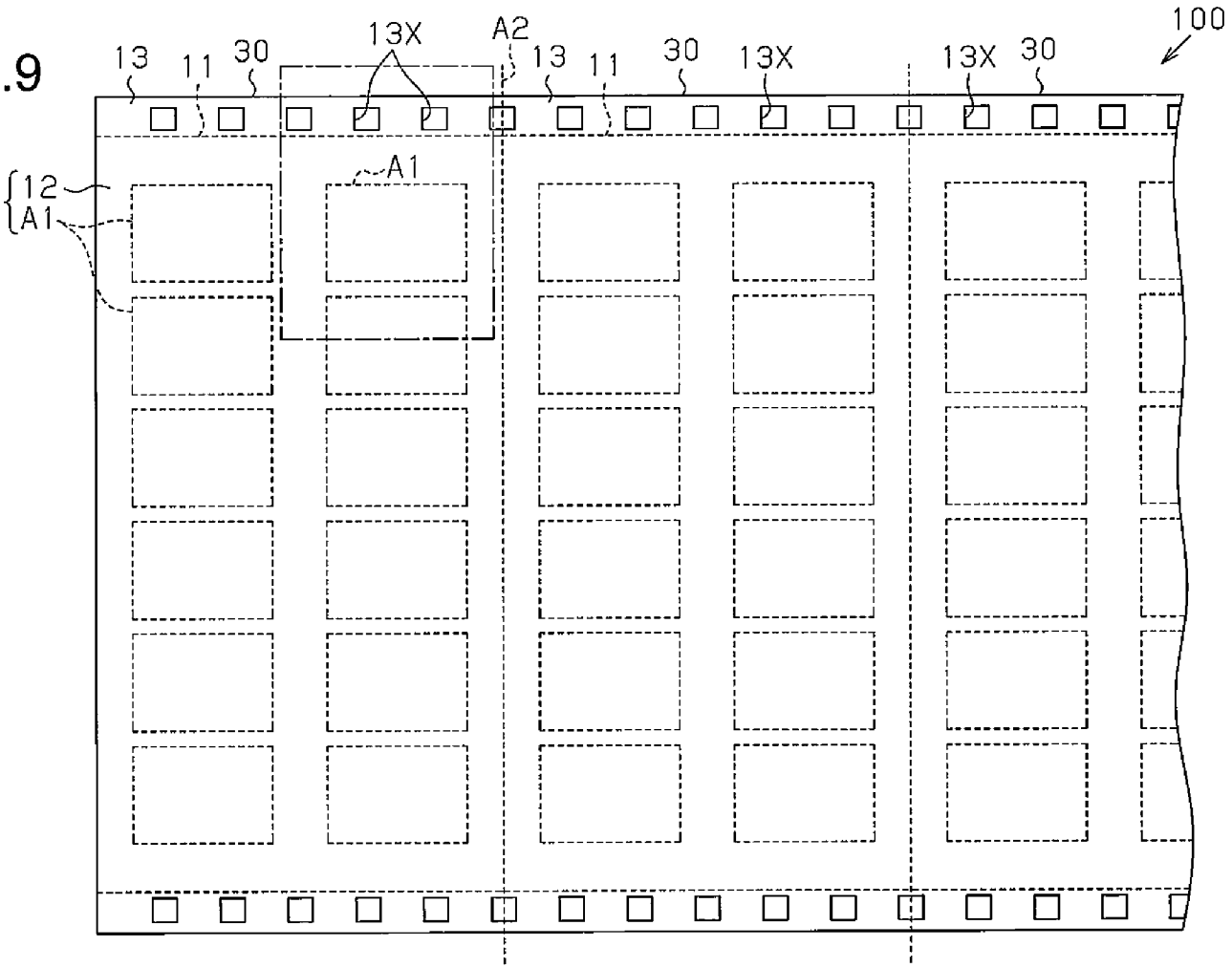
FIG. 9 is a schematic plan view illustrating a manufacturing method of the coil substrate of FIG. 1.

First, in the step illustrated in FIG. 9, a substrate 100 is prepared. The substrate 100 includes a plurality of substrates 30, each of which has the block 11 and the outer frame 13. Each block 11 includes individual areas A1 and the connection 12 surrounding the individual areas A1. The outer frame 13 is arranged at both ends (upper and lower ends in FIG. 9) of the substrate 100. The sprocket holes 13X extending through the substrate 30 in the thickness direction are formed in the outer frame 13. The sprocket holes 13X are arranged at an approximately constant interval in the longitudinal direction (horizontal direction in FIG. 9) of the substrate 100. The sprocket holes 13X may be formed by using, for example, a press processing method or a laser processing method. The sprocket holes 13X are through holes for transferring the substrate 100 and are engaged with pins of the sprocket driven by the motor or the like so as to transfer the substrate 100 by a pitch between the sprocket holes 13X when the substrate 100 is mounted to the manufacturing apparatus.

A reel-like (tape-like) flexible insulating resin film may be used as the substrate 100. The width (length in a direction perpendicular to an arrangement direction of the sprocket holes 13X in the planar view) of the substrate 100 is determined so as to be compatible to the manufacturing apparatus to which the substrate 100 is mounted. For example, the width of the substrate 100 may be about 40 mm to 90 mm. The length of the substrate 100 in the longitudinal direction may be appropriately determined. In the example illustrated in FIG. 9, the individual areas A1 are arranged in six rows and two columns in each substrate 30. Instead, the substrate 30 may be lengthened so as to arrange the individual areas A1 in, for example, about hundreds of columns. The substrate 100 is cut at a cutting position A2.

Hereinafter, the manufacturing method will be described regarding one individual area A1 (indicated by a dashed-line frame in FIG. 9) of one substrate 30.

Figure 10A:
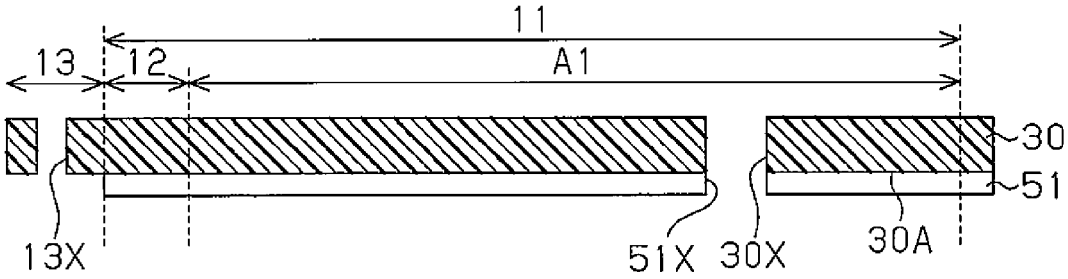
FIG. 10A is a schematic cross-sectional view, taken along line 10*a*-10*a* in FIG. 10B, illustrating the manufacturing method of the coil substrate.
Figure 10B:
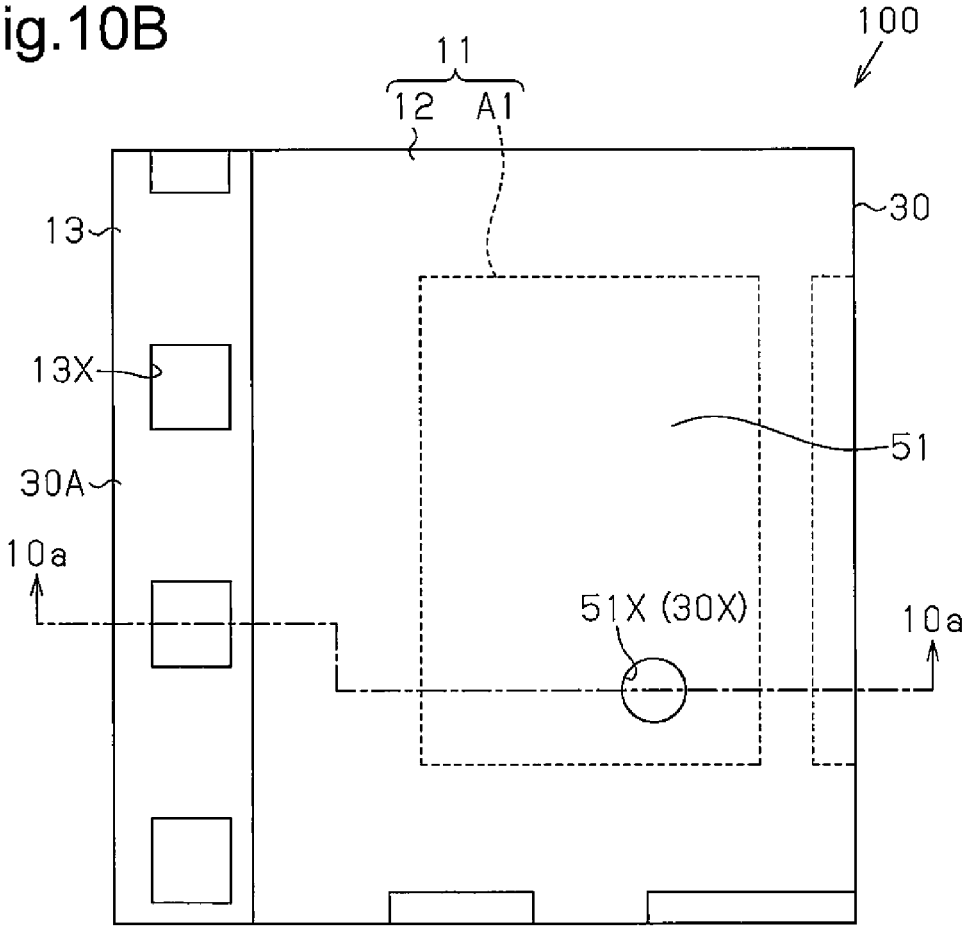
FIG. 10B is a schematic plan view illustrating the manufacturing method of the coil substrate.

In the step illustrated in FIGS. 10A and 10B, the insulating layer 51 in a semi-cured state is stacked on the lower surface 30A of the substrate 30 in the area (that is, the block 11) except for the outer frame 13. For example, the insulating layer 51 covers the entire lower surface 30A of the substrate 30 at a position of the block 11. For example, when an insulating resin film is used as the insulating layer 51, the insulating resin film is laminated to the lower surface 30A of the substrate 30. However, in this step, the insulating resin film is not thermally cured but left to be in a B-stage state (semi-cured state). By laminating the insulating resin film to the lower surface 30A of the substrate 30 in the vacuum atmosphere, generation of a void in the insulating layer 51 may be suppressed. When a liquid insulating resin or an insulating resin paste is used as the insulating layer 51, the liquid insulating resin or the insulating resin paste is applied to the lower surface 30A of the substrate 30 by, for example, a printing method or a spin coating method. Then, the liquid insulating resin or the insulating resin paste is pre-baked to be in the B-stage state.

Subsequently, the through hole 30X is formed in the substrate 30 at a position of the individual area A1. Further, the through hole 51X that communicates with the through hole 30X is formed in the insulating layer 51 at the position of the individual area A1. The through holes 30X and 51X may be formed by using, for example the press processing method or the laser processing method. In this step, the sprocket hole 13X may be formed. In other words, the through holes 30X and 51X and the sprocket hole 13X may be formed during the same process.

Figure 11A:
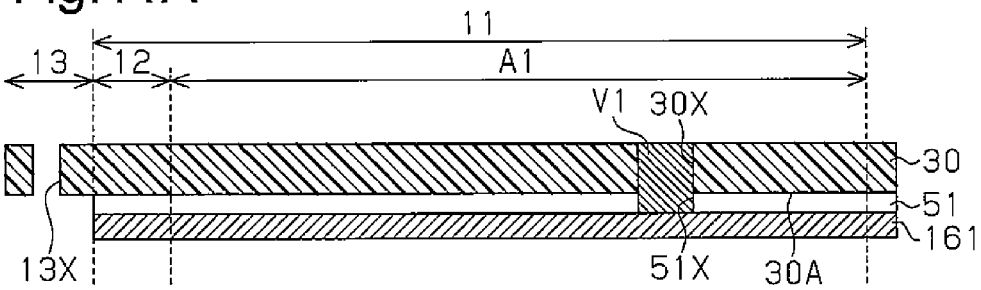
FIG. 11A is a schematic cross-sectional view, taken along line 10*a*-10*a* in FIG. 10B, illustrating the manufacturing method of the coil substrate.

Subsequently, in the step illustrated in FIG. 11A, a metal foil 161 is stacked on a lower surface of the semi-cured insulating layer 51. The metal foil 161 covers, for example, the entire lower surface of the insulating layer 51. For example, the metal foil 161 is laminated to the lower surface of the semi-cured insulating layer 51 and undergoes a thermal press fitting. Then, the semi-cured insulating layer 51 is cured by a thermal treatment in the atmosphere of temperature at about 150° C. By curing the insulating layer 51, the substrate 30 is bonded to an upper surface of the insulating layer 51 and the metal foil 161 is bonded to the lower surface of the insulating layer 51. Thus, the insulating layer 51 serves as an adhesive that bonds the substrate 30 to the metal foil 161. The metal foil 161 is patterned in the subsequent step to form the wiring 61, the connection portion 61A, and the like. A copper foil may be used as the metal foil 161.

Subsequently, the via wiring V1 filling the through holes 30X and 51X is formed on the metal foil 161 exposed in the through hole 51X. For example, the via wiring V1 is formed in the through holes 30X and 51X by performing electrolytic plating using the metal foil 161 as a power supplying layer. Alternatively, the via wiring V1 may be formed by applying metal paste such as copper on the metal foil 161 exposed in the through hole 51X.

Figure 11B:
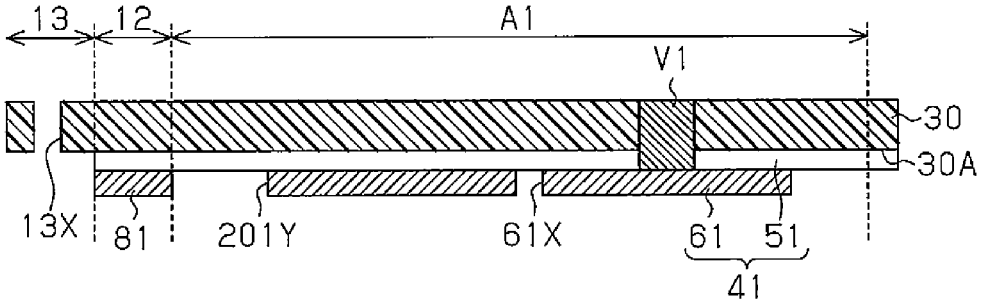
FIG. 11B is a schematic cross-sectional view, taken along line 11*b*-11*b* in FIG. 11C, illustrating the manufacturing method of the coil substrate.
Figure 11C:
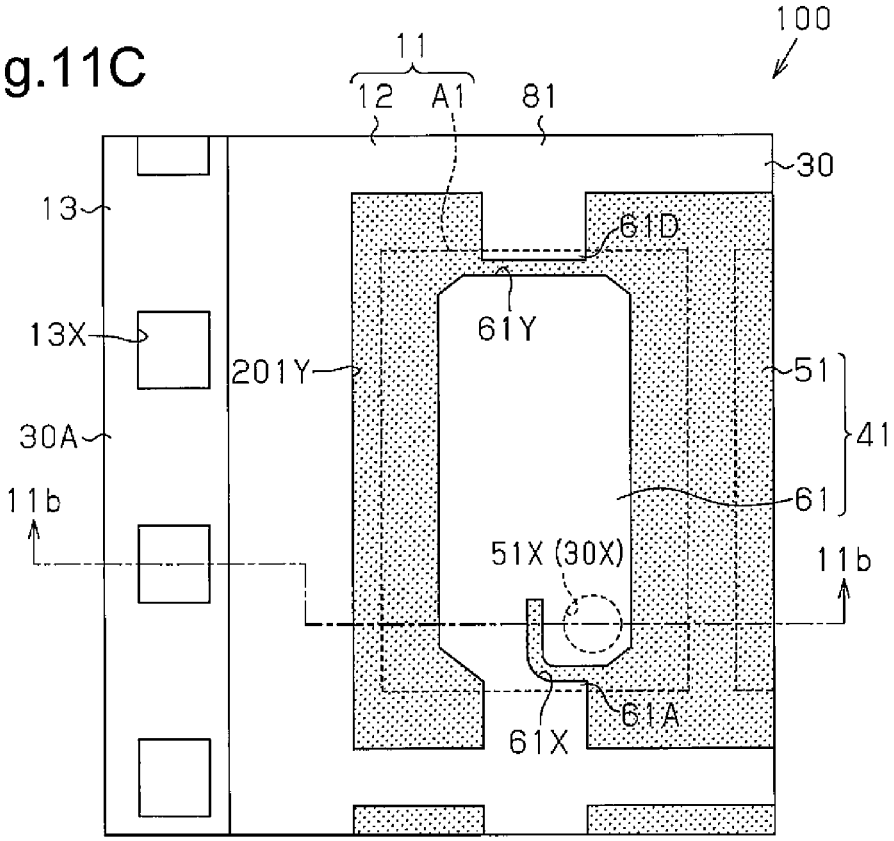
FIG. 11C is a schematic plan view illustrating the manufacturing method of the coil substrate.

Next, as illustrated in FIGS. 11B and 11C, the metal foil 161 is patterned to form the wiring 61 on the lower surface of the insulating layer 51 at a position of the individual area A1. By patterning the metal foil 161, the connection portion 61A is formed at one end portion of the wiring 61 and the metal layer 61D is formed as the dummy pattern. As a result, the structural body 41, which includes the insulating layer 51, the wiring 61, and the connection portion 61A, is stacked on the lower surface 30A of the substrate 30. The wiring 61 (first metal layer) formed in this step has a planar shape greater than, for example, the wiring 61 (a part of the helical coil) illustrated in FIG. 7. The wiring 61 (first metal layer) is molded by die-cutting or the like eventually to form the first-layer wiring (about one turn) of the helical coil. Further, in this step, the metal layer 81 connected to the connection portion 61A and the metal layer 61D is formed in the lower surface of the insulating layer 51 at a position of the connection 12. In other words, the metal foil 161 illustrated in FIG. 11A is patterned so as to form an opening 201Y and the grooves 61X and 61Y as illustrated in FIG. 11C. The groove 61X facilitates formation of the spiral shape of the coil when molding the coil substrate 20 in the subsequent step. The metal layer 81 formed in this step is used as the power supplying layer when performing the electrolytic plating in the subsequent step. When the electrolytic plating is not performed in the subsequent step, the formation of the metal layer 81 may be omitted. In FIG. 11C, the insulating layer 51 exposed from the opening 201Y and the grooves 61X and 61Y is illustrated by the shaded pattern.

The patterning of the metal foil 161 may be performed using a wiring forming method such as a subtractive method. For example, a photosensitive resist is applied to a lower surface of the metal foil 161, and a predetermined area is exposed and developed to form an opening in the resist. Then, the metal foil 161 exposed in the opening is removed by etching. The wiring 61, the connection portion 61A, the metal layer 61D, and the metal layer 81 are integrally formed.

Figure 12A:
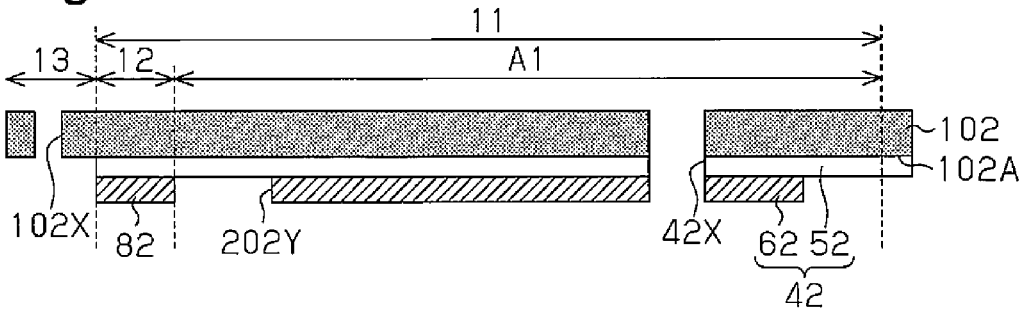
FIG. 12A is a schematic cross-sectional view, taken along line 12*a*-12*a* in FIG. 12C, illustrating the manufacturing method of the coil substrate.

Next, in the step illustrated in FIG. 12A, a support film 102 having the structure similar to the substrate 100 is prepared. That is, the support film 102 includes the block 11, which includes individual areas A1, and the outer frame 13, which projects outward from the block 11. For example, a reel-like (tape-like) flexible insulating resin film may be used as the support film 102. For example, polyphenylene sulfide (PPS), a polyimide film, a polyethylene naphthalate film, or the like may be used as the support film 102. The thickness of the support film 102 may be, for example, about 12 μm to 50 μm.

Figure 12B:
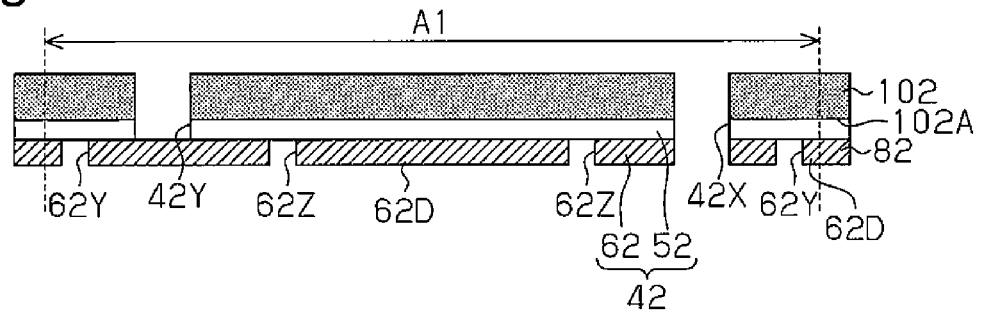
FIG. 12B is a schematic cross-sectional view, taken along line 12*b*-12*b* in FIG. 12C, illustrating the manufacturing method of the coil substrate.
Figure 12C:
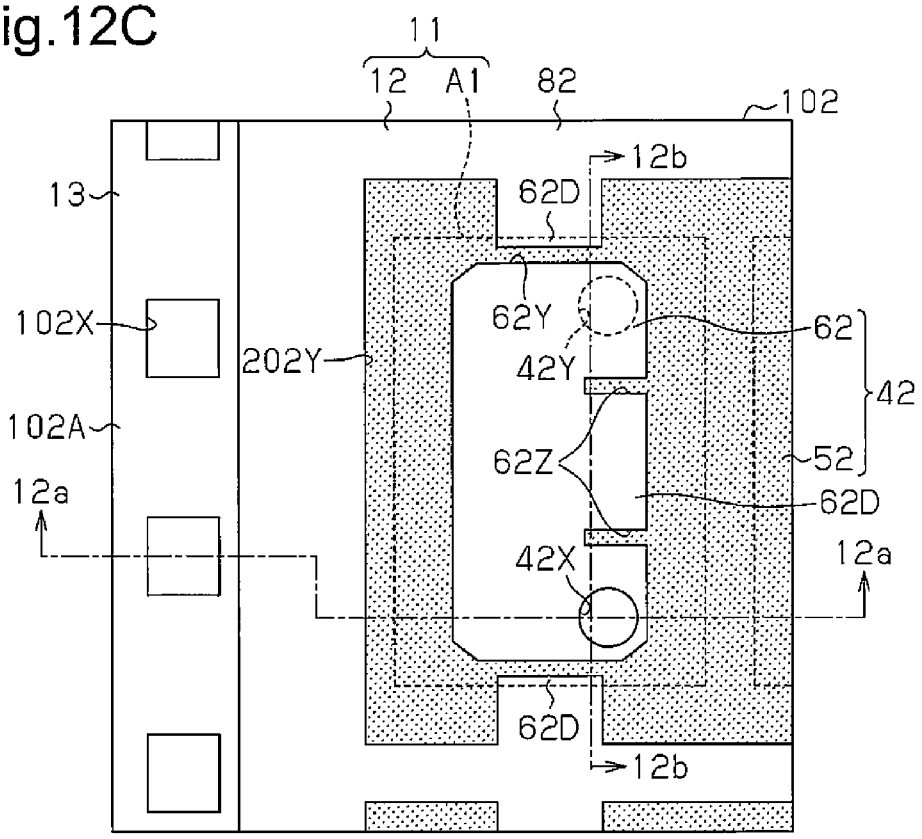
FIG. 12C is a schematic plan view illustrating the manufacturing method of the coil substrate.

Subsequently, in the same manner as the steps illustrated in FIGS. 9 and 10A, the structural body 42 including the insulating layer 52 and the wiring 62 is stacked on a lower surface 102A of the support film 102. For example, sprocket holes 102X are formed in the support film 102 at the position of the outer frame 13, and then, the semi-cured insulating layer 52 is stacked on the lower surface 102A of the support film 102 at the position except for the outer frame 13. Subsequently, as illustrated in FIG. 12B, the through holes 42X and 42Y extending through the support film 102 and the insulating layer 52 in the thickness direction are formed by using the press processing method or the laser processing method. Then, the metal foil is stacked on the lower surface of the semi-cured insulating layer 52, and the metal foil is patterned by the subtractive method. As illustrated in FIG. 12C, by patterning the metal foil, the wiring 62 is formed in the lower surface of the insulating layer 52 at the position of the individual area A1, and the metal layer 62D is formed as the dummy pattern. In addition, the through hole that extends through the wiring 62 in the thickness direction and communicates with the through hole 42X is formed at a given position of the wiring 62. Further, the metal layer 82 connected to the metal layer 62D is formed in the lower surface of the insulating layer 52 at the position of the connection 12. In other words, the metal foil stacked on the lower surface of the insulating layer 52 is patterned in this step so as to form the through hole 42X, an opening 202Y, and the grooves 62Y and 62Z. The wiring 62 (second metal layer) formed in this step has a planar shape greater than, for example, the wiring 62 (a part of the helical coil) illustrated in FIG. 7. The wiring 62 (second metal layer) is molded by the die-cutting or the like eventually to form the second-layer wiring (about ¾ turn) of the helical coil. The wiring 62 is separated from the metal layer 82 by the opening 202Y and the groove 62Y. The groove 62Z facilitates the formation of the spiral shape of the coil when molding the coil substrate 20 in the subsequent step. In FIG. 12C, the insulating layer 52 exposed from the opening 202Y and the grooves 62Y and 62Z is illustrated by the shaded pattern.

Similarly to the sprocket holes 13X, the sprocket holes 102X are used to transfer the support film 102 and engaged with pins of the sprocket driven by the motor or the like so as to transfer the support film 102 by a pitch between the sprocket holes 102X when the support film 102 is mounted to the manufacturing apparatus.

The through hole 42X overlaps the through hole 30X in the planar view when the structural body 42 is stacked on the upper surface 30B of the substrate 30. As illustrated in FIG. 12B, the upper surface of the wiring 62 is exposed in the through hole 42Y.

Figure 13A:
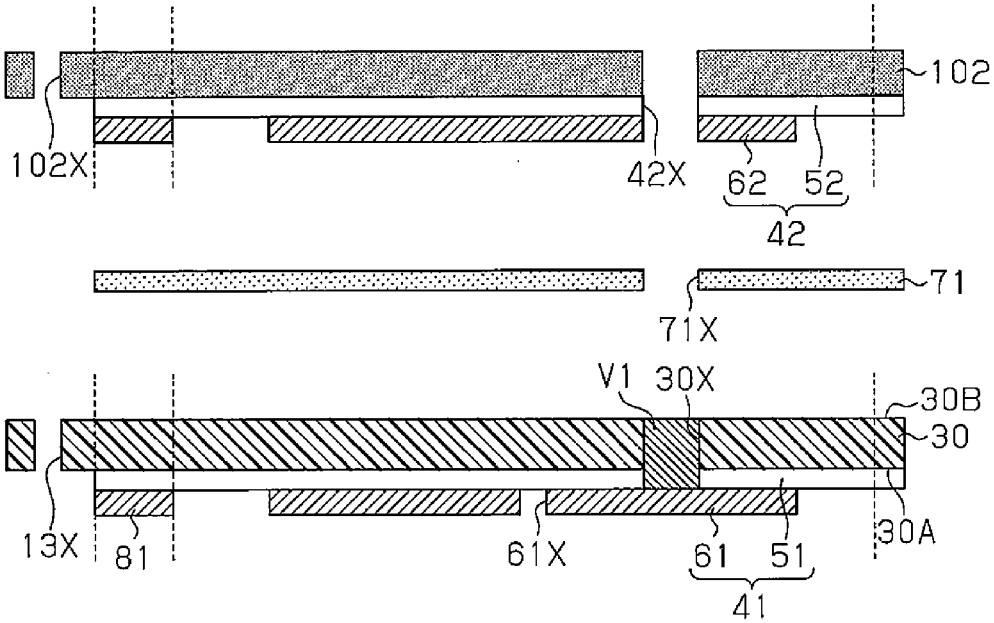
FIGS. 13A to 13C are schematic cross-sectional views illustrating the manufacturing method of the coil substrate.
Figure 13B:
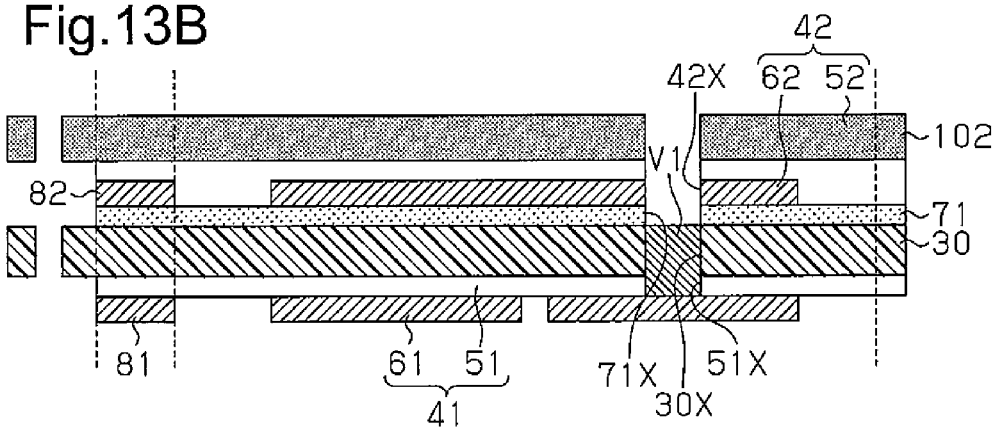
Figure 13C:
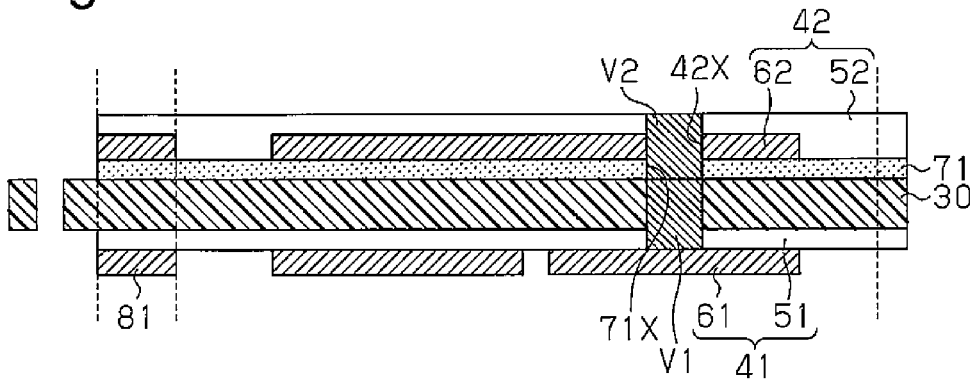

Next, the steps illustrated in FIGS. 13A to 13C will now be described. FIGS. 13A to 13C are cross-sectional views corresponding to the position at line 11*b*-11*b* of FIG. 11C, and the position at line 12*a*-12*a* of FIG. 12C. First, the adhesive layer 71 is prepared in the step illustrated in FIG. 13A, and the through hole 71X extending through the adhesive layer 71 in the thickness direction is formed. The through hole 71X overlaps the through holes 30X and 42X in the planar view when the structural body 42 is stacked on the upper surface 30B of the substrate 30 via the adhesive layer 71.

Subsequently, the adhesive layer 71 and the structure illustrated in FIG. 12A (including the structural body 42 stacked on the lower surface 102A of the support film 102) are arranged in order above the structure illustrated in FIG. 11B (including the structural body 41 stacked on the lower surface 30A of the substrate 30). At this time, the structural body 42 is arranged facing down so that the wiring 62 faces the upper surface 30B of the substrate 30 via the adhesive layer 71.

Subsequently, in the step illustrated in FIG. 13B, the structural body 42 is stacked on the upper surface 30B of the substrate 30 via the adhesive layer 71. Then, the structure illustrated in FIG. 13A (that is, the structural body of FIG. 11B, the adhesive layer 71, and the structural body of FIG. 12A) are subjected to heating and pressing from both sides thereof. This forms the insulating layer 52 covering the side surface of the wiring 62. Then, the adhesive layer 71 is cured. The through hole 42X, the through hole 71X, the through hole 30X, and the through hole 51X are communicated with one another. Thus, an upper surface of the via wiring V1 is exposed through the through holes 42X and 71X.

In the steps illustrated in FIG. 12A to 13B, the through holes 42X, 42Y, and 71X may be formed after the structural body 42 is stacked on the upper surface 30B of the substrate 30 via the adhesive layer 71.

Next, in the step illustrated in FIG. 13C, the support film 102 illustrated in FIG. 13B is removed from the insulating layer 52 of the structural body 42. For example, the support film 102 is mechanically peeled off from the insulating layer 52. Next, the via wiring V2 is formed on the via wiring V1 exposed through the through hole 42X. Thus, the wiring 61 is connected in series to the wiring 62 through the via wirings V1 and V2.

Figure 14A:
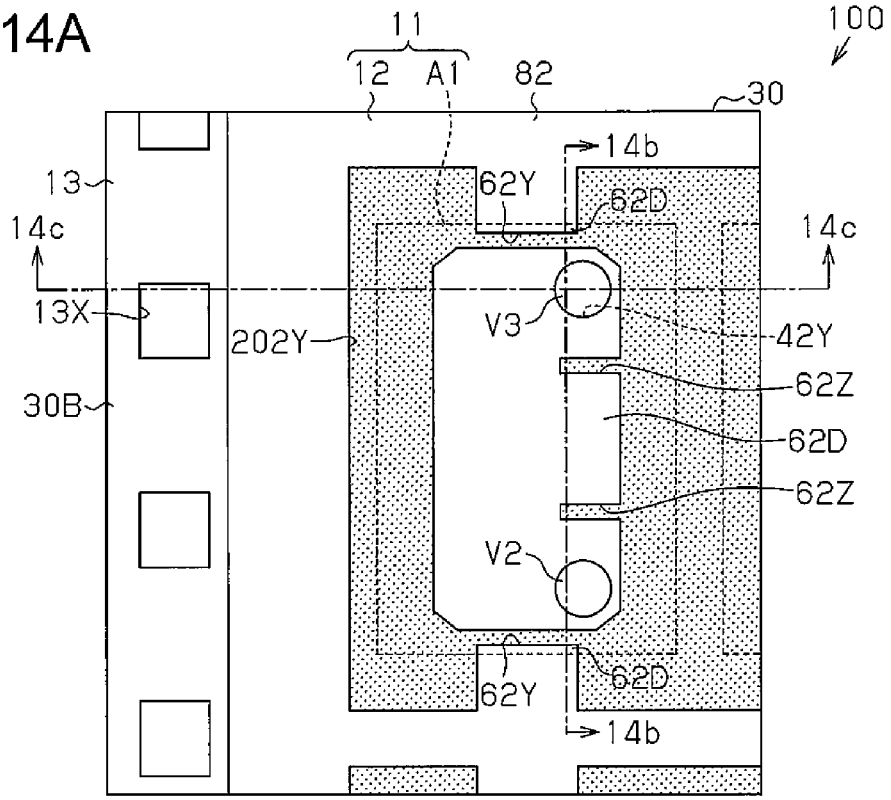
FIG. 14A is a schematic plan view illustrating the manufacturing method of the coil substrate.
Figure 14B:
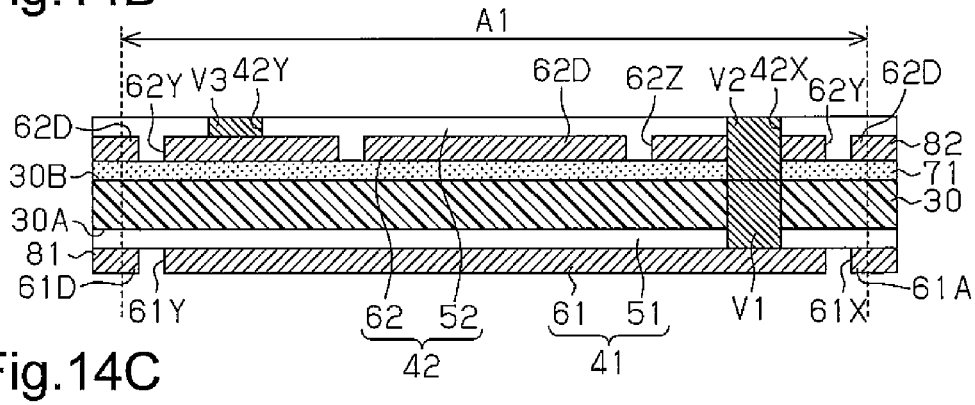
FIG. 14B is a schematic cross-sectional view, taken along line 14*b*-14*b* in FIG. 14A, illustrating the manufacturing method of the coil substrate.
Figure 14C:
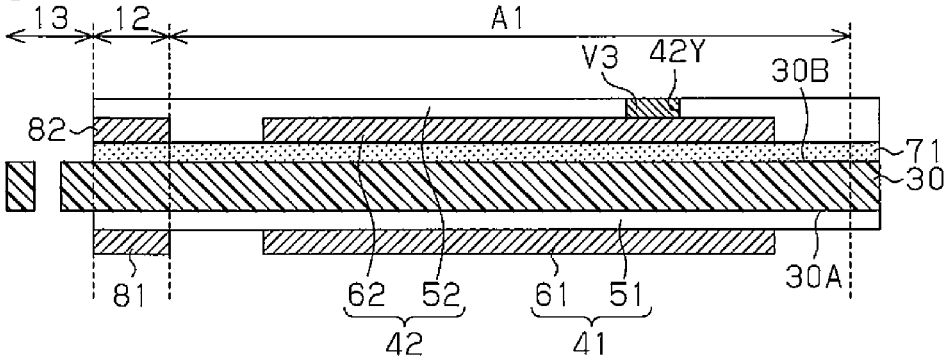
FIG. 14C is a schematic cross-sectional view, taken along line 14*c*-14*c* in FIG. 14A, illustrating the manufacturing method of the coil substrate.

Next, as illustrated in FIGS. 14A to 14C, the via wiring V3 electrically connected to the wiring 62 is formed on the wiring 62 exposed through the through hole 42Y. In this step, the via wirings V2 and V3 are formed such that the upper surfaces thereof are flush with the upper surface of the insulating layer 52. For example, the via wirings V2 and V3 may be formed by performing the electrolytic plating using both of the metal layer 81 and the wiring 61 as the power supplying layer, or by filling metal paste. In FIG. 14A, the insulating layer 52 is not illustrated, and the adhesive layer 71 exposed from the opening 202Y and the grooves 62Y and 62Z is illustrated by the shaded pattern.

By the manufacturing steps described above, the wiring 61 is connected in series to the wiring 62 by the via wirings V1 and V2 in a stacked structure having the structural body 41 on the lower surface 30A of the substrate 30 and the structural body 42 on the upper surface 30B of the substrate 30. The series conductor of the wirings 61 and 62 and the via wirings V1 and V2 corresponds to a part of about (1+¾) turns of the helical coil.

Figure 15A:
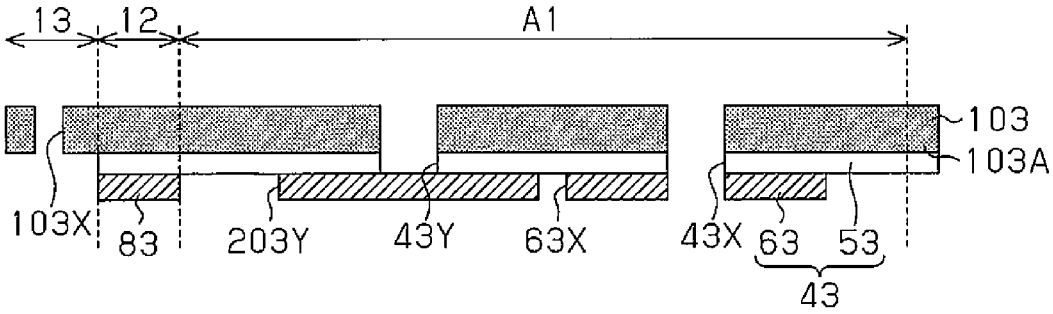
FIG. 15A is a schematic cross-sectional view, taken along line 15*a*-15*a* in FIG. 15B, illustrating the manufacturing method of the coil substrate.

Next, in the step illustrated in FIG. 15A, the structural body 43 having the insulating layer 53 and the wiring 63 is stacked on a lower surface 103A of a support film 103. This step may be performed in the same manner as the step illustrated in FIGS. 12A and 12B. The differences between the step of FIG. 15A and the step of FIG. 12A are the position of the through hole and the wiring shape after the patterning of the metal foil. Thus, the detailed description regarding the manufacturing method in the step of FIG. 15A will be omitted. The shape, thickness, material, and the like of the support film 103 as well as the support films 104 to 107 used in the subsequent step are the same as those of the support film 102 illustrated in FIG. 12A. Sprocket holes 103X to 107X formed in the outer frame 13 of the support films 103 to 107 are also the same as the sprocket holes 102X of the support film 102.

Figure 15B:
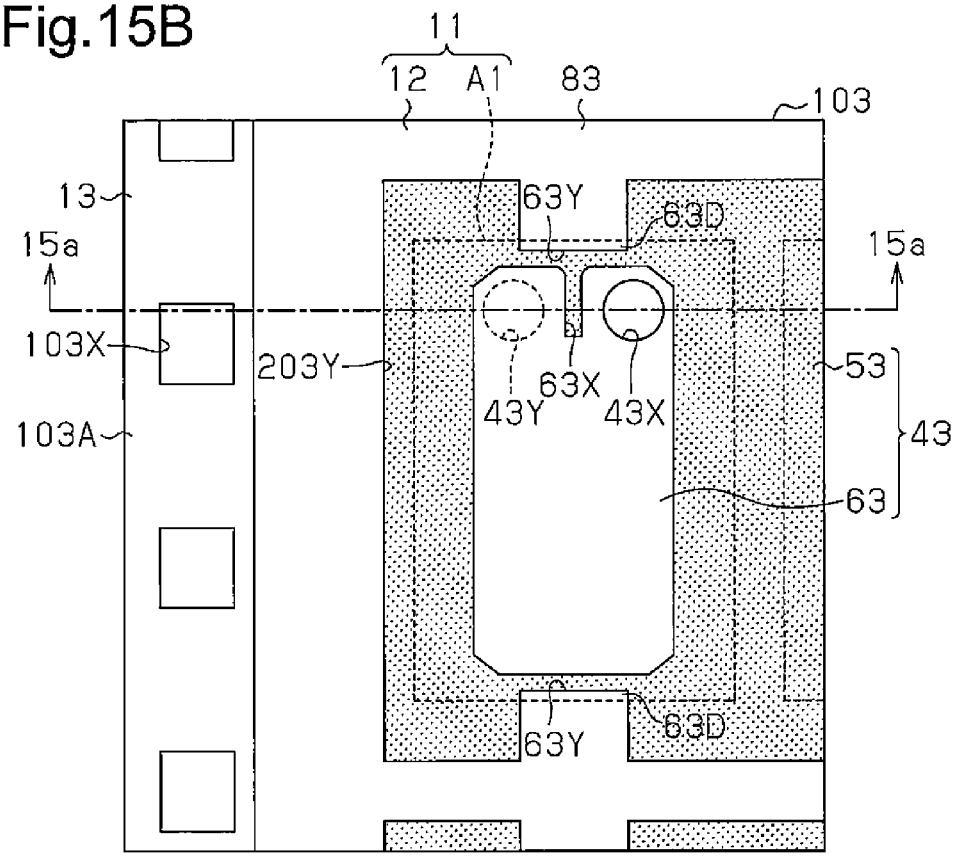
FIG. 15B is a schematic plan view illustrating the manufacturing method of the coil substrate.

The structure illustrated in FIG. 15A includes the through hole 43X that extends through the support film 103, the insulating layer 53, and the wiring 63 in the thickness direction. Further, this structure includes the through hole 43Y that extends through the support film 103 and the insulating layer 53 in the thickness direction to expose the upper surface of the wiring 63. As illustrated in FIG. 15B, the wiring 63, the metal layer 63D, and the metal layer 83 are formed in the lower surface of the insulating layer 53. The wiring 63 is separated from the metal layers 63D and 83 by an opening 203Y and the groove 63Y. The groove 63X is formed in the wiring 63. The groove 63X facilitates the formation of the spiral shape of the coil when molding the coil substrate 20 in the subsequent step. The wiring 63 (second metal layer) formed in this step has a planar shape greater than, for example, the wiring 63 illustrated in FIG. 7 (a part of the helical coil). The wiring 63 is molded by the die-cutting or the like eventually to form the third-layer wiring (about one turn) of the helical coil. In FIG. 15B, the insulating layer 53 exposed from the opening 203Y and the grooves 63X and 63Y is illustrated by the shaded pattern.

Figure 16A:
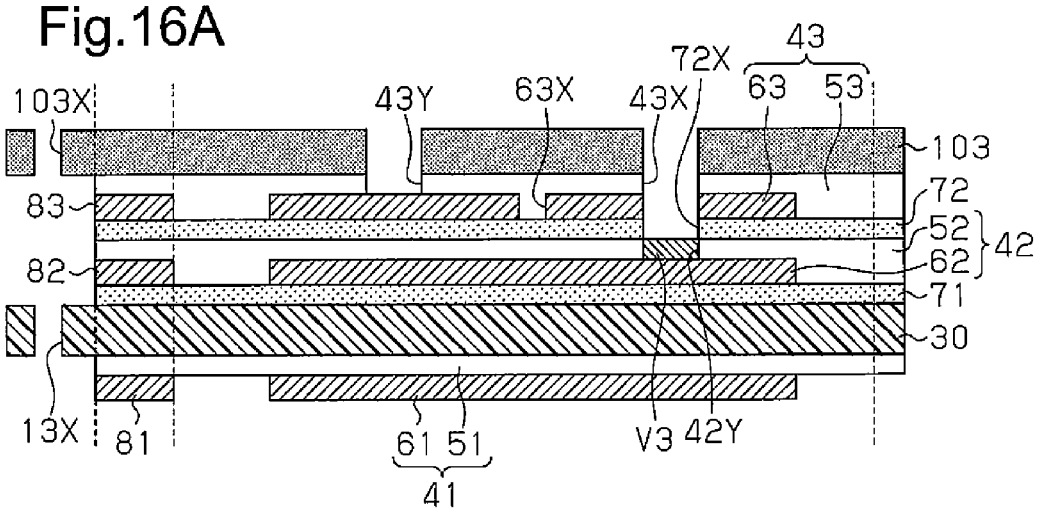
FIGS. 16A to 16C are schematic cross-sectional views illustrating the manufacturing method of the coil substrate.
Figure 16B:
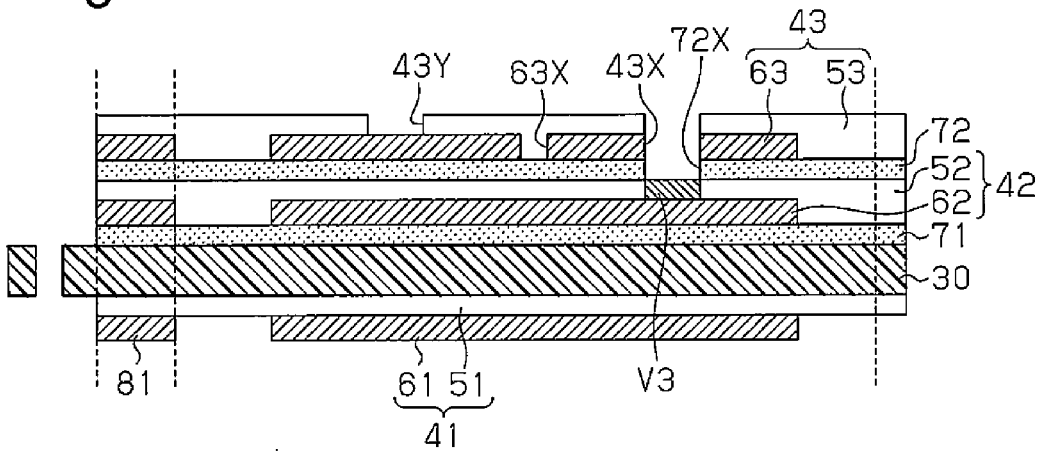
Figure 16C:
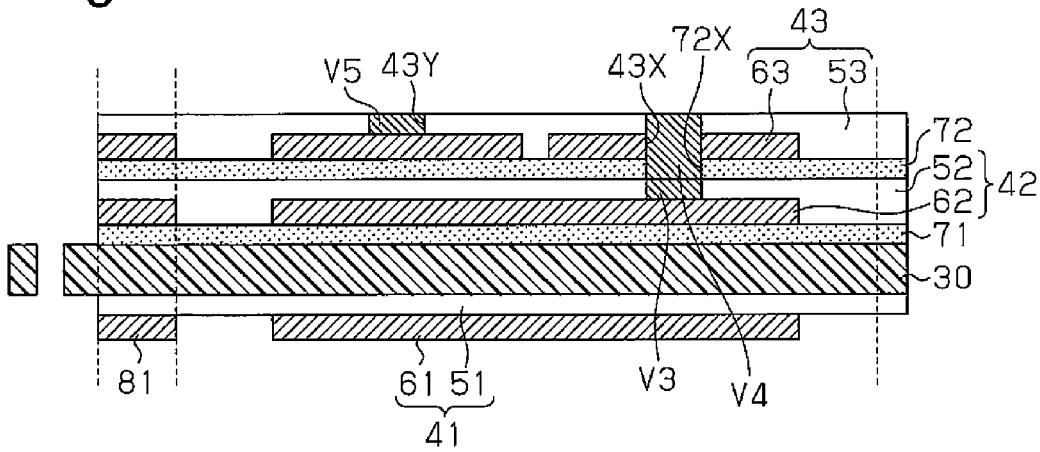

Next, the steps illustrated in FIGS. 16A to 16C will now be described. FIGS. 16A to 16C are cross-sectional views corresponding to the position at line 14*c*-14*c* of FIG. 14A, and the position at line 15*a*-15*a* of FIG. 15B.

First, in the step illustrated in FIG. 16A, the adhesive layer 72 is stacked on the insulating layer 52 of the structural body 42. Next, the through hole 72X extending through the adhesive layer 72 in the thickness direction is formed. Next, in the same manner as the step in FIG. 13B, the structural body 43 is stacked on the insulating layer 52 via the adhesive layer 72, and then the support film 103 is stacked on the structural body 43. The through hole 43X, the through hole 72X, and the through hole 42Y are communicated with one another. Thus, the via wiring V3 filled in the through hole 42Y is exposed through the through holes 43X and 72X.

Next, in the step illustrated in FIG. 16B, the support film 103 is removed from the insulating layer 53 of the structural body 43. For example, the support film 103 is mechanically peeled off from the insulating layer 53.

Next, in the step illustrated in FIG. 16C, the via wiring V4, which fills the through holes 43X and 72X, and the via wiring V5, which fills the through hole 43Y, are formed. Accordingly, the wiring 62 is connected in series to the wiring 63 by the via wirings V3 and V4, and the wiring 63 is electrically connected to the via wiring V5. For example, the via wirings V4 and V5 are formed such that upper surfaces of the via wirings V4 and V5 are flush with the upper surface of the insulating layer 53. For example, the via wirings V4 and V5 may be formed by performing the electrolytic plating using both of the metal layer 81 and the wiring 61 as the power supplying layer, or by filling metal paste.

By the manufacturing steps described above, the wirings 61, 62, and 63 are connected in series to one another by the via wirings V1 to V4 in a stacked structure having the structural body 41, the substrate 30, the structural body 42, and the structural body 43. The series conductor of the wirings 61 to 63 and the via wirings V1 to V4 corresponds to a part of about (2+¾) turns of the helical coil.

In the steps illustrated in FIGS. 15A to 16B, the through holes 43X, 43Y, and 72X may be formed after the structural body 43 is stacked on the structural body 42 via the adhesive layer 72.

Figure 17A:
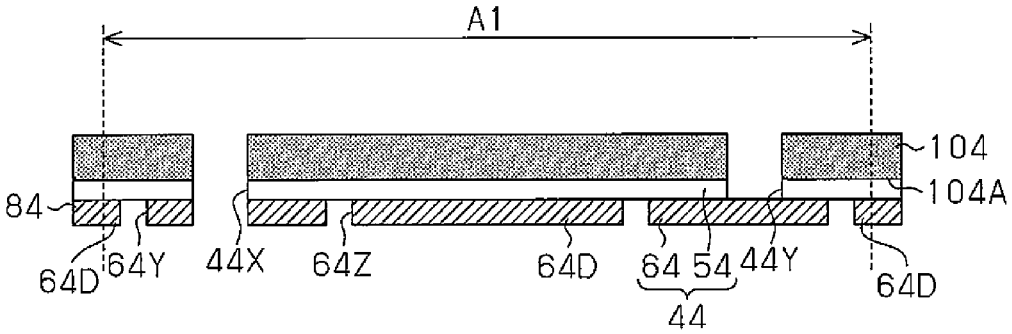
FIG. 17A is a schematic cross-sectional view, taken along line 17*a*-17*a* in FIG. 17B, illustrating the manufacturing method of the coil substrate.

Next, in the step illustrated in FIG. 17A, the structural body 44 having the insulating layer 54 and the wiring 64 is stacked on a lower surface 104A of the support film 104. This step may be performed in the same manner as the step illustrated in FIGS. 12A and 12B. Thus, the detailed description of the manufacturing method will be omitted.

Figure 17B:
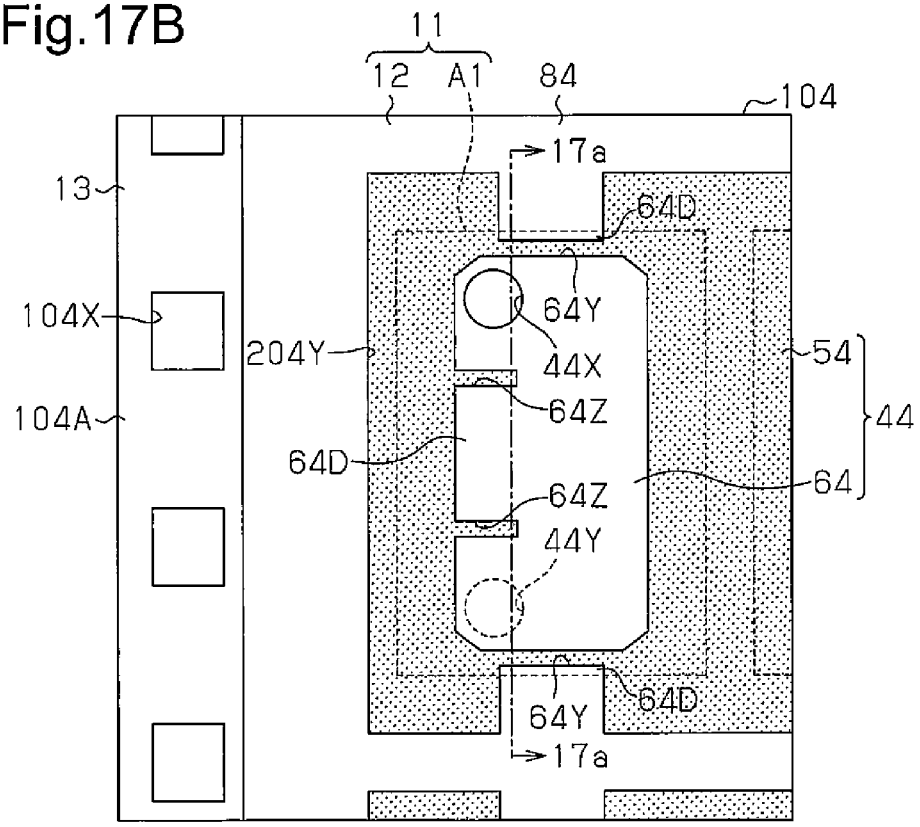
FIG. 17B is a schematic plan view illustrating the manufacturing method of the coil substrate.

The structure illustrated in FIG. 17A includes the through hole 44X that extends through the support film 104, the insulating layer 54, and the wiring 64 in the thickness direction. Further, this structure includes the through hole 44Y that extends through the support film 104 and the insulating layer 54 in the thickness direction to expose the upper surface of the wiring 64. As illustrated in FIG. 17B, the wiring 64, the metal layer 64D, and the metal layer 84 are formed in the lower surface of the insulating layer 54. The wiring 64 is separated from the metal layer 84 by an opening 204Y and the groove 64Y. The groove 64Z is formed in the wiring 64. The groove 64Z facilitates the formation of the spiral shape of the coil when molding the coil substrate 20 in the subsequent step. The wiring 64 (second metal layer) formed in this step has a planar shape greater than, for example, the wiring 64 illustrated in FIG. 7 (a part of the helical coil). The wiring 64 (second metal layer) is molded by the die-cutting or the like eventually to form the fourth-layer wiring (about ¾ turn) of the helical coil. In FIG. 17B, the insulating layer 54 exposed from the opening 204Y and the grooves 64Y and 64Z is illustrated by the shaded pattern.

Figure 18A:
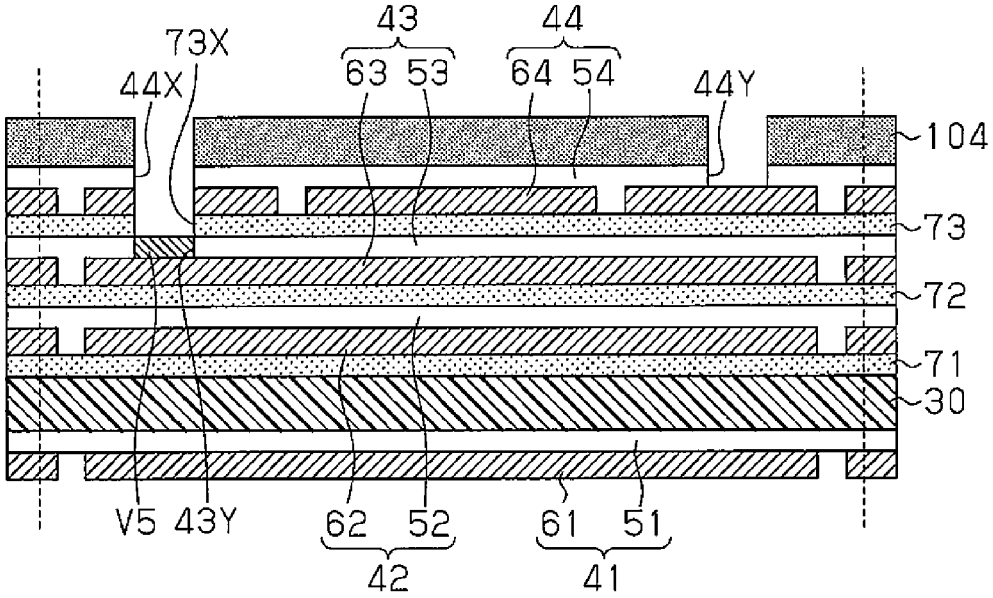
FIGS. 18A and 18B are schematic cross-sectional views illustrating the manufacturing method of the coil substrate.
Figure 18B:
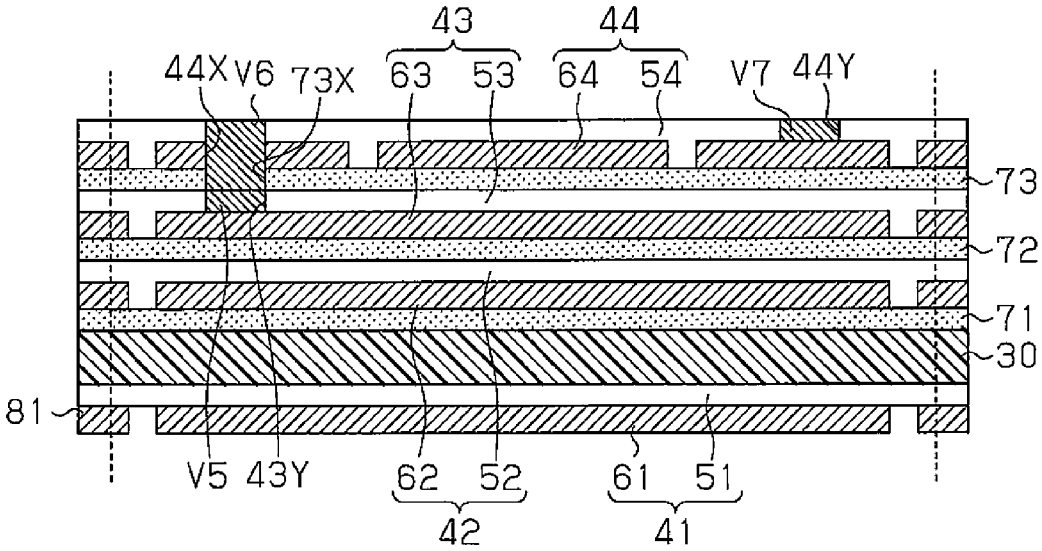

Next, the steps illustrated in FIGS. 18A and 18B will now be described. FIGS. 18A and 18B are cross-sectional views corresponding to the position at line 17*a*-17*a* of FIG. 17B.

First, in the step illustrated in FIG. 18A, the adhesive layer 73 is stacked on the insulating layer 53 of the structural body 43. Next, the through hole 73X that extends through the adhesive layer 73 in the thickness direction is formed. Next, in the same manner as the step in FIG. 13B, the structural body 44 is stacked on the insulating layer 53 via the adhesive layer 73, and then the support film 104 is stacked on the structural body 44. The through hole 44X, the through hole 73X, and the through hole 43Y are communicated with one another. Thus, the via wiring V5 filled in the through hole 43Y is exposed through the through holes 44X and 73X. Next, the support film 104 is peeled off from the insulating layer 54 of the structural body 44.

Next, in the step illustrated in FIG. 18B, the via wiring V6, which fills the through holes 44X and 73X, and the via wiring V7, which fills the through hole 44Y, are formed. Accordingly, the wiring 64 is connected in series to the wiring 63 by the via wirings V5 and V6, and the wiring 64 is electrically connected to the via wiring V7. For example, the via wirings V6 and V7 are formed such that upper surfaces of the via wirings V6 and V7 are flush with the upper surface of the insulating layer 54. For example, the via wirings V6 and V7 may be formed by performing the electrolytic plating using both of the metal layer 81 and the wiring 61 as the power supplying layer, or by filling metal paste.

By the manufacturing steps described above, the wirings 61, 62, 63, and 64 are connected in series to one another by the via wirings V1 to V6 in a stacked structure having the structural body 41, the substrate 30, and the structural bodies 42 to 44. The series conductor of the wirings 61 to 64 and the via wirings V1 to V6 corresponds to a part of about three turns of the helical coil.

In the steps illustrated in FIGS. 17A and 18A, the through holes 44X, 44Y, and 73X may be formed after the structural body 44 is stacked on the structural body 43 via the adhesive layer 73.

Figure 19A:
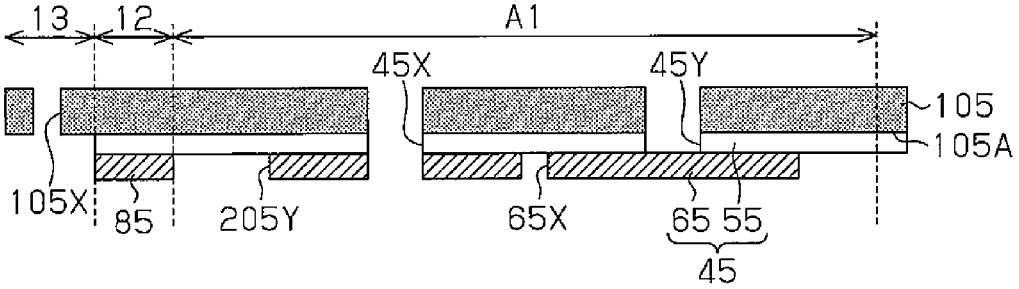
FIG. 19A is a schematic cross-sectional view, taken along line 19*a*-19*a* in FIG. 19B, illustrating the manufacturing method of the coil substrate.

Next, in the step illustrated in FIG. 19A, the structural body 45 having the insulating layer 55 and the wiring 65 is stacked on a lower surface 105A of the support film 105. This step may be performed in the same manner as the step illustrated in FIGS. 12A and 12B. Thus, the detailed description of the manufacturing method will be omitted.

Figure 19B:
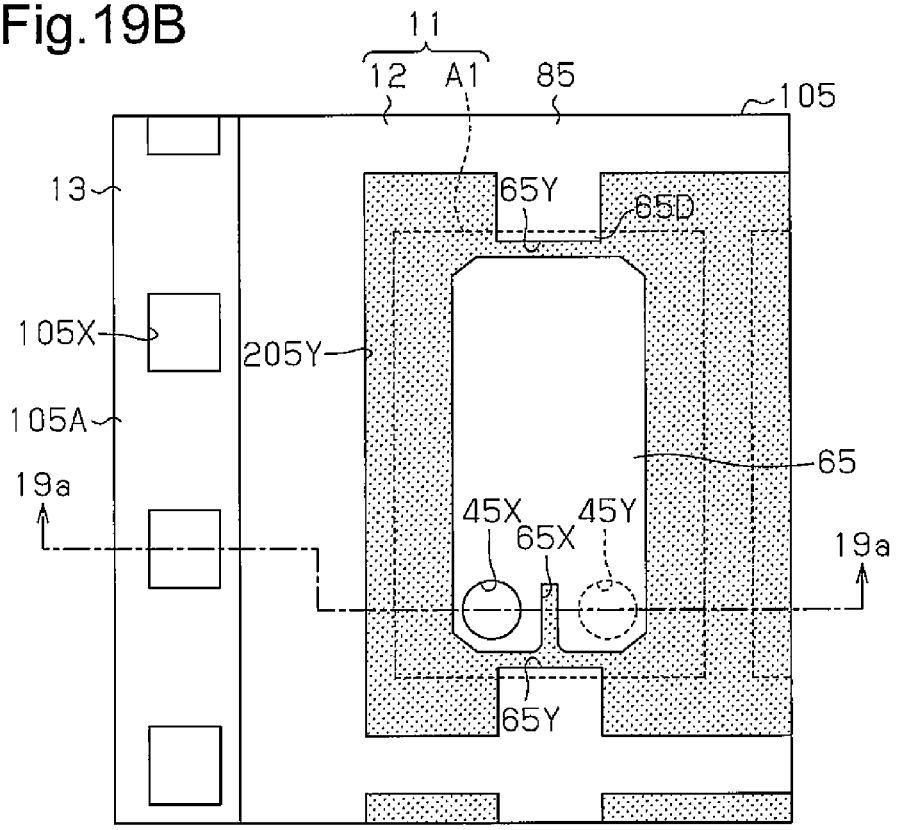
FIG. 19B is a schematic plan view illustrating the manufacturing method of the coil substrate.

The structure illustrated in FIG. 19A includes the through hole 45X that extends through the support film 105, the insulating layer 55, and the wiring 65 in the thickness direction. Further, this structure includes the through hole 45Y that extends through the support film 105 and the insulating layer 55 in the thickness direction to expose the upper surface of the wiring 65. As illustrated in FIG. 19B, the wiring 65, the metal layer 65D, and the metal layer 85 are formed in the lower surface of the insulating layer 55. The wiring 65 is separated from the metal layers 65D and 85 by an opening 205Y and the groove 65Y. The groove 65X is formed in the wiring 65. The groove 65X facilitates the formation of the spiral shape of the coil when molding the coil substrate 20 in the subsequent step. The wiring 65 (second metal layer) formed in this step has a planar shape greater than, for example, the wiring 65 illustrated in FIG. 7 (a part of the helical coil). The wiring 65 is molded by the die-cutting or the like eventually to form the fifth-layer wiring (about one turn) of the helical coil. In FIG. 19B, the insulating layer 55 exposed from the opening 205Y and the grooves 65X and 65Y is illustrated by the shaded pattern.

Figure 20A:
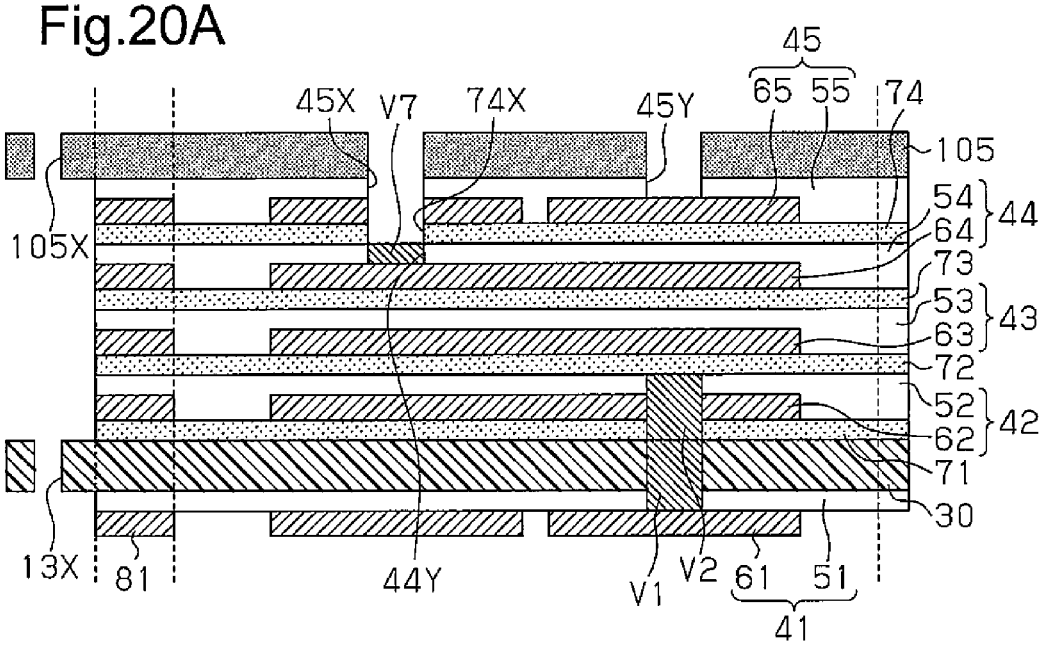
FIGS. 20A, 20B, 21A, and 21B are schematic cross-sectional views illustrating the manufacturing method of the coil substrate.
Figure 20B:
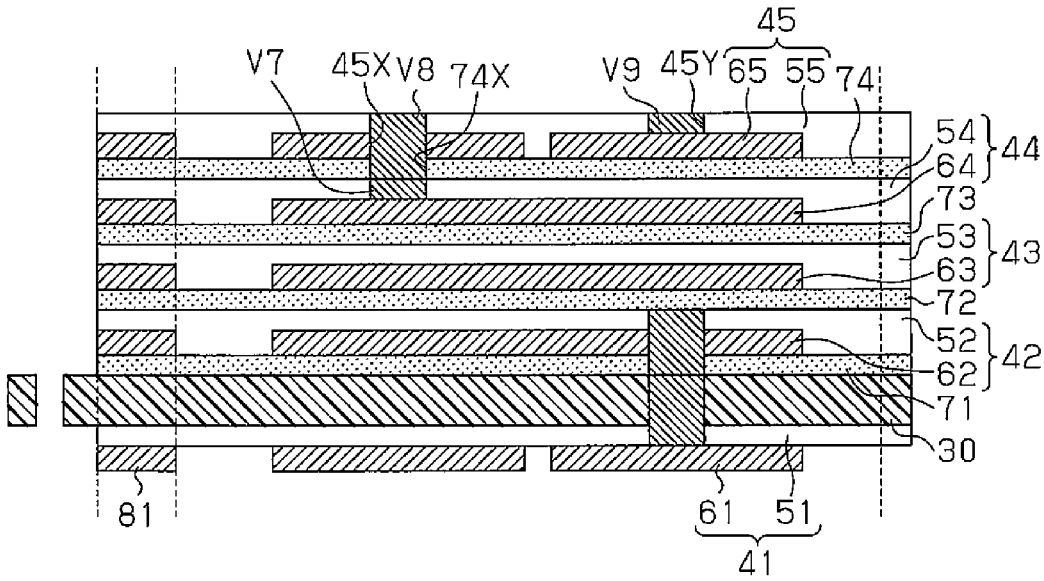

Next, the steps illustrated in FIGS. 20A and 20B will now be described. FIGS. 20A and 20B are cross-sectional views corresponding to the position at line 19*a*-19*a* of FIG. 19B.

First, in the step illustrated in FIG. 20A, the adhesive layer 74 is stacked on the insulating layer 54 of the structural body 44. Next, the through hole 74X that extends through the adhesive layer 74 in the thickness direction is formed. Next, in the same manner as the step illustrated in FIG. 13B, the structural body 45 is stacked on the insulating layer 54 via the adhesive layer 74, and then the support film 105 is stacked on the structural body 45. The through hole 45X, the through hole 74X, and the through hole 44Y are communicated with one another. Thus, the via wiring V7 filled in the through hole 44Y is exposed through the through holes 45X and 74X. Next, the support film 105 is peeled off from the insulating layer 55 of the structural body 45.

Next, in the step illustrated in FIG. 20B, the via wiring V8, which fills the through holes 45X and 74X, and the via wiring V9, which fills the through hole 45Y, are formed. Accordingly, the wiring 65 is connected in series to the wiring 64 by the via wirings V7 and V8, and the wiring 65 is electrically connected to the via wiring V9. For example, the via wirings V8 and V9 are formed such that upper surfaces of the via wirings V8 and V9 are flush with the upper surface of the insulating layer 55. The via wirings V8 and V9 may be formed by performing the electrolytic plating using both of the metal layer 81 and the wiring 61 as the power supplying layer, or by filling metal paste, for example.

By the manufacturing steps described above, the wirings 61, 62, 63, 64, and 65 are connected in series to one another by the via wirings V1 to V8 in a stacked structure having the structural body 41, the substrate 30, and the structural bodies 42 to 45. The series conductor of the wirings 61 to 65 and the via wirings V1 to V8 corresponds to a part of about four turns of the helical coil.

In the steps illustrated in FIGS. 19A and 20A, the through holes 45X, 45Y, and 74X may be formed after the structural body 45 is stacked on the structural body 44 via the adhesive layer 74.

Figure 21A:
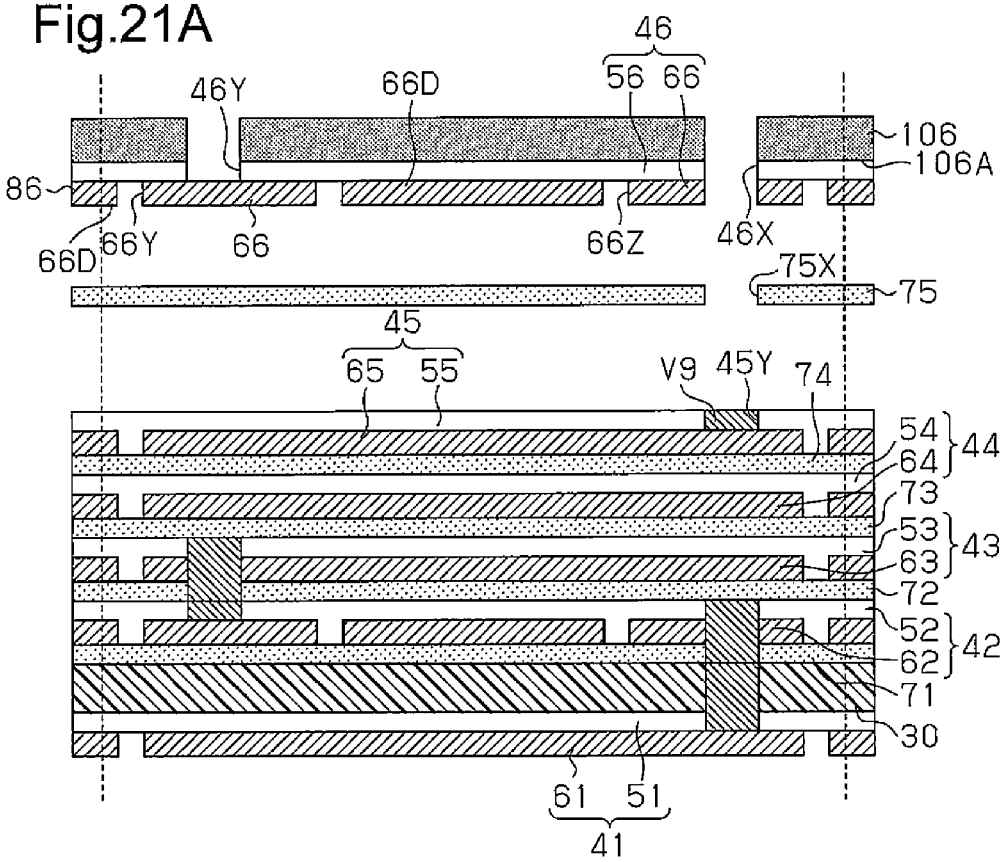
Figure 21B:
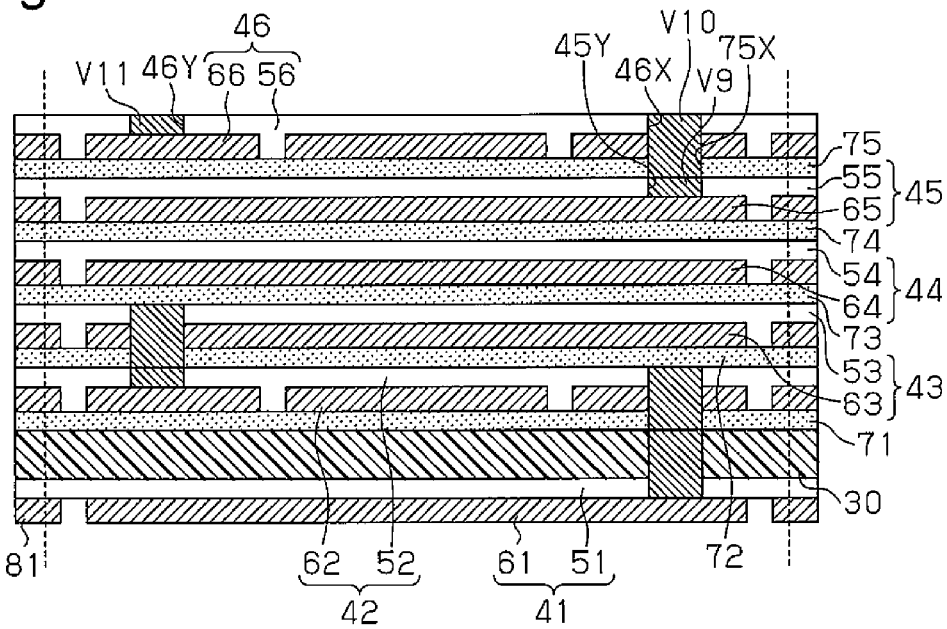

Next, the steps illustrated in FIGS. 21A and 21B will now be described. FIGS. 21A and 21B are cross-sectional views corresponding to the position at line 12*a*-12*a* of FIG. 12C.

In the step illustrated in FIG. 21A, in the same manner as the steps in FIGS. 12A to 12C, the structural body 46 having the insulating layer 56 and the wiring 66 is stacked on a lower surface 106A of the support film 106. The structural body 46 includes the through hole 46X that extends through the support film 106, the insulating layer 56, and the wiring 66 in the thickness direction. Further, the structural body 46 includes the through hole 46Y that extends through the support film 106 and the insulating layer 56 in the thickness direction to expose the upper surface of the wiring 66. Further, the wiring 66, the metal layer 66D, and the metal layer 86 are formed in the lower surface of the insulating layer 56. The wiring 66 is separated from the metal layer 86 by the groove 66Y. The groove 66Z is formed in the wiring 66. The groove 66Z facilitates the formation of the spiral shape of the coil when molding the coil substrate 20 in the subsequent step. The wiring 66 (second metal layer) formed in this step has a planar shape greater than, for example, the wiring 66 illustrated in FIG. 7 (a part of the helical coil). The wiring 66 (second metal layer) is molded by the die-cutting or the like eventually to form the sixth-layer wiring (about ¾ turn) of the helical coil. The structural body 46 has the same structure as the structural body 42. Although not illustrated in FIGS. 21A and 21B, the structural body 46 includes an opening at the position corresponding to the opening 202Y.

Next, the adhesive layer 75 is prepared and the through hole 75X extending through the adhesive layer 75 in the thickness direction is formed.

Next, in the step illustrated in FIG. 21B, in the same manner as the step in FIG. 13B, the structural body 46 is stacked on the insulating layer 55 of the structural body 45 via the adhesive layer 75, and then the support film 106 is stacked on the structural body 46. The through hole 46X, the through hole 75X, and the through hole 45Y are communicated with one another. Thus, the via wiring V9 filled in the through hole 45Y is exposed through the through holes 46X and 75X. Next, the support film 106 is peeled off from the insulating layer 56 of the structural body 46. Next, the via wiring V10, which fills the through holes 46X and 75X, and the via wiring V11, which fills the through hole 46Y, are formed. Accordingly, the wiring 66 is connected in series to the wiring 65 by the via wirings V9 and V10, and the wiring 66 is electrically connected to the via wiring V11. For example, the via wirings V10 and V11 are formed such that upper surfaces of the via wirings V10 and V11 are flush with the upper surface of the insulating layer 56. For example, the via wirings V10 and V11 may be formed by performing the electrolytic plating using both of the metal layer 81 and the wiring 61 as the power supplying layer, or by filling metal paste.

By the manufacturing steps described above, the wirings 61, 62, 63, 64, 65, and 66 are connected in series to one another by the via wirings V1 to V10 in a stacked structure having the structural body 41, the substrate 30, and the structural bodies 42 to 46. The series conductor of the wirings 61 to 66 and the via wirings V1 to V10 corresponds to a part of about (4+¾) turns of the helical coil.

In the step illustrated in FIG. 21A, the through holes 46X, 46Y, and 75X may be formed after the structural body 46 is stacked on the structural body 45 via the adhesive layer 75.

Figure 22A:
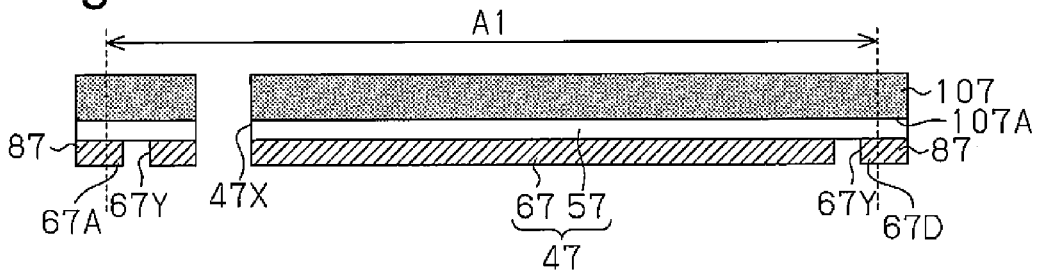
FIG. 22A is a schematic cross-sectional view, taken along line 22*a*-22*a* in FIG. 22C, illustrating the manufacturing method of the coil substrate.

Next, in the step illustrated in FIG. 22A, the structural body 47 having the insulating layer 57 and the wiring 67 is stacked on a lower surface 107A of the support film 107. This step may be performed in the same manner as the step illustrated in FIGS. 12A and 12B. Thus, the detailed description of the manufacturing method will be omitted.

Figure 22B:
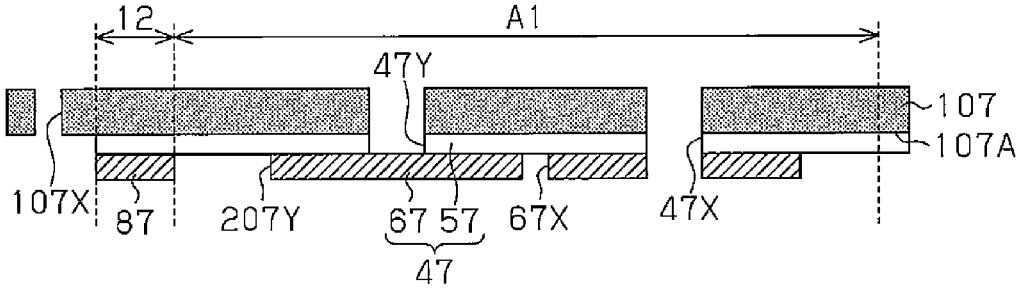
FIG. 22B is a schematic cross-sectional view, taken along line 22*b*-22*b* in FIG. 22C, illustrating the manufacturing method of the coil substrate.
Figure 22C:
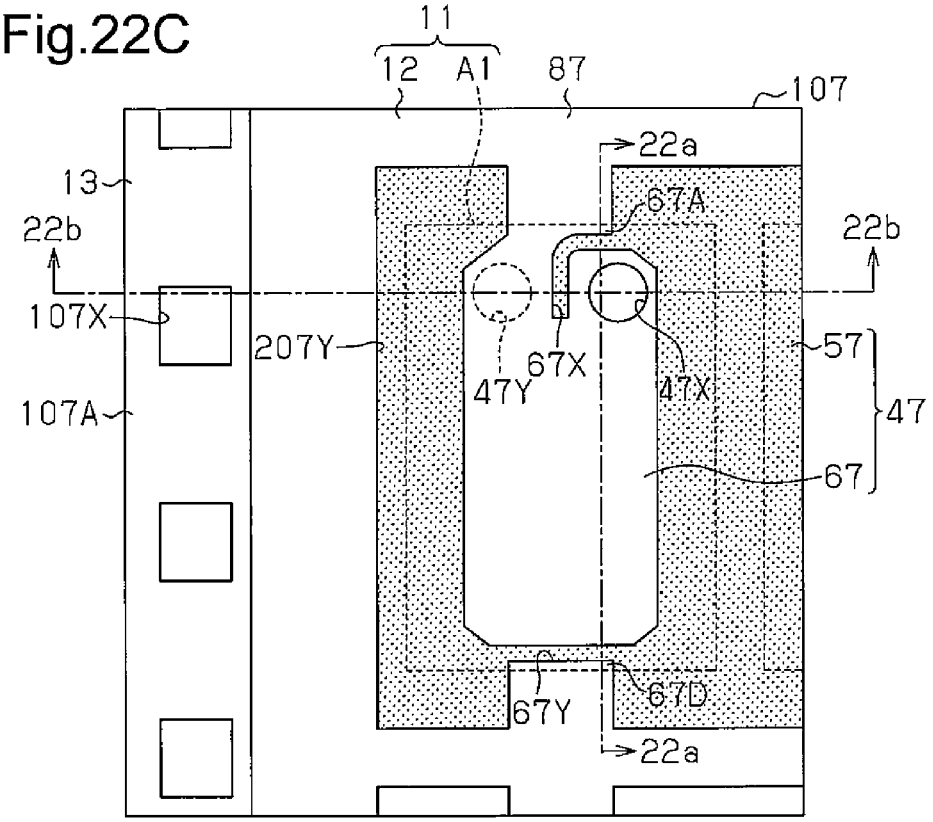
FIG. 22C is a schematic plan view illustrating the manufacturing method of the coil substrate.

The structure illustrated in FIG. 22B includes the through hole 47X that extends through the support film 107, the insulating layer 57, and the wiring 67 in the thickness direction. Further, this structure includes the through hole 47Y that extends through the support film 107 and the insulating layer 57 in the thickness direction to expose the upper surface of the wiring 67. As illustrated in FIGS. 22A and 22C, the wiring 67, the connection portion 67A, the metal layer 67D, and the metal layer 87 are formed in the lower surface of the insulating layer 57. These wiring 67, connection portion 67A, metal layer 67D, and metal layer 87 are integrally formed. In addition, as illustrated in FIG. 22C, an opening 207Y is formed in the structural body 47, and the groove 67Y is formed between the wiring 67 and the metal layer 67D. The groove 67X is formed in the wiring 67. The groove 67X facilitates the formation of the spiral shape of the coil when molding the coil substrate 20 in the subsequent step. The wiring 67 (second metal layer) formed in this step has a planar shape greater than, for example, the wiring 67 illustrated in FIG. 7 (a part of the helical coil). Further, the wiring 67 is molded by the die-cutting or the like eventually to form the seventh-layer wiring (about one turn) of the helical coil. In FIG. 22C, the insulating layer 57 exposed from the opening 207Y and the grooves 67X and 67Y is illustrated by the shaded pattern.

Next, the steps illustrated in FIGS. 23A to 24B will now be described. FIGS. 23A to 24A are cross-sectional views corresponding to the position at line 22*a*-22*a* of FIG. 22C, and FIG. 24B is a cross-sectional view corresponding to the position at line 22*b*-22*b* of FIG. 22C.

Figure 23A:
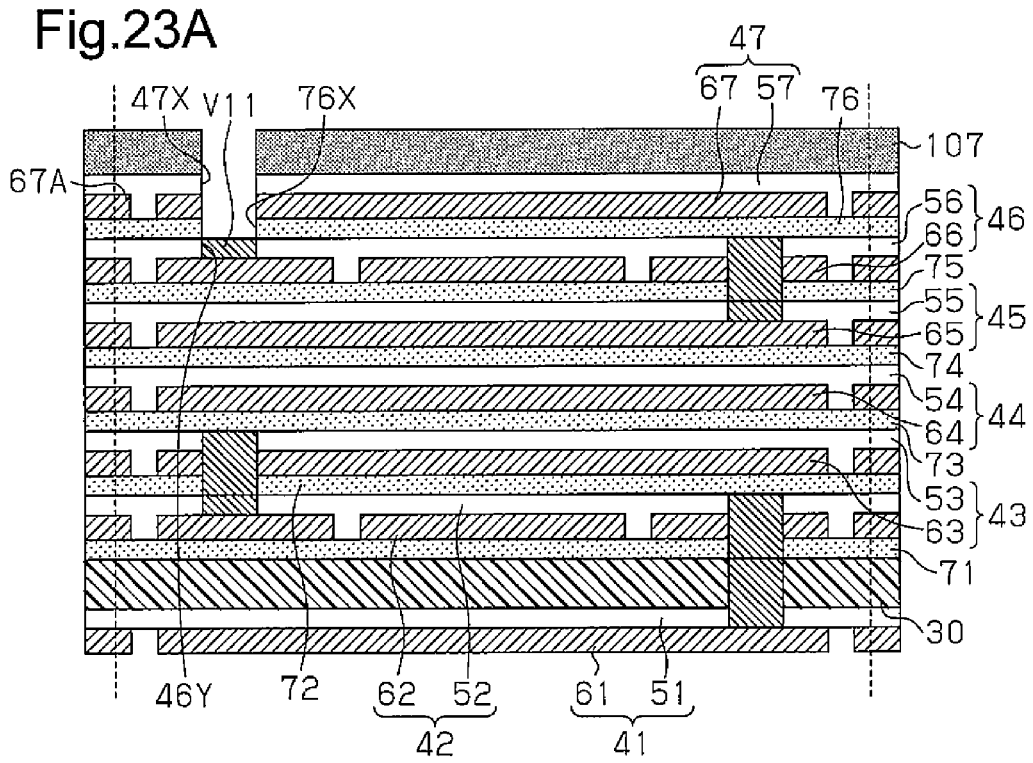
FIGS. 23A, 23B, 24A, and 24B are schematic cross-sectional views illustrating the manufacturing method of the coil substrate.
Figure 23B:
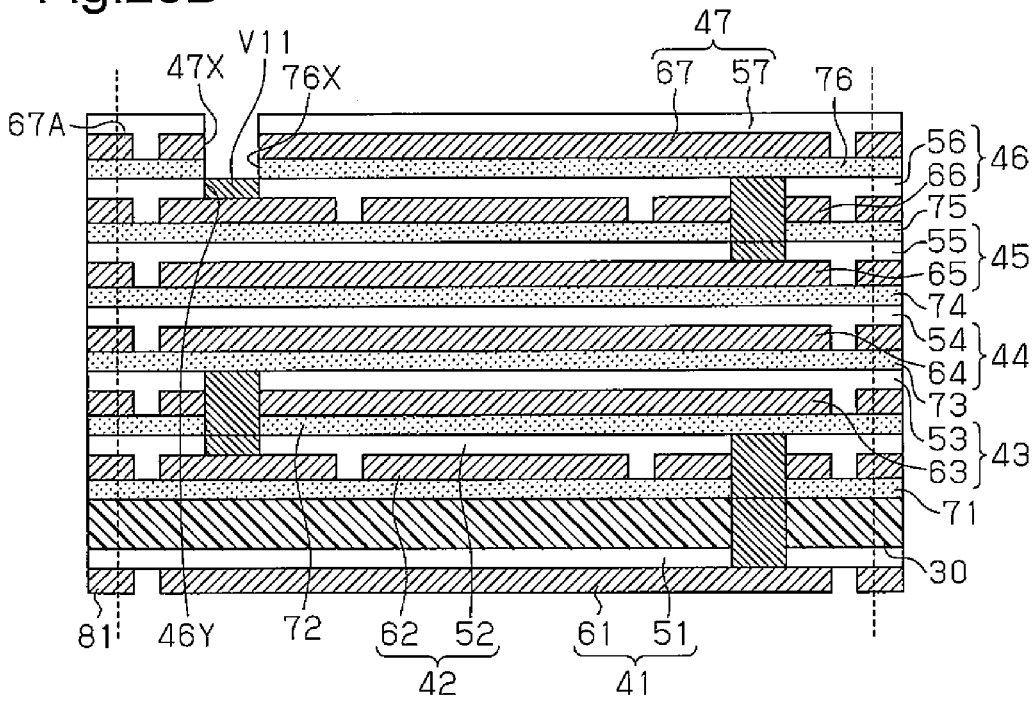

First, in the step illustrated in FIG. 23A, the adhesive layer 76 is stacked on the insulating layer 56 of the structural body 46, and then the through hole 76X that extends through the adhesive layer 76 in the thickness direction is formed. Next, in the same manner as the step in FIG. 13B, the structural body 47 is stacked on the insulating layer 56 via the adhesive layer 76, and then the support film 107 is stacked on the structural body 47. The through hole 47X, the through hole 76X, and the through hole 46Y are communicated with one another. Thus, the via wiring V11 filled in the through hole 46Y is exposed through the through holes 47X and 76X. Next, in the step illustrated in FIG. 23B, the support film 107 illustrated in FIG. 23A is peeled off from the insulating layer 57 of the structural body 47.

Figure 24A:
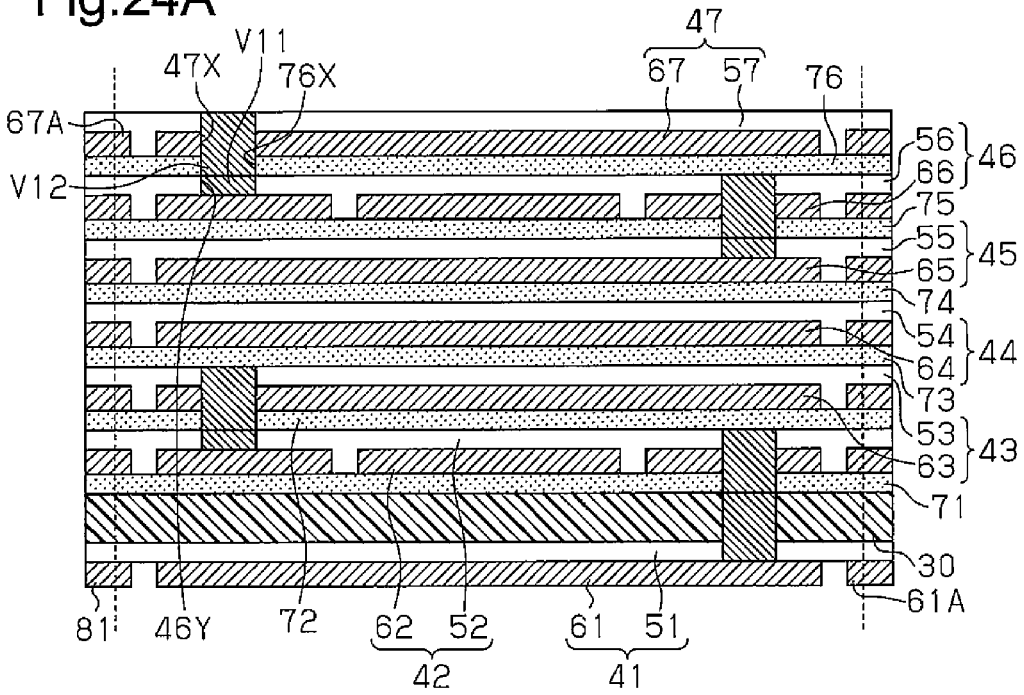
Figure 24B:
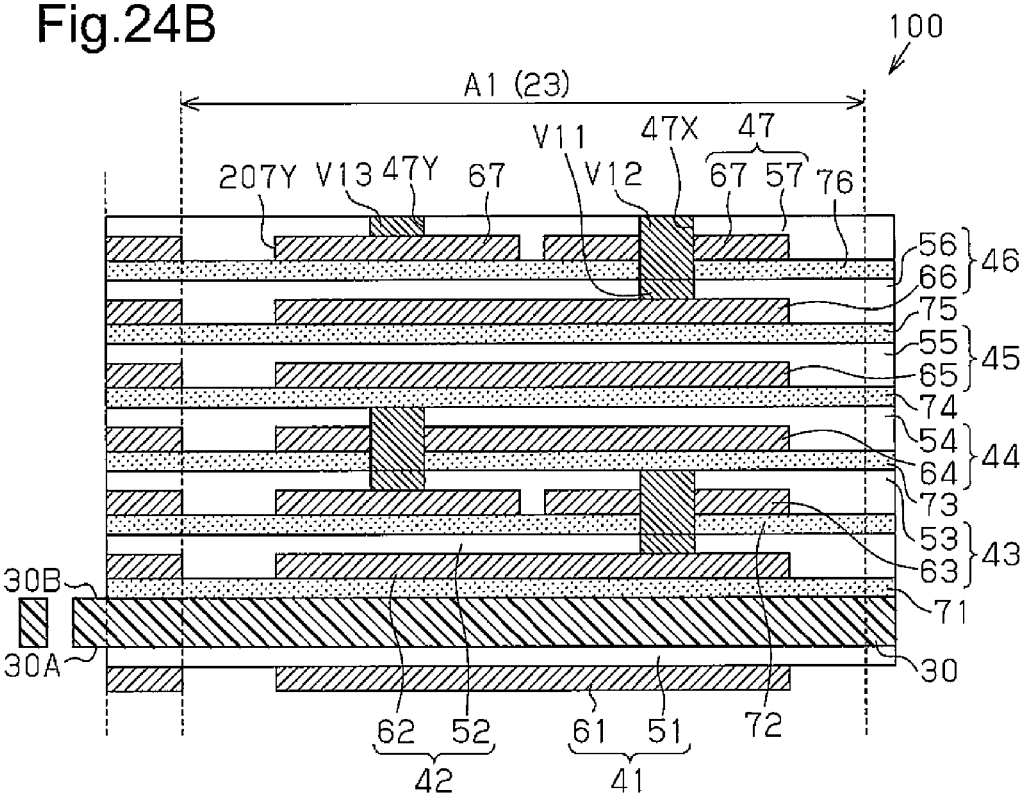

Next, in the steps illustrated in FIGS. 24A and 24B, the via wiring V12 that fills the through holes 47X and 76X is formed. Accordingly, the wiring 67 is connected in series to the wiring 66 by the via wirings V11 and V12. Further, as illustrated in FIG. 24B, the via wiring V13 that fills the through hole 47Y is formed. Accordingly, the wiring 67 is electrically connected to the via wiring V13. For example, the via wirings V12 and V13 are formed such that upper surfaces of the via wirings V12 and V13 are flush with the upper surface of the insulating layer 57. For example, the via wirings V12 and V13 may be formed by performing the electrolytic plating using both of the metal layer 81 and the wiring 61 as the power supplying layer, or by filling metal paste.

By the manufacturing steps described above, the wirings 61, 62, 63, 64, 65, 66, and 67 are connected in series to one another by the via wirings V1 to V12 in a stacked structure having the structural body 41, the substrate 30, and the structural bodies 42 to 47. The series conductor of the wirings 61 to 67 and the via wirings V1 to V12 corresponds to a part of about (5+½) turns of the helical coil.

In the step illustrated in FIGS. 22A to 23B, the through holes 47X, 47Y, and 76X may be formed after the structural body 47 is stacked on the structural body 46 via the adhesive layer 76.

By the manufacturing steps described above, the stacked structure 23 is formed in each of the individual areas A1 such that the structural body 41 is stacked on the lower surface 30A of the substrate 30 and the structural bodies 42 to 47 are sequentially stacked on the upper surface 30B of the substrate 30.

Figure 25A:
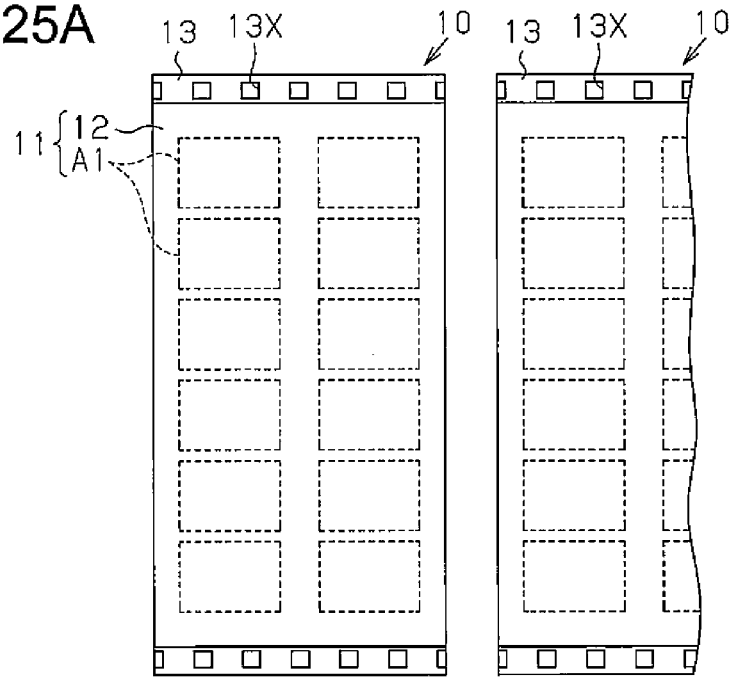
FIGS. 25A to 25C are schematic plan views illustrating the manufacturing method of the coil substrate.

Next, in the step illustrated in FIG. 25A, the structure illustrated in FIG. 24B is cut along the cutting position A2 illustrated in FIG. 9 to obtain sheet-like individual coil substrates 10. In the example of FIG. 25A, twelve individual areas A1 are formed in each of the coil substrates 10. Here, without performing the step illustrated in FIG. 25A, the reel-like substrate 100 after completing the step illustrated in FIG. 24B may be shipped as a product.

Figure 25B:
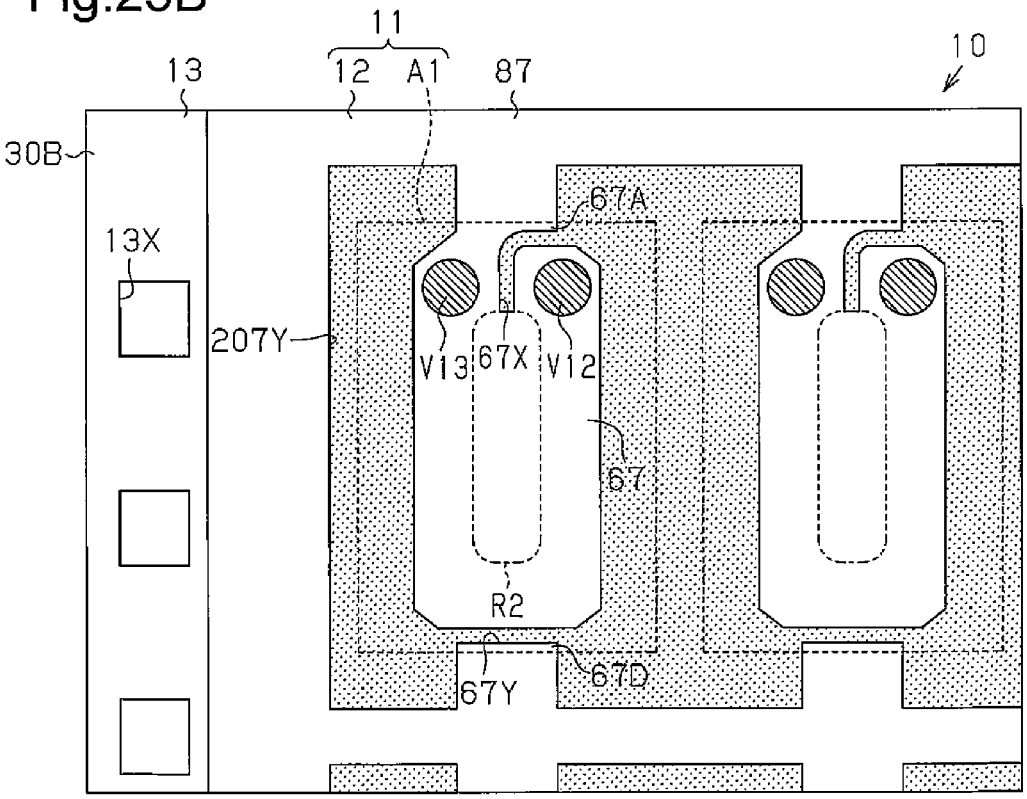
Figure 25C:
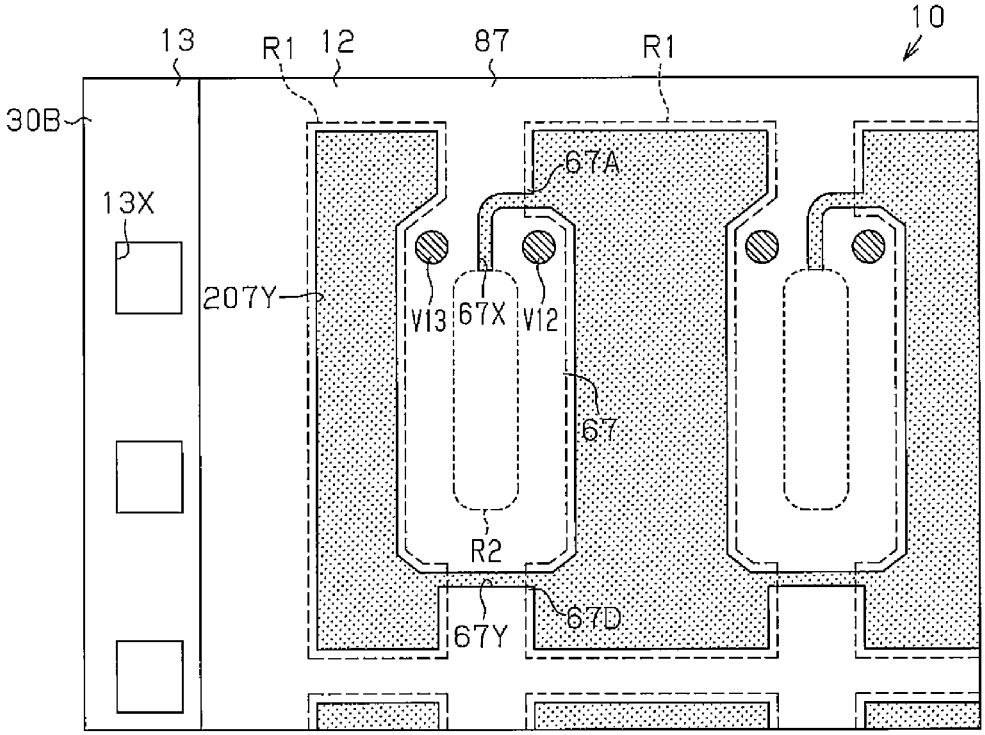
Figure 26:
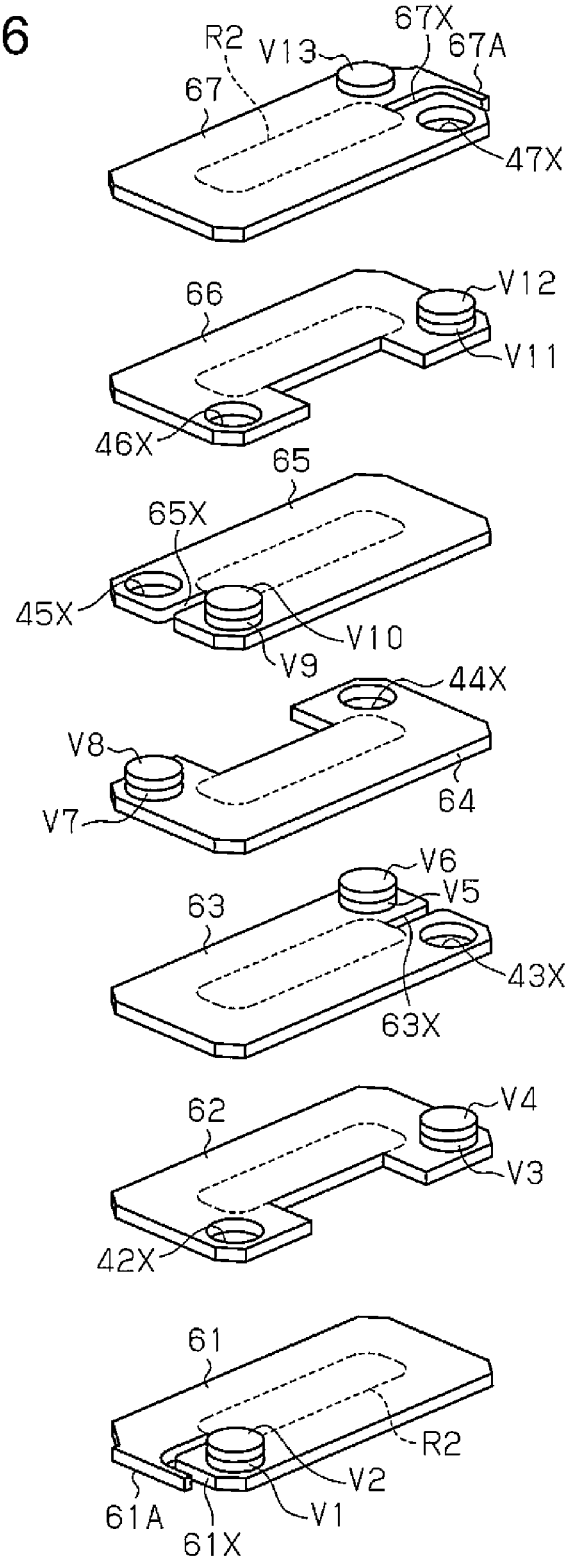
FIG. 26 is a schematic perspective view illustrating the wiring structure before molding.
Figure 27A:
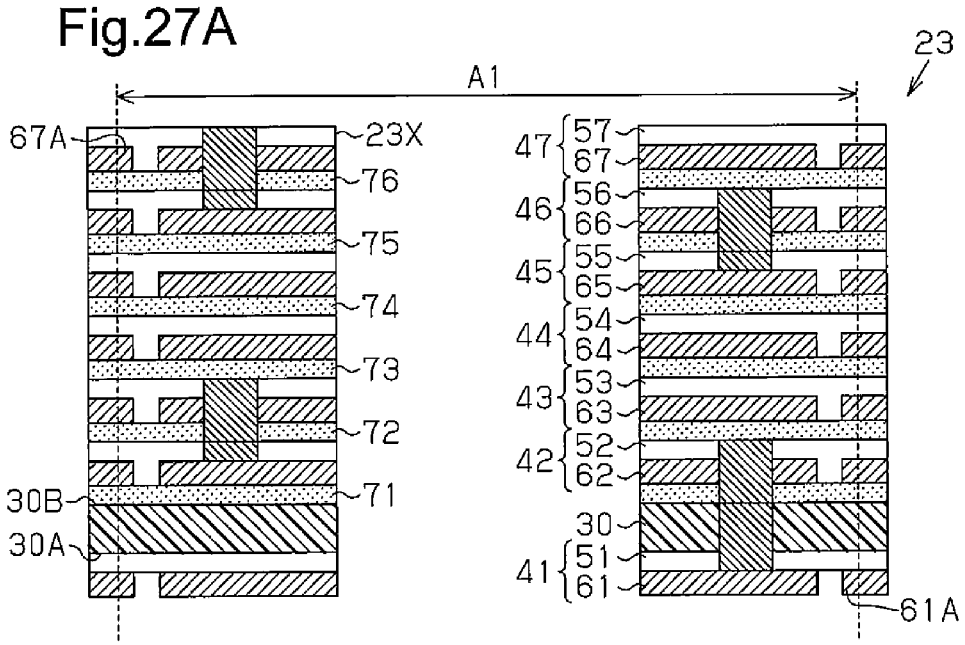
FIG. 27A is a schematic cross-sectional view, taken along line 27*a*-27*a* in FIG. 27B, illustrating the manufacturing method of the coil substrate.
Figure 27B:
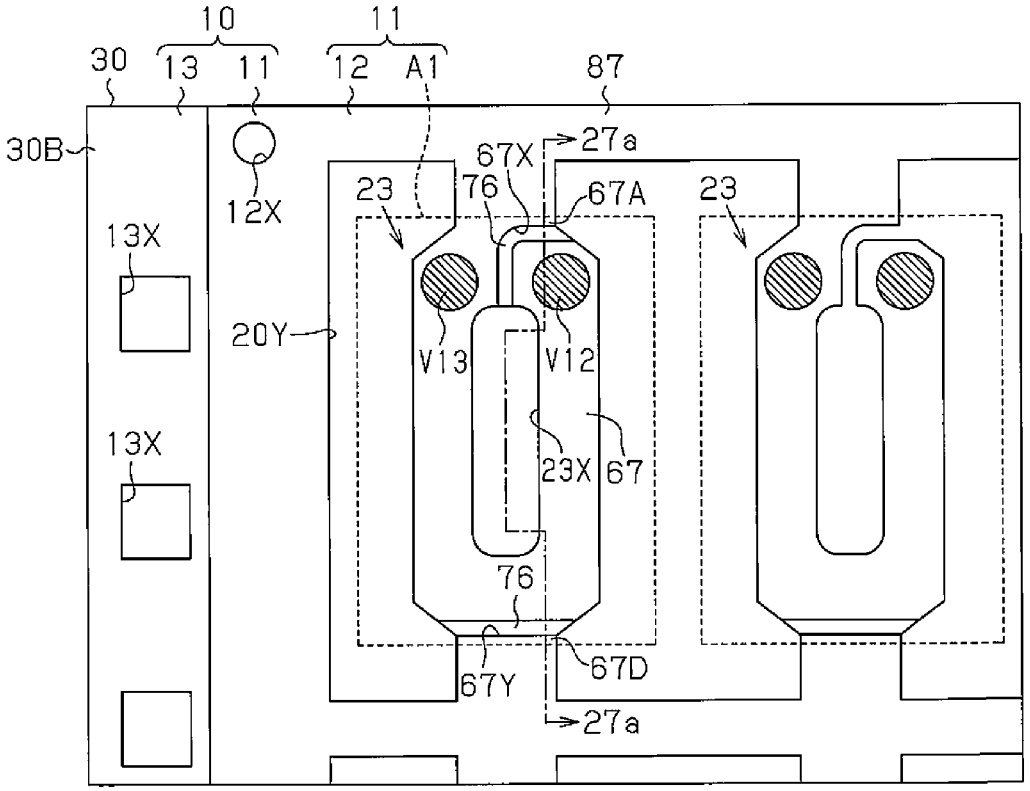
FIGS. 27B and 28 are schematic plan views illustrating the manufacturing method of the coil substrate.

Next, in the steps illustrated in FIGS. 25B to 27B, the coil substrate 10 is molded by the die-cutting or the like to remove an unnecessary portion, and the wirings 61 to 67 are processed into the shape of the helical coil. FIG. 25B illustrates the wiring 67 and the adhesive layer 76 before molding the coil substrate 10. In FIG. 25B, the insulating layer 57 is not illustrated, and the adhesive layer 76 exposed from the opening 207Y and the grooves 67X and 67Y are illustrated by the shaded pattern. FIG. 26 schematically illustrates the shapes of the wirings 61 to 67 before molding the coil substrate 10. The coil substrate 10 illustrated in FIGS. 25B and 26 is molded by, for example, the press processing using a mold or the like to have the shape illustrated in FIGS. 27A and 27B. In this example, the substrate 30, the insulating layers 51 to 57, the wirings 61 to 67, and the adhesive layers 71 to 76 (see FIG. 24B) are punched out to remove an unnecessary portion of the coil substrate 10 illustrated in FIG. 25B by the press processing at a position corresponding to the opening 20Y. Here, the coil substrate 10 is punched out along a punching region R1 surrounded by the broken line in FIG. 25C. The punching region R1 is set to have a size including a peripheral edge of a coil pattern of each layer formed along the outer shape of the unit coil substrates 20 (see FIG. 1) in the coil substrate 10. In other words, the coil pattern of each layer is formed including a punching margin at its peripheral edge. Further, the substrate 30, the insulating layers 51 to 57, the wirings 61 to 67, and the adhesive layers 71 to 76 are punched out to remove an unnecessary portion of the coil substrate 10 by the press processing along a punching region R2 surrounded by the broken line in FIGS. 25B, 25C, and 26. As a result, as illustrated in FIG. 27B, the opening 20Y is formed at a given position of the block 11, and the outer shape of the stacked structure 23 is molded to be a substantially rectangular shape. Further, the through hole 23X is formed at the substantially center portion of the stacked structure 23. By forming the through hole 23X, as illustrated in FIG. 27A, the inner surfaces of the wirings 61 to 67 that define the inner wall surface of the through hole 23X are exposed. In addition, by forming the opening 20Y, the outer surfaces of the wirings 61 to 67 are exposed from the outer wall surface of the stacked structure 23 (see FIG. 3). The stacked structure 23 is formed in each individual area A1, and the neighboring stacked structures 23 are connected to each other by the connection 12.

In the present embodiment, when performing the press processing, the conductive layers (wirings 61 to 67 and the metal layers 61D to 67D) in the structural bodies 41 to 47 before the molding process are formed in almost the same shape. In other words, by forming the metal layers 61D to 67D as the dummy patterns in the structural bodies 41 to 47, the difference in shapes of the conductive layers in the structural bodies 41 to 47 is decreased. This may suppress deformation of the stacked structure 23 due to the difference in shapes of the conductive layers at the time of the press processing.

Further, the wirings 61 to 67 are formed in the helical coil shape by the press processing. In the present example, the wirings 61 to 67 are connected in series to one another by the via wirings V1 to V12 so as to form the helical coil of about (5+½) turns.

Instead of the press processing using a mold, the coil substrate 10 (i.e., the opening 20Y and the through hole 23X) may be formed by the laser processing. In addition, in this step, when forming the opening 20Y and the through hole 23X, as illustrated in FIG. 27B, the recognition mark 12X that extends through the connection 12 in the thickness direction may be formed at a given position of the connection 12. For example, the recognition mark 12X may be formed by the press processing using a mold or the laser processing.

Figure 28:
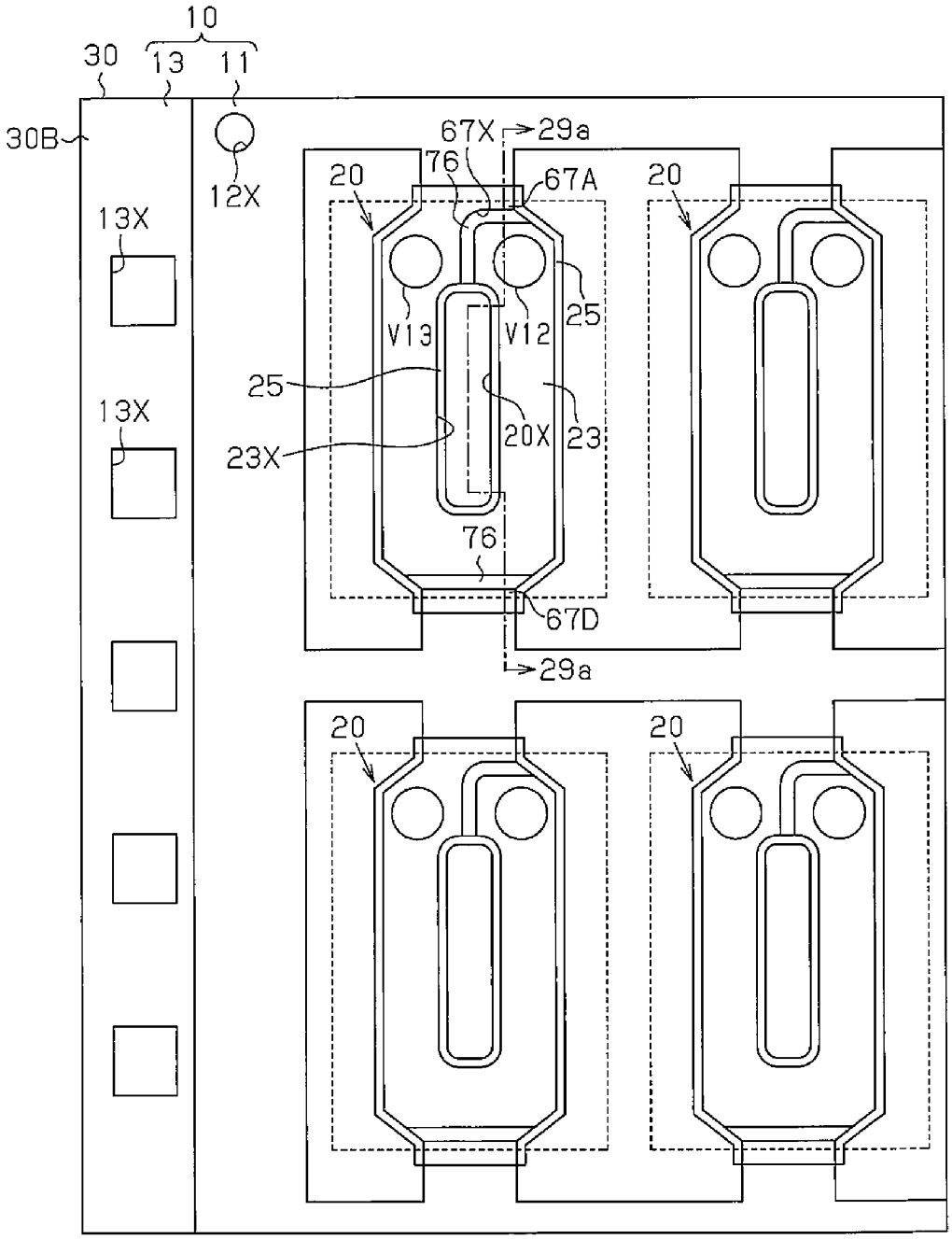
Figure 29A:
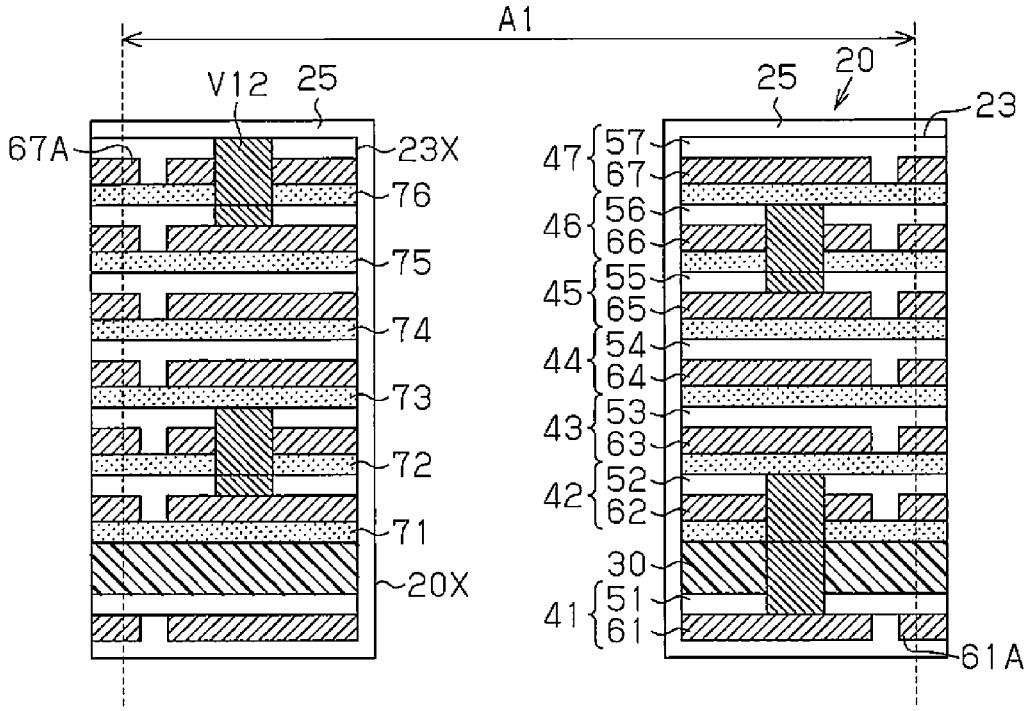
FIG. 29A is a schematic cross-sectional view illustrating the manufacturing method of the coil substrate.

Next, in the steps illustrated in FIGS. 28 and 29A, the insulation film 25 that covers the entire surface of the stacked structure 23 including the inner wall surface of the through hole 23X is formed. The insulation film 25 continuously covers the outer wall surface (side wall) of the stacked structure 23, the lower and side surfaces of the wiring 61 at the lowermost layer, the upper surface of the insulating layer 57 at the uppermost layer, the upper surfaces of the via wiring V12 and V13, and the inner wall surface of the through hole 23X in each individual area A1. End surfaces of the wirings 61 to 67 are exposed at the outer wall surface of the stacked structure 23 and the inner wall surface of the through hole 23X. Thus, even when the encapsulating resin 91 of the inductor 90 (see FIG. 8B) contains a conductive material such as a filler of the magnetic material, the insulation film 25 covering the surface of the stacked structure 23 suppresses the short-circuiting of the wirings 61 to 67 to the conductive material.

The insulation film 25 may be formed using, for example, a spin covering method or a spray covering method. An electrodeposited resist may be used as the insulation film 25. In this case, the electrodeposited resist (insulation film 25) is deposited on the outer surface of the stacked structure 23 and the inner wall surface of the through hole 23X using an electrodeposition covering method.

By the manufacturing method described above, the coil substrate 10 including coil substrates 20 is manufactured.

Next, the manufacturing method of the inductor 90 will now be described.

Figure 29B:
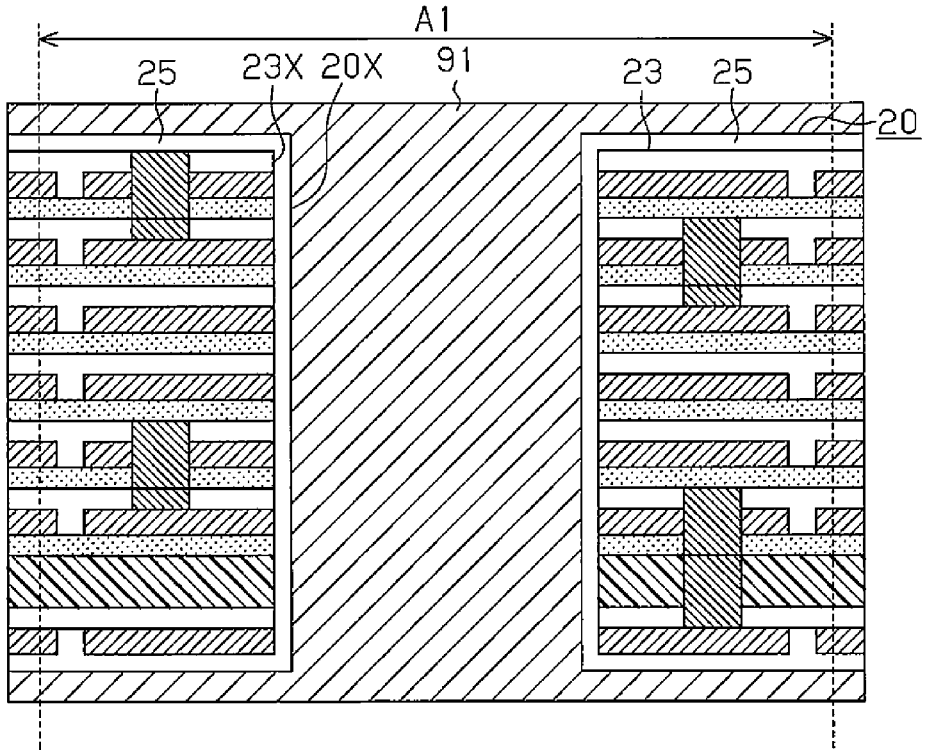
FIGS. 29B, 30A, and 30B are schematic cross-sectional views illustrating the manufacturing method of the inductor of FIG. 8B.

First, in the step illustrated in FIG. 29B, the encapsulating resin 91 which encapsulates the entire coil substrates 20 in each individual area A1 is formed. Accordingly, the through hole 20X of the coil substrate 20 is filled with the encapsulating resin 91. Further, the outer wall surface (side wall) of the coil substrate 20, the upper surface of the coil substrate 20 (upper surface of the insulation film 25), and the lower surface of the coil substrate 20 (lower surface of the insulation film 25) are covered with the encapsulating resin 91. For example, a transfer molding method, a compression molding method, or an injection molding method may be used as a method of filling the encapsulating resin 91.

Next, the structure (coil substrate 10) illustrated in FIG. 29B is cut at the position of the individual area A1 indicated by the broken line. Accordingly, the connection 12 and the outer frame 13 are removed, and the coil substrate 20 encapsulated by the encapsulating resin 91 is obtained. At this time, the plurality of coil substrates 20 are obtained from the coil substrate 10. The connection portion 61A is exposed at one side surface 20A of the coil substrate 20, and the connection portion 67A is exposed at the other side surface 20B of the coil substrate 20.

Figure 30A:
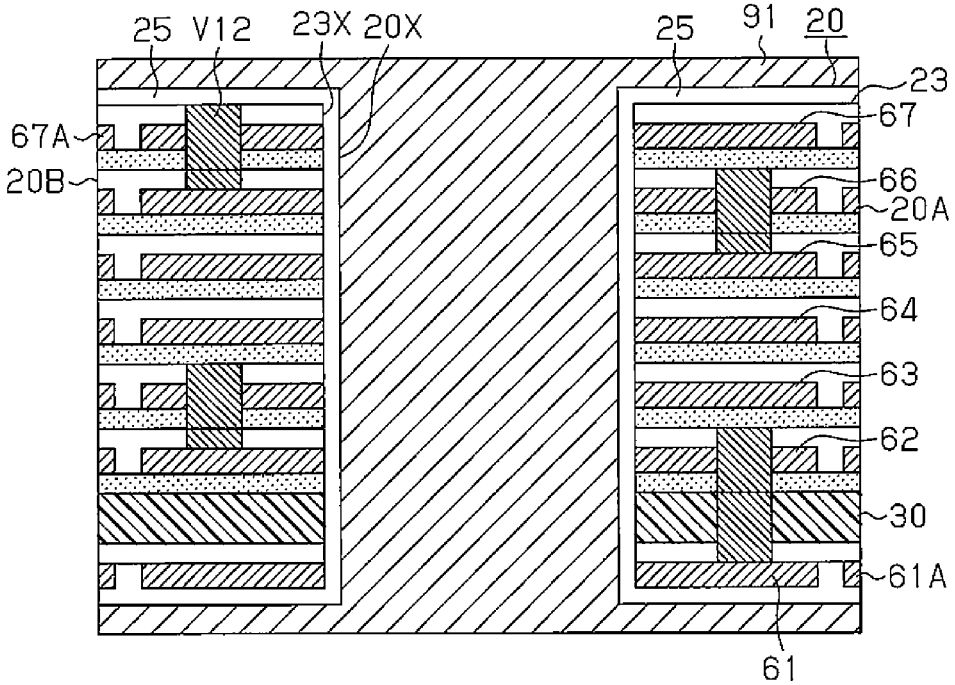

In the steps illustrated in FIGS. 29B and 30A, the structure (coil substrate 10) illustrated in FIGS. 29A and 29B is fragmentized into individual coil substrates 20 after forming the encapsulating resin 91 which encapsulates the coil substrates 20 in each individual area A1. Instead, for example, after fragmentized into the individual coil substrates 20, each of the coil substrates 20 may be encapsulated by the encapsulating resin 91 except for the side surfaces 20A and 20B.

Figure 30B:
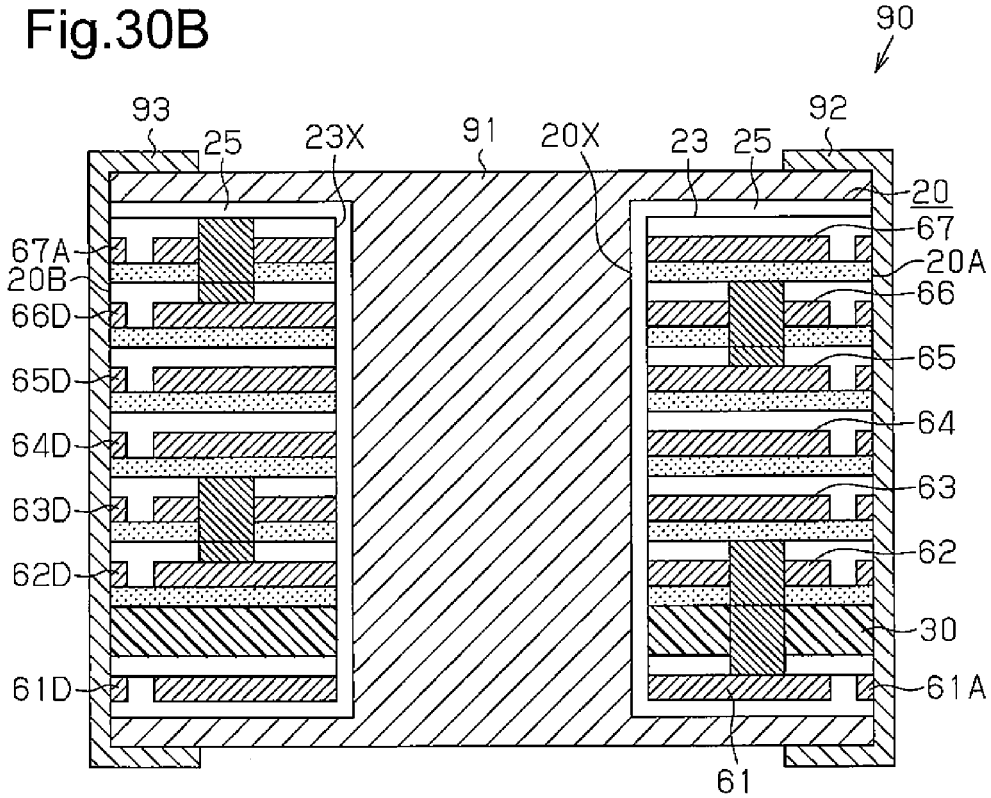

Next, the electrodes 92 and 93 are formed in the step illustrated in FIG. 30B. The electrode 92 continuously covers the side surface 20A of the coil substrate 20, the side surface, upper surface and lower surface at one side of the encapsulating resin 91. The electrode 93 continuously covers the side surface 20B of the coil substrate 20, the side surface, upper surface and lower surface at the other side of encapsulating resin 91. The inner wall surface of the electrode 92 is in contact with the side surface of the connection portion 61A exposed at the side surface 20A of the coil substrate 20. Accordingly, the wiring 61 including the connection portion 61A is electrically connected to the electrode 92. Similarly, the inner wall surface of the electrode 93 is in contact with the side surface of the connection portion 67A exposed at the side surface 20B of the coil substrate 20. Accordingly, the wiring 67 including the connection portion 67A is electrically connected to the electrode 93. By the manufacturing steps described above, the inductor 90 illustrated in FIG. 8B is manufactured.

The present embodiment has the following advantages.

(1) The structural body 41 including the wiring 61 and the insulating layer 51 is stacked on the lower surface 30A of the substrate 30, and the structural bodies 42 to 47 including the wirings 62 to 67 and the insulating layers 52 to 57 are stacked on the upper surface 30B of the substrate 30. The wirings 61 to 67 are connected in series to one another by the via wirings V1 to V12 to form one helical coil. According to this structure, a coil having any number of turns may be formed by adjusting the number of structural bodies stacked on both the surfaces 30A and 30B of the substrate 30 without changing the planar shape of the coil (inductor). Thus, a coil having a size (for example, the planar shape of 1.6 mm×0.8 mm) that is smaller than a conventional size (for example, the planar shape of 1.6 mm×1.6 mm) may be easily formed.

(2) By increasing the number of structural bodies stacked on the side surfaces 30A and 30B of the substrate 30, the number of turns of the coil is increased without changing the planar shape of the coil (inductor). Thus, a coil having a smaller size and a greater inductance may be easily formed.

(3) The substrate 30 having a smaller thermal expansion coefficient than that of the insulating layers 51 to 57 of the structural bodies 41 to 47 is arranged in the stacked structure 23. This reduces thermal deformation (thermal shrinkage or thermal expansion) of the substrate 30 when the change in temperature occurs in the coil substrate 20. Thus, displacement of the positions of the wirings 61 to 67 is suppressed. That is, even when the change in temperature occurs in the coil substrate 20, the displacement of the position of the coil (coil substrate 20) from the design value is suppressed. This improves the positional accuracy of the coil formed by the wirings 61 to 67.

(4) The substrate 30 is formed to have a greater rigidity than each of the insulating layers 51 to 57. For example, the substrate 30 is formed to be thicker than each of the insulating layers 51 to 57. In this manner, as the substrate 30 has a greater rigidity, the thermal deformation of the entire coil substrate 20 is suppressed.

(5) The stacked structure 23 is formed by laminating the structural bodies 41 to 47 on the substrate 30, and the wiring 61 is arranged at the lowermost layer of the stacked structure 23. The wiring 61 (for example, a copper layer) has greater adhesion to the insulation film 25 than the substrate 30 (for example, the polyimide film). This improves the adhesion between the stacked structure 23 and the insulation film 25 as compared to when the substrate 30 is arranged at the lowermost layer of the stacked structure 23. If the substrate 30 is arranged at the lowermost layer of the stacked structure 23, it is necessary to perform a surface treatment (for example, a plasma processing) on the lower surface of the substrate 30 before forming the insulation film 25 in order to increase the adhesion between the substrate 30 and the insulation film 25. On the contrary, in this example, there is no need to perform such a surface treatment since the adhesion between the wiring 61 and the insulation film 25 is high.

(6) The insulation film 25 covering the side surface of the wiring 61 exposed at the grooves 61X and 61Y is formed. This increases a contact area between the insulation film 25 and the wiring 61 so that the adhesion between the insulation film 25 and the wiring 61 is further improved.

(7) The stacked structure 23 and the outer frame 13 share the substrate 30 in the coil substrate 10, and the sprocket holes 13X are formed in the outer frame 13. Thus, the coil substrate 10 may easily be transferred by using the sprocket holes 13X of the substrate 30 without an additional member.

(8) Instead of the manufacturing method of the present embodiment, the method in which the wirings corresponding to the shape of the coil are formed in the structural bodies before the structural bodies are stacked may be used. For example, the wirings 61 to 67 illustrated in FIG. 7 (i.e., the state in which the through hole 23X is formed) are formed in the structural bodies 41 to 47, and then the structural bodies 41 to 47 are stacked on the substrate 30 to form the stacked structure 23. However, in such a method, the positions of the wirings 61 to 67 may be deviated in the planar direction (e.g., right and left) so that the stacked wirings 61 to 67 do not promptly overlap in the planar view. In this case, when the through hole or the like is formed in the stacked structure, a portion of the wiring that is positional-deviated may be removed. Such a problem may be solved by, for example, thinning the wiring formed in each of the structural bodies. However, in this case, DC resistance of the coil may increase.

On the contrary, in the manufacturing method of the present embodiment, the metal layers (the wirings 61 to 67 during the manufacturing process) having a planar shape larger than the wirings 61 to 67 with the helical coil shape (see FIG. 7) are formed in the structural bodies 41 to 47. Then, the structural bodies 41 to 47 are stacked on the substrate 30 to form the stacked structure 23, and the stacked structure 23 is formed into the helical coil shape. Thus, the wirings 61 to 67 are not deviated in the planar direction, and the wirings 61 to 67 overlapping one another in the planar view are stacked with a high accuracy. Therefore, the helical coil is formed with a favorable accuracy. As a result, the DC resistance of the helical coil is decreased. In other words, since there is no need to consider the positional deviation of the wirings 61 to 67 in the planar direction, it is possible to increase each width of the wirings 61 to 67.

(9) The reel-like (tape-like) flexible insulating resin film is used for each of the substrate 100 and the support films 102 to 107. Accordingly, the coil substrate 10 may be manufactured by a reel-to-reel method. This realizes mass production to reduce cost of the coil substrate 10.

(10) The number of turns of each of the wirings 61 to 67 is set to be less than or equal to one turn of the coil. This increases the width of the wiring formed in one structural body. In other words, a cross-sectional area of each of the wirings 61 to 67 is increased in the width direction so that the winding resistance related to the performance of the inductor can be reduced.

(11) The metal layers 61D to 67D are formed as the dummy patterns in the structural bodies 41 to 47. This decreases the difference in shapes of the conductive layers between the structural bodies 41 to 47. Accordingly, generation of unevenness in the insulating layers 51 to 57 covering the conductive layers is suppressed.

(12) The metal layers 81 to 87 are stacked on the substrate 30 at the position of the connection 12. This increases the mechanical strength of the entire coil substrate 10.

(13) The wirings 62 to 67 are electrically connected to one another by the through electrodes (via wirings V2 to V13). Each of the through electrodes connects two adjacent structural bodies in the thickness direction of the stacked structure 23. Each of the through electrodes extends through the insulating layer of a lower side one of the two adjacent structural bodies and the wiring and the insulating layer of an upper side one of the two adjacent structural bodies. Thus, the through electrodes are formed at two positions in each of the insulating layers 52 to 57. For example, the via wirings V2 and V3 are formed in the insulating layer 52. Similarly, the via wirings V4 and V5 are formed in the insulating layer 53. Similarly, the via wirings V6 and V7 are formed in the insulating layer 54. Similarly, the via wirings V8 and V9 are formed in the insulating layer 55. Similarly, the via wirings V10 and V11 are formed in the insulating layer 56. Similarly, the via wirings V12 and V13 are formed in the insulating layer 57. According to this structure, each of the via wirings V2 to V13 serves as the support for maintaining the rigidity of the insulating layers 52 to 57. Thus, distortion of the entire inductor 90 is suppressed.

It should be apparent to those skilled in the art that the present invention may be embodied in many other specific forms without departing from the scope of the invention. Particularly, it should be understood that the present invention may be embodied in the following forms.

Figure 31A:
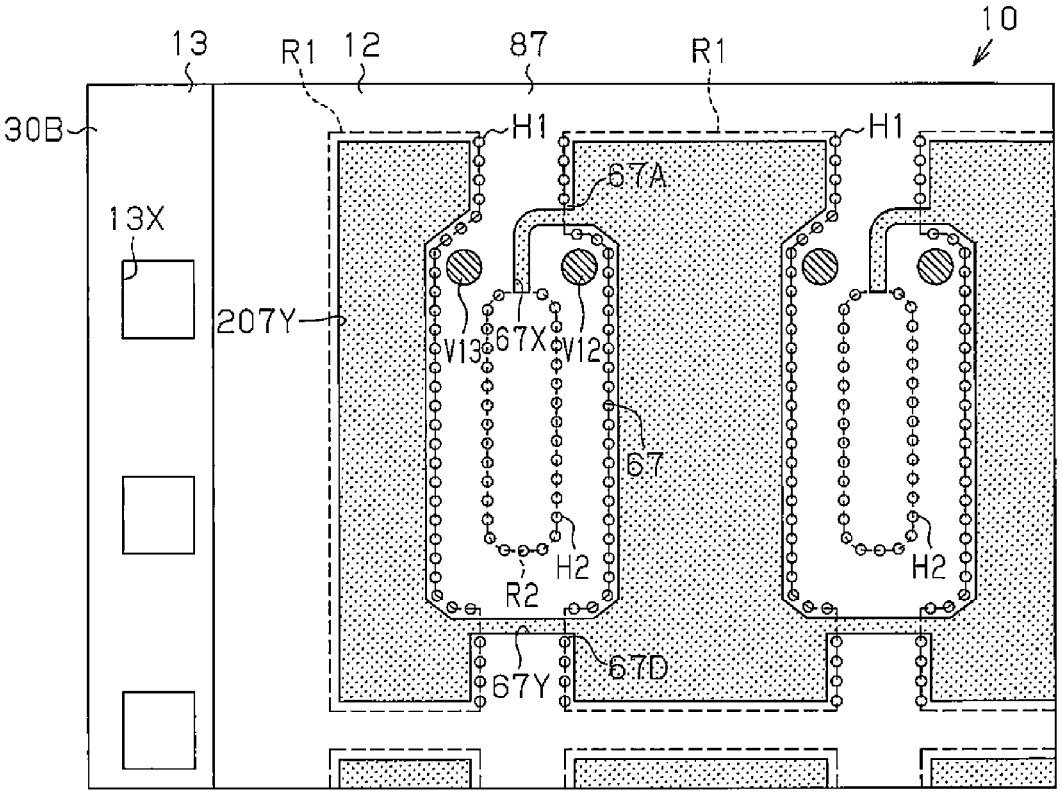
FIGS. 31A and 31B are schematic plan views illustrating how to prevent sag of coil patterns when the coil substrate is punched out.
Figure 31B:
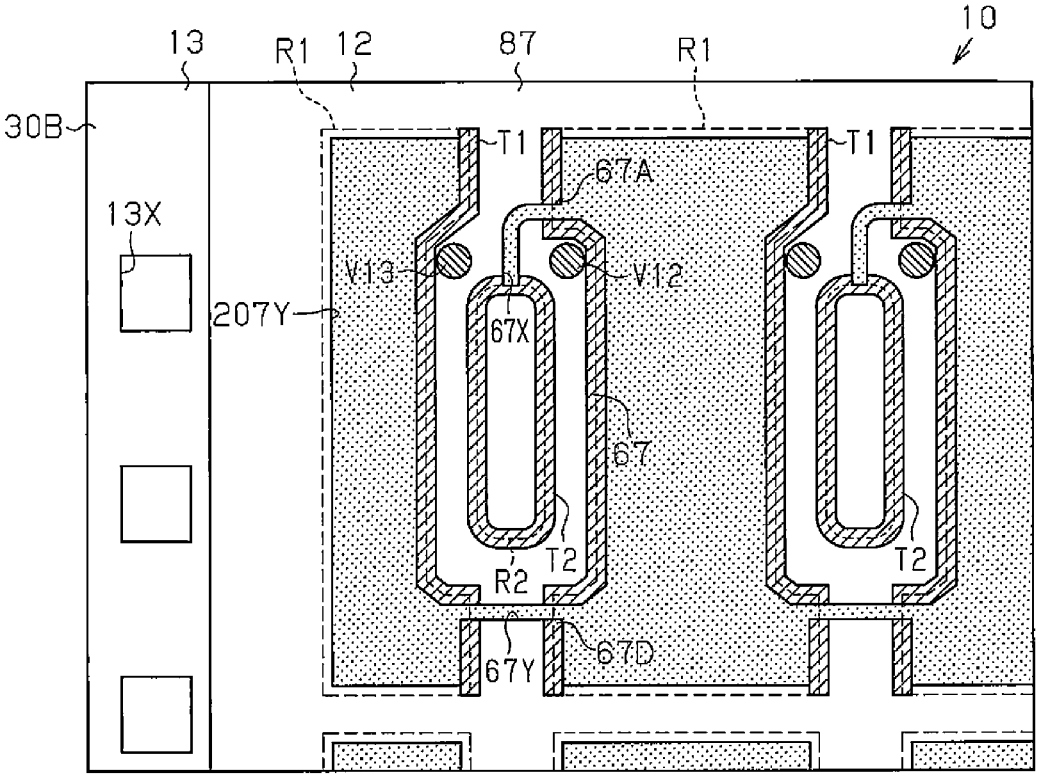

In the manufacturing, for example, as illustrated in FIG. 31A, punching holes H1 and H2 may be partially formed in the coil pattern of each metal layer (each of wirings 61 to 67 of the coil substrate 10) at a region overlapping a peripheral edge of each of the punching regions R1 and R2 in the planar view. The planar shape of the punching holes H1 and H2 may have any shape. For example, each of the punching holes H1 and H2 may be a circular shape or polygonal shape in the planar view. Alternatively, for example, as illustrated in FIG. 31B, a thinning process may be performed to form thinned portion T1 and T2 in the coil pattern of each metal layer (each of wirings 61 to 67 of the coil substrate 10) at the region overlapping the peripheral edge of each of the punching regions R1 and R2 in the planar view. The punching holes H1 and H2 and the thinned portions T1 and T2 prevents an edge of the coil pattern of each metal layer from sagging when the coil substrate 10 is punched out by the press processing. This prevents short-circuiting between the adjacent coil patterns of the metal layers.

In the manufacturing method of the above embodiment, the formation of the openings 201Y to 207Y may be omitted. In this case, only the grooves 61X and 61Y are formed in the metal foil 161 covering the entire lower surface of the insulating layer 51 in the step of patterning the metal foil 161 (for example, the step illustrated in FIG. 11B). In other words, the metal layer covering the lower surface of the insulating layer 51 except for the grooves 61X and 61Y is formed by leaving the metal foil 161 except for the grooves 61X and 61Y. The other layers are also similarly formed. For example, the metal layer covering the lower surface of the insulating layer 52 except for the through hole 42X and the grooves 62Y and 62Z is formed in the lower surface of the insulating layer 52.

In the above embodiment, the formation of the metal layers 81 to 87 may be omitted.

In the above embodiment, the formation of the metal layers 61D to 67D (dummy patterns) may be omitted.

In the above embodiment, a recognition mark similar to the recognition mark 12X may be formed in the outer frame 13. In other words, a through hole for positioning may be formed in the outer frame 13. In this case, both of the recognition mark and the sprocket hole 13X may be formed in the outer frame 13. Alternatively, only the recognition mark may be formed in the outer frame 13.

In the above embodiment, the insulation film 25 may be omitted. For example, when the encapsulating resin 91 does not have the magnetic material, the insulation film 25 covering the coil substrate 20 is not necessary. Therefore, the insulation film 25 may be omitted. In such a case, since the encapsulating resin 91 does not have the magnetic material which causes a short circuit, the encapsulating resin 91 may be formed directly on the coil substrate 20.

In the above embodiment, there is no particular limit to the number of the structural bodies stacked on both surfaces of the substrate 30. For example, two or more structural bodies may be stacked on the lower surface 30A of the substrate 30. Further, and one to five, or seven or more structural bodies may be stacked on the upper surface 30B of the substrate 30. Further, the number of the structural bodies stacked on the lower surface 30A of the substrate 30 and the number of the structural bodies stacked on the upper surface 30B of the substrate 30 may be determined such that the substrate 30 is positioned adjacent to the center of the stacked structure 23 in the thickness direction.

In the above embodiment, the insulating layer 51 may be omitted. In this case, the surface treatment such as the plasma processing is preferably performed on the lower surface 30A of the substrate 30 so as to improve the adhesion between the substrate 30 and the wiring 61. Even in this case, it is possible to sufficiently secure the insulation between the wiring 61 and the wiring 62 by the substrate 30.

In the above embodiment, the turn number of each of the wirings may be changed. As in the embodiment described above, the wiring of about one turn and the wiring of about ¾ turn may be combined, or the wiring of about one turn and the wiring of about ½ turn may be combined. When the wiring of about ¾ turn is used, the wirings having four patterns (wirings 62, 63, 64, and 65 in the example of the above embodiment) are required. Meanwhile, when the wiring of about ½ turn is used, a helical coil can be formed by using the wirings having only two patterns.

CLAUSES

This disclosure further encompasses various embodiments described below.

1. A method for manufacturing a coil substrate, the method including:

preparing a substrate;

stacking a first structural body, which includes a first metal layer, on a lower surface of the substrate;

sequentially stacking a plurality of second structural bodies on an upper surface of the substrate, wherein the plurality of second structural bodies include a plurality of second metal layers and a plurality of insulating layers, respectively, and each of the insulating layers covers a corresponding one of the second metal layers; and forming a stacked structure, which includes the substrate, the first structural body, and the second structural bodies, in a helical coil shape, wherein the subsequently stacking a plurality of second structural bodies includes using a support when stacking each of the second structural bodies, removing the support after stacking each of the second structural bodies, bonding the substrate and the second structural bodies by a plurality of adhesive layers, the adhesive layers being arranged one by one between the substrate and the second structural bodies, and connecting the first metal layer and the second metal layers in series to one another, wherein a plurality of through holes for transferring or positioning the coil substrate are formed at both ends of the substrate and both ends of the support, and the substrate has a thickness greater than that of each of the insulating layers.

The present examples and embodiments are to be considered as illustrative and not restrictive, and the invention is not to be limited to the details given herein, but may be modified within the scope and equivalence of the appended claims.

The invention claimed is:

1. An inductor comprising:

a stacked structure including a substrate, a first structural body stacked on a lower surface of the substrate, and a plurality of second structural bodies sequentially stacked on an upper surface of the substrate;

a through hole extending through the stacked structure in a thickness direction; and an insulation film covering the stacked structure, wherein:

the first structural body includes a first insulating layer, which is stacked on the lower surface of the substrate, and a first wiring, which is stacked on a lower surface of the first insulating layer;

the first wiring is positioned at a lowermost layer of the stacked structure;

the plurality of second structural bodies include a plurality of second insulating layers and a plurality of second wirings, respectively;

one of the second insulating layers is positioned at an uppermost layer of the stacked structure;

each of the second insulating layers is stacked on an upper surface of a corresponding one of the second wirings;

an inner surface of the substrate, an inner surface of the first structural body, and inner surfaces of the second structural bodies define an inner wall surface of the through hole;

the first wiring includes a first connection portion;

the second wiring of the uppermost one of the second structural bodies includes a second connection portion;

the insulation film covers the stacked structure except for a surface of the stacked structure on which the first connection portion and the second connection portion are exposed;

the first wiring and the second wirings are connected in series to one another to form a helical coil; and the substrate has a thickness greater than that of the first insulating layer and greater than that of each of the second insulating layers.

2. The inductor according to claim 1, further comprising:

an encapsulating resin that covers the insulation film except for the surface of the stacked structure on which the first connection portion and the second connection portion are exposed; and two electrodes formed on the surface of the stacked structure on which the first connection portion and the second connection portion are exposed so that the two electrodes are electrically connected to the first connection portion and the second connection portion, respectively.

3. The inductor according to claim 2, wherein the encapsulating resin includes a magnetic material.

4. The inductor according to claim 1, further comprising:

a plurality of through electrodes that electrically connect the plurality of second wirings to one another, wherein each of the through electrodes extends through the second insulating layer of a lower side one of two adjacent second structural bodies in the thickness direction and the second wiring and the second insulating layer of an upper side one of the two adjacent second structural bodies.

5. The inductor according to claim 1, further comprising:

a plurality of adhesive layers that bond the substrate and the second structural bodies to one another, wherein the adhesive layers are arranged one by one between the substrate and the second structural bodies.

6. A coil substrate comprising:

a block including a plurality of unit coil substrates formed in a plurality of areas, wherein each of the unit coil substrates includes:

a stacked structure including a substrate, a first structural body stacked on a lower surface of the substrate, and a plurality of second structural bodies sequentially stacked on an upper surface of the substrate;

a through hole extending through the stacked structure in a thickness direction; and an insulation film covering the stacked structure, wherein:

the first structural body includes a first insulating layer, which is stacked on the lower surface of the substrate, and a first wiring, which is stacked on a lower surface of the first insulating layer;

the first wiring is positioned at a lowermost layer of the stacked structure;

the plurality of second structural bodies include a plurality of second insulating layers and a plurality of second wirings, respectively;

one of the second insulating layers is positioned at an uppermost layer of the stacked structure;

each of the second insulating layers is stacked on an upper surface of a corresponding one of the second wirings;

an inner surface of the substrate, an inner surface of the first structural body, and inner surfaces of the second structural bodies define an inner wall surface of the through hole;

the first wiring includes a first connection portion;

the second wiring positioned at the uppermost one of the second structural bodies includes a second connection portion;

the insulation film covers the stacked structure except for a surface of the stacked structure on which the first connection portion and the second connection portion are exposed;

the first wiring and the second wirings are connected in series to one another to form a helical coil; and the substrate has a thickness greater than that of the first insulating layer and greater than that of each of the second insulating layers.

7. The coil substrate according to claim 6, further comprising:

an encapsulating resin that covers an upper surface and a lower surface of the insulation film and is filled in the through hole.

8. The coil substrate according to claim 7, wherein the encapsulating resin includes a magnetic material.

9. The coil substrate according to claim 6, further comprising:

a plurality of through electrodes that electrically connect the plurality of second wirings to one another, wherein each of the through electrodes extends through the second insulating layer of a lower side one of two adjacent second structural bodies in the thickness direction and the second wiring and the second insulating layer of an upper side one of the two adjacent second structural bodies.

10. The coil substrate according to claim 6, further comprising:

a plurality of adhesive layers that bond the substrate and the second structural bodies to one another, wherein the adhesive layers are arranged one by one between the substrate and the second structural bodies.

11. The coil substrate according to claim 6, further comprising:

an outer frame projecting outward from the block, wherein the outer frame is formed by the substrate, and the outer frame includes a through hole for transferring or positioning the coil substrate.

* * * * *